US012145032B2

(12) United States Patent
Stokke et al.

(10) Patent No.: US 12,145,032 B2
(45) Date of Patent: Nov. 19, 2024

(54) GOLF CLUB HEAD HAVING AN ADJUSTABLE WEIGHTING SYSTEM

(71) Applicant: KARSTEN MANUFACTURING CORPORATION, Phoenix, AZ (US)

(72) Inventors: Ryan M. Stokke, Anthem, AZ (US); David A. Higdon, Cave Creek, AZ (US); Martin R. Jertson, Phoenix, AZ (US); Jeremy Pope, Phoenix, AZ (US); Xiaojian Chen, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 18/183,634

(22) Filed: Mar. 14, 2023

(65) Prior Publication Data

US 2023/0211212 A1 Jul. 6, 2023

Related U.S. Application Data

(63) Continuation of application No. 17/334,312, filed on May 28, 2021, now Pat. No. 11,602,678, which is a (Continued)

(51) Int. Cl.

| | |
|---|---|
| ***A63B 53/04*** | (2015.01) |
| ***A63B 53/06*** | (2015.01) |
| *A63B 53/02* | (2015.01) |

(52) U.S. Cl.

CPC ..... *A63B 53/0466* (2013.01); *A63B 53/04* (2013.01); *A63B 53/06* (2013.01); *A63B 53/023* (2020.08); *A63B 53/025* (2020.08); *A63B 53/026* (2020.08); *A63B 53/0408* (2020.08); *A63B 53/0412* (2020.08); *A63B 53/0433* (2020.08);

(Continued)

(58) Field of Classification Search

CPC ..... A63B 53/04; A63B 53/06; A63B 53/0433; A63B 2053/0491

See application file for complete search history.

(56) References Cited

U.S. PATENT DOCUMENTS 806,782 A 12/1905 Damon
4,043,563 A 8/1977 Churchward (Continued)

FOREIGN PATENT DOCUMENTS

WO 2007076304 7/2007

OTHER PUBLICATIONS

PCT/US2017/040121 filed Jun. 29, 2017; WO/ISR mailed Nov. 21, 2017.

*Primary Examiner* — William M Pierce

(57) ABSTRACT

A golf club head includes a club body having a crown opposite a sole, a toe end opposite a heel end, a back end, and a hosel. The golf club head also includes an adjustable weighting system positioned on the club body, the adjustable weighting system includes a single channel and a member that is received by the single channel and fastened to the club body, where a plurality of weights are coupled to the member. The golf club head can additionally or alternatively include a face angle adjustment system positioned on the sole, the face angle adjustment system includes a member that is removably received by the single channel and fastened to the sole, the member includes a first end member and a second end member, wherein the member is configured to be repositioned within the channel to adjust a resting face angle of the golf club head.

18 Claims, 25 Drawing Sheets

Related U.S. Application Data continuation of application No. 16/669,376, filed on Oct. 30, 2019, now Pat. No. 11,020,637, which is a continuation of application No. 15/877,516, filed on Jan. 23, 2018, now Pat. No. 10,463,928, which is a continuation-in-part of application No. PCT/US2017/040121, filed on Jun. 29, 2017.

(60) Provisional application No. 62/509,817, filed on May 23, 2017, provisional application No. 62/501,474, filed on May 4, 2017, provisional application No. 62/449,332, filed on Jan. 23, 2017, provisional application No. 62/356,415, filed on Jun. 29, 2016.

(52) U.S. Cl.
CPC ... *A63B 53/0445* (2020.08); *A63B 2053/0491* (2013.01); *A63B 2053/0495* (2013.01)

(56) References Cited

U.S. PATENT DOCUMENTS

| | | | |
|---|---|---|---|
| 4,432,549 | A | 2/1984 | Zebelean |
| 4,695,054 | A | 9/1987 | Tunstall |
| 5,518,243 | A | 5/1996 | Redman |
| 6,089,994 | A | 7/2000 | Sun |
| 6,409,612 | B1 | 6/2002 | Evans |
| 6,458,044 | B1 | 10/2002 | Vincent |
| 6,592,468 | B2 | 7/2003 | Vincent |
| 6,638,183 | B2 | 10/2003 | Takeda |
| 6,663,505 | B1 | 12/2003 | Solari |
| 6,860,818 | B2 | 3/2005 | Mahaffey |
| 6,988,960 | B2 | 1/2006 | Mahaffey |
| 7,004,852 | B2 | 2/2006 | Billings |
| 7,153,220 | B2 | 12/2006 | Lo |
| 7,166,041 | B2 | 1/2007 | Evans |
| 7,530,903 | B2 | 5/2009 | Imamoto |
| 7,549,935 | B2 | 6/2009 | Foster |
| 7,824,280 | B2 | 11/2010 | Yokota |
| 7,927,231 | B2 | 4/2011 | Sato |
| 7,967,699 | B2 | 6/2011 | Soracco |
| 8,033,930 | B2 | 10/2011 | Tavares |
| 8,043,167 | B2 | 10/2011 | Boyd |
| 8,292,757 | B2 | 10/2012 | Soracco |
| 8,337,325 | B2 | 12/2012 | Boyd |
| 8,409,031 | B2 | 4/2013 | Stites |
| 8,517,851 | B2 | 8/2013 | Cackett |
| 8,668,596 | B2 | 3/2014 | Cackett |
| 8,684,863 | B2 | 4/2014 | Bezilla |
| 8,690,706 | B2 | 4/2014 | Stites |
| 8,702,533 | B2 | 4/2014 | Evans |
| 8,715,106 | B1 | 5/2014 | Seluga |
| 8,747,253 | B2 | 6/2014 | Stites |
| 8,753,225 | B1 | 6/2014 | Abbott |
| 8,777,774 | B1 | 7/2014 | Kim |
| 8,790,195 | B1 | 7/2014 | Myers |
| 8,870,679 | B2 | 10/2014 | Oldknow |
| 9,033,813 | B2 | 5/2015 | Oldknow |
| 9,205,312 | B2 | 12/2015 | Zimmerman |
| 9,216,333 | B2 | 12/2015 | Bezilla |
| 9,259,627 | B1 | 2/2016 | Myers |
| 9,295,885 | B2 | 3/2016 | Matsunaga |
| 9,333,404 | B2 | 5/2016 | Abbott |
| 9,358,436 | B2 | 6/2016 | Sargent |
| 9,375,618 | B2 | 6/2016 | Myers |
| 9,393,467 | B2 | 7/2016 | Kitagawa |
| 9,433,836 | B2 | 9/2016 | Breier |
| 9,480,890 | B2 | 11/2016 | Matsunaga |
| 9,623,302 | B1 | 4/2017 | Myers |
| 9,764,210 | B2 | 9/2017 | Curtis |
| 9,914,028 | B1 | 3/2018 | Cleghorn |
| 9,975,012 | B2 | 5/2018 | Sanchez |
| 10,183,202 | B1 | 1/2019 | Harbert |
| 10,463,928 | B2 | 11/2019 | Stokke |
| 10,556,161 | B2 | 2/2020 | Jertson |
| 11,020,637 | B2 | 6/2021 | Stokke |
| 11,534,687 | B2 | 12/2022 | Nomura |
| 2001/0011044 | A1 | 8/2001 | Galy |
| 2013/0244808 | A1 | 9/2013 | Bennett |
| 2013/0344988 | A1 | 12/2013 | Hettinger |
| 2014/0274441 | A1 | 9/2014 | Greer |
| 2016/0101330 | A1 | 4/2016 | Harrington |
| 2021/0299525 | A1 | 9/2021 | Mizutani |

GOLF CLUB HEAD HAVING AN ADJUSTABLE WEIGHTING SYSTEM

CROSS REFERENCE

This is a continuation of U.S. patent application Ser. No. 17/334,312, filed May 28, 2021, which is a continuation of U.S. patent application Ser. No. 16/669,376, filed Oct. 30, 2019, which is a continuation of U.S. patent application Ser. No. 15/877,516, filed Jan. 23, 2018, now U.S. Pat. No. 10,463,928, which is a continuation in part of PCT/US17/40121, filed Jun. 29, 2017, and further claims the benefit of U.S. Provisional Application No. 62/509,817, filed May 23, 2017, U.S. Provisional Application No. 62/501,474, filed May 4, 2017, U.S. Provisional Application No. 62/449,332, filed Jan. 23, 2017, and PCT/US17/40121 further claims the benefit of U.S. Provisional Application No. 62/356,415, filed Jun. 29, 2016, the contents of all of which are incorporated in their entirety.

FIELD OF THE INVENTION

The present disclosure relates to a golf club, and more specifically to an adjustable weighting system for a golf club head that includes a single port that receives a member. One or more weights can be attached at one or more locations on the member.

BACKGROUND

Various characteristics of a golf club can affect the performance of the golf club. For example, the center of gravity and the moment of inertia of the golf club head are characteristics that can affect performance.

The center of gravity and moment of inertia of the golf club head are functions of the distribution of mass of the golf club head. In particular, distributing mass of the club head to be closer to a sole portion of the club head, closer to a strike face of the club head, and/or closer to a toe portion and heel portion of the club head can alter the center of gravity and/or the moment of inertia of the club head. Altering the moment of inertia of the club head can in turn alter the forgiveness of the golf club, flight direction of the golf ball, and/or flight angle of the golf ball.

Many weighting systems in current golf club heads require bulky and complex internal structures that reduce club head moment of inertia and move the club head center of gravity up (toward the crown) and forward (toward the face). There is a need in the art for a club head that provides user adjustability of club head weighting and center of gravity position to affect ball flight (trajectory and/or spin), without negatively impacting moment of inertia or center of gravity positon.

DETAILED DESCRIPTION

Figure 1:
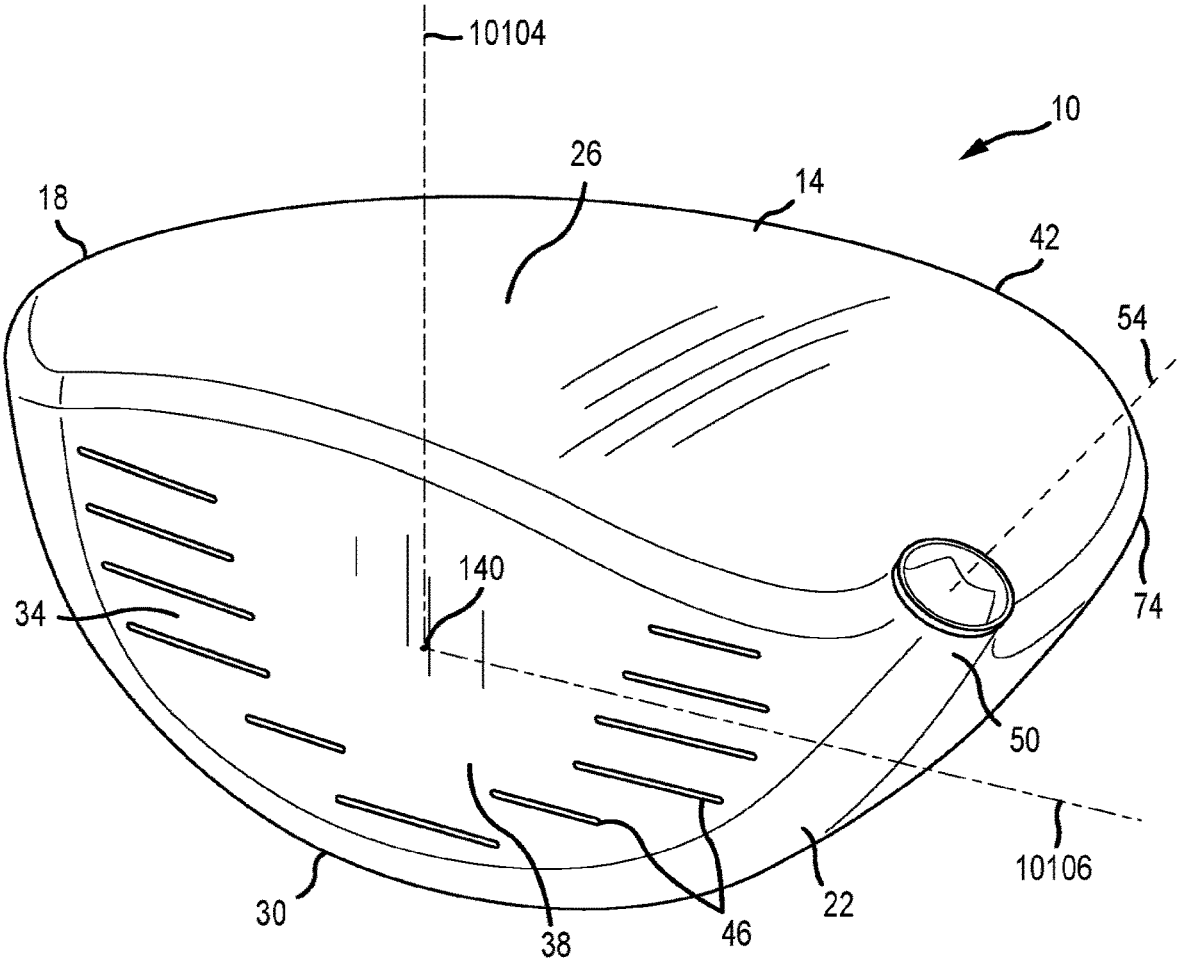
FIG. 1 is a perspective view of a golf club head that includes one or more embodiments of an adjustable weighting system as disclosed herein.

Described herein is a golf club head having a multi-component adjustable weighting system that allows user adjustability of club head center of gravity, while maintaining a high moment of inertia and low and back head center of gravity position. In many embodiments, the club head includes a club body having a crown opposite a sole, a toe end opposite a heel end, a back end, a hosel, and a channel formed in the club body. The adjustable weighting system includes a member configured to be received by the channel and fastened to the club body, the member includes a member body having a first end and a second end. A first weight configured to be coupled to the first end of the member body, and a second weight configured to be coupled to the second end of the member body. The first and second weight can be replaced or repositioned to adjust the club head center of gravity, thereby changing ball flight characteristics (i.e. ball spin or trajectory). In many embodiments, the adjustable weighting system can be removably coupled to the channel using a fastener that comprises a density similar to or less than the density of the club head body.

In many embodiments, the adjustable weighting systems described herein protrude from the external contour of the club head, or are minimally insert from the external contour of the club head. Further, in many embodiments the adjustable weighting systems described herein are positioned near the perimeter of the club head. The positioning of the adjustable weighting systems maximizes perimeter weighting and low and back weight positioning, thereby maximizing club head moment of inertia for forgiveness on off-center hits and positioning the club head center of gravity low and back to increase launch angle and reduce backspin. Accordingly, the golf club heads described herein provide user adjustability of club head center of gravity to adjust ball flight, while maintaining optimal design and performance characteristics (high moment of inertia and low and back center of gravity position).

Many embodiments described herein include adjustable weighting systems positioned within a recess or channel, without requiring significant internal structures that would adversely affect moment of inertia and head center of gravity position.

The terms "loft" or "loft angle" of a golf club, as described herein, refers to the angle formed between the club face and the shaft, as measured by any suitable loft and lie machine.

The term "face angle" of a golf club, as described herein, refers to the angle formed between the club face and the golf ball, and more specifically between the club face and an imaginary line that extends from the golf ball along a player's intended target line. The terms "face angle at address" or "resting face angle" of a golf club, as described herein, refers to the angle formed between the club face and the golf ball at address (i.e., prior to the swing), and more specifically between the club face and an imaginary line that extends from the golf ball along a player's intended target line at address. It should be appreciated that the face angle is in a neutral position when the club face is square (or generally perpendicular) to the golf ball/imaginary line. The face angle is in an open position when the club head rotates about the shaft such that the toe end moves away from the ball. The face angle is in a closed position when the club head rotates about the shaft such that the toe end moves towards the ball.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

For ease of discussion and understanding, and for purposes of description only, the following detailed description illustrates a golf club head 10 as a wood, and more specifically a driver. It should be appreciated that the wood is provided for purposes of illustration of one or more embodiments of an adjustable weighting system 100, 500, 700, 800, 900, 1000, 1100, 1300, 1400, 1500, 1600, 1700, 1800, 1900, 2000, 2100, 2200, 2300. The disclosed systems 100, 500, 700, 800, 900, 1000, 1100, 1300, 1400, 1500, 1600, 1700, 1800, 1900, 2000, 2100, 2200, 2300, can be used on any desired wood, hybrid, iron, or other golf club where one or more weights can be adjustably positioned on the golf club head and/or the face angle at address can be adjusted. For example, the club head 10 may include, but is not limited to, a driver, a fairway wood, a hybrid, a one-iron, a two-iron, a three-iron, a four-iron, a five-iron, a six-iron, a seven-iron, an eight-iron, a nine-iron, a pitching wedge, a gap wedge, a utility wedge, a sand wedge, a lob wedge, and/or a putter. In addition, the golf club head 10 can have a loft that can range from approximately 3 degrees to approximately 65 degrees (including, but not limited to, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, 20, 20.5, 21, 21.5, 22, 22.5, 23, 23.5, 24, 24.5, 25, 25.5, 26, 26.5, 27, 27.5, 28, 28.5, 29, 29.5, 30, 30.5, 31, 31.5, 32, 32.5, 33, 33.5, 34, 34.5, 35, 35.5, 36, 36.5, 37, 37.5, 38, 38.5, 39, 39.5, 40, 40.5, 41, 41.5, 42, 42.5, 43, 43.5, 44, 44.5, 45, 45.5, 46, 46.5, 47, 47.5, 48, 48.5, 49, 49.5, 50, 50.5, 51, 51.5, 52, 52.5, 53, 53.5, 54, 54.5, 55, 55.5, 56, 56.5, 57, 57.5, 58, 58.5, 59, 59.5, 60, 60.5, 61. 61.5, 62, 62.5, 63, 63.5, 64, 64.5, and/or 65 degrees).

A. Golf Club Head with Adjustable Weighting System

Figure 2:
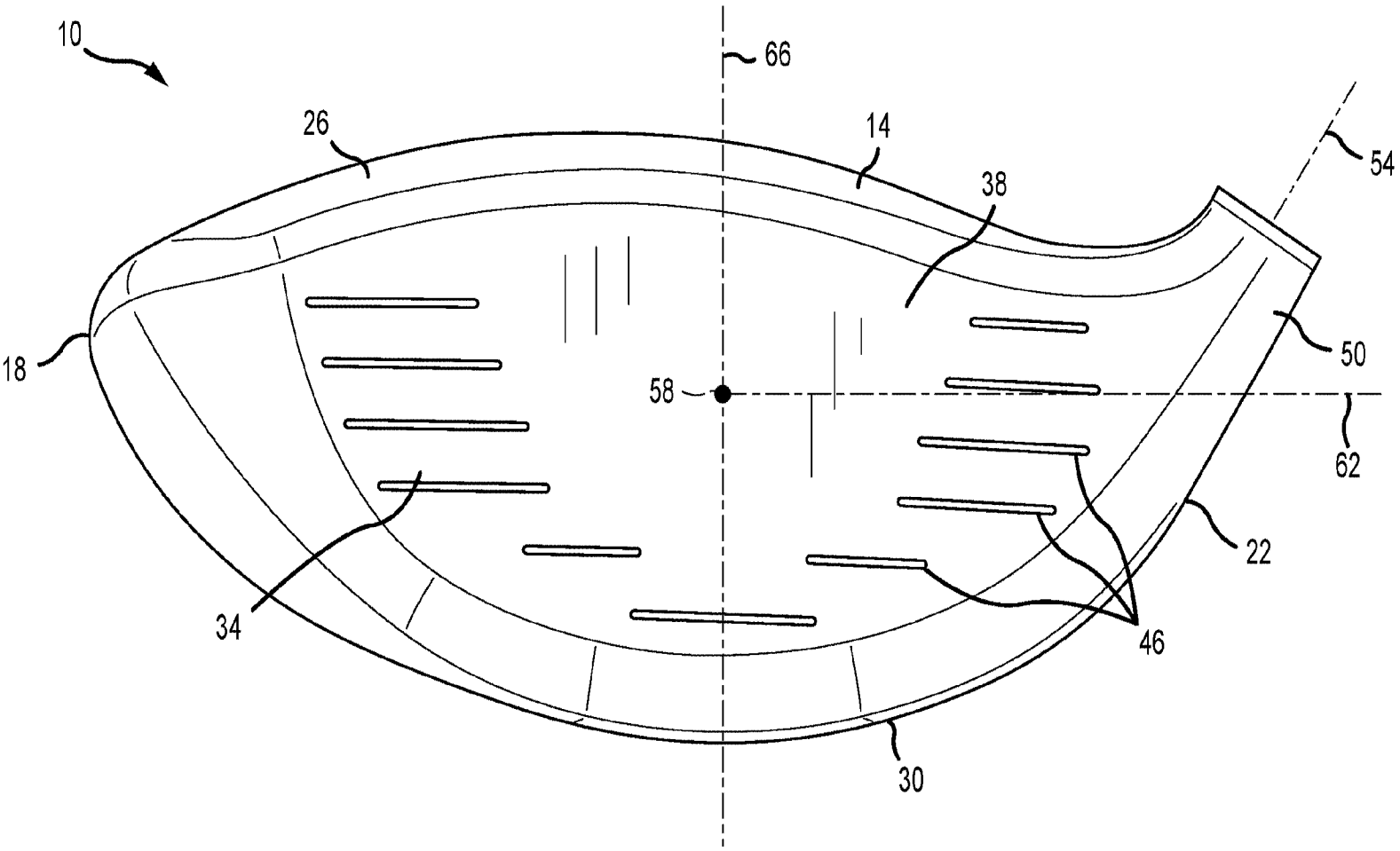
FIG. 2 is a front view of the club head of FIG. 1, illustrating the face plate.

Referring now to the figures, FIGS. 1-3 illustrate an embodiment of the golf club head 10 that incorporates one or more embodiments of the adjustable weighting system 100, 500, 700, 800, 900, 1000, 1100, 1300, 1400, 1500, 1600, 1700, 1800, 1900, 2000, 2100, 2200, 2300 disclosed herein. The adjustable weighting systems described herein comprise a weight structure that is removably coupled to a channel or recess in the club head body. The weight structure of the adjustable weighting system includes a member configured to receive a plurality of weights in various configurations. The adjustable weighting system can be removed from the channel of the club head, and the plurality of weights having different masses repositioned or replaced such that the club head center of gravity changes when the adjustable weighting system is repositioned within the cavity, thereby changing ball flight characteristics (i.e. ball spin or trajectory).

The golf club head 10 includes a club body 14 (or body 14) having a toe or toe end 18 opposite a heel or heel end 22. The body 14 also includes a crown or top 26 opposite a sole or bottom 30. The body 14 carries a face plate or strike plate or club face or strikeface 34 (shown in FIGS. 1-2) that defines a strike surface 38 (shown in FIGS. 1-2) and is opposite a rear end or back or rear or back end 42 (shown in FIG. 1). The golf club head 10 also includes a hosel 50 having a hosel axis 54 (shown in FIG. 2) that extends through a center of the hosel 50. The hosel 50 is configured to receive a golf club shaft (not shown) that carries a grip (not shown).

As illustrated in FIG. 3, the golf club head 10 includes a rail or skirt 74 that defines a transition area between the crown 26 and the sole 30. The rail 74 generally extends around the body 14 of the golf club head from an end of the face plate 34 at the toe end 18 to an end of the face plate 34 at the heel end 22. In the illustrated embodiment, the rail 74 is generally curved or arcuate in shape.

In many embodiments, the golf club head 10 comprises a driver-type club head. In these embodiments, the loft angle of the club head 10 can be less than approximately 16 degrees, less than approximately 15 degrees, less than approximately 14 degrees, less than approximately 13 degrees, less than approximately 12 degrees, less than approximately 11 degrees, or less than approximately 10 degrees. Further, in these embodiments, the volume of the club head 10 can be greater than approximately 400 cc, greater than approximately 425 cc, greater than approximately 450 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the club head can be approximately 400 cc-600 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

In some embodiments, the club head 10 can comprise a fairway wood-type club head. In these embodiments, the loft angle of the club head 10 can be less than approximately 35 degrees, less than approximately 34 degrees, less than approximately 33 degrees, less than approximately 32 degrees, less than approximately 31 degrees, or less than approximately 30 degrees. Further, in these embodiments, the loft angle of the club head 10 can be greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. Further, in these embodiments, the volume of the club head 10 can be less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. For example, the volume of the club head can be approximately 300 cc-400 cc, approximately 325 cc-400 cc, approximately 350 cc-400 cc, approximately 250 cc-400 cc, approximately 250-350 cc, or approximately 275-375 cc.

In some embodiments, the club head 10 can comprise a hybrid type club head. In these embodiments, the loft angle of the club head 10 can be less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in these embodiments, the loft angle of the club head 10 can be greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees. Further, in these embodiments, the volume of the club head 10 can be less than approximately 200 cc, less than approximately 175 cc, less than approximately 150 cc, less than approximately 125 cc, less than approximately 100 cc, or less than approximately 75 cc. For example, the volume of the club head can be approximately 100 cc-150 cc, approximately 75 cc-150 cc, approximately 100 cc-125 cc, or approximately 75 cc-125 cc. In other embodiments, the golf club head 10 can comprise any type of golf club head.

A plurality of grooves 46 (shown in FIGS. 1-2) are positioned on the face plate 34. The strikeface 34 of the club head 10 defines a geometric center 140. In some embodiments, the geometric center 140 can be located at the geometric centerpoint of a strikeface perimeter, and at a midpoint of face height. In the same or other examples, the geometric center 140 also can be centered with respect to engineered impact zone, which can be defined by a region of grooves on the strikeface. As another approach, the geometric center of the strikeface can be located in accordance with the definition of a golf governing body such as the United States Golf Association (USGA). For example, the geometric center 140 of the strikeface 34 can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

The club head 10 defines a loft plane 10102 tangent to the geometric center 140 of the strikeface 34. The club head 10 further defines a coordinate system having an origin located at the geometric center 140 of the strikeface 34. The coordinate system has an x' axis 10106, a y' axis 10104, and a z' axis 10108. The x' axis 10106 extends through the geometric center 140 of the strikeface 34 in a direction from the heel 22 to the toe 18 of the club head 10. The y' axis 10104 extends through the geometric center 140 of the strikeface 34 in a direction from the crown 26 to the sole 30 of the club head 10 and perpendicular to the x' axis 10106. The z' axis 10108 extends through the geometric center 140 of the strikeface 34 in a direction from the strikeface 34 to the back end 42 of the club head 10 and is perpendicular to the x' axis 10106 and the y' axis 10104.

The coordinate system defines an x'y' plane 10124 extending through the x' axis 10106 and the y' axis 10104; an x'z' plane 10126 extending through the x' axis 10106 and the z' axis 10108; and a y'z' plane 10128 extending through the y' axis 10104 and the z' axis 10108, wherein the x'y' plane 10124, the x'z' plane 10126, and the y'z' plane 10128 are all perpendicular to one another and intersect at the origin of the coordinate system located at the geometric center 140 of the strikeface 34. The x'y' plane 10124 extends parallel to the hosel axis 54 and is positioned at an angle corresponding to the loft angle of the club head 10 from the loft plane 10102. Further, the x' axis 10106 is positioned at a 60 degree angle to the hosel axis 54 when viewed from a direction perpendicular to the x'y' plane 10124.

In these or other embodiments, the club head 10 can be viewed from a front view (FIG. 2) when the strikeface 34 is viewed from a direction perpendicular to the x'y' plane 10124. Further, in these or other embodiments, the club head 10 can be viewed from a side view or side cross-sectional view (FIG. 3B) when the heel 22 is viewed from a direction perpendicular to the y'z' plane 10128.

Figure 3A:
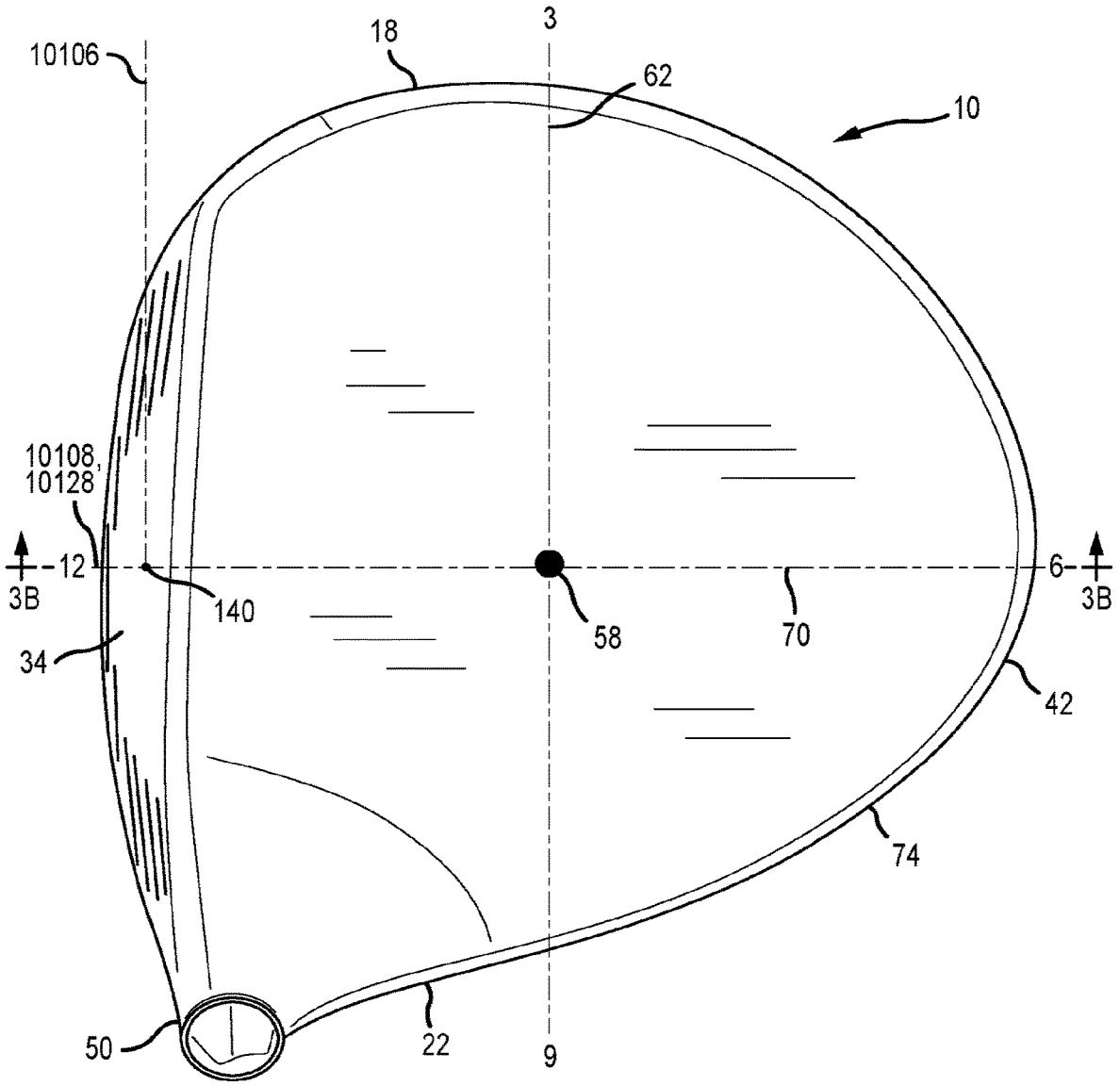
FIG. 3A is a top (or crown) view of the club head of FIG. 1.
Figure 3B:
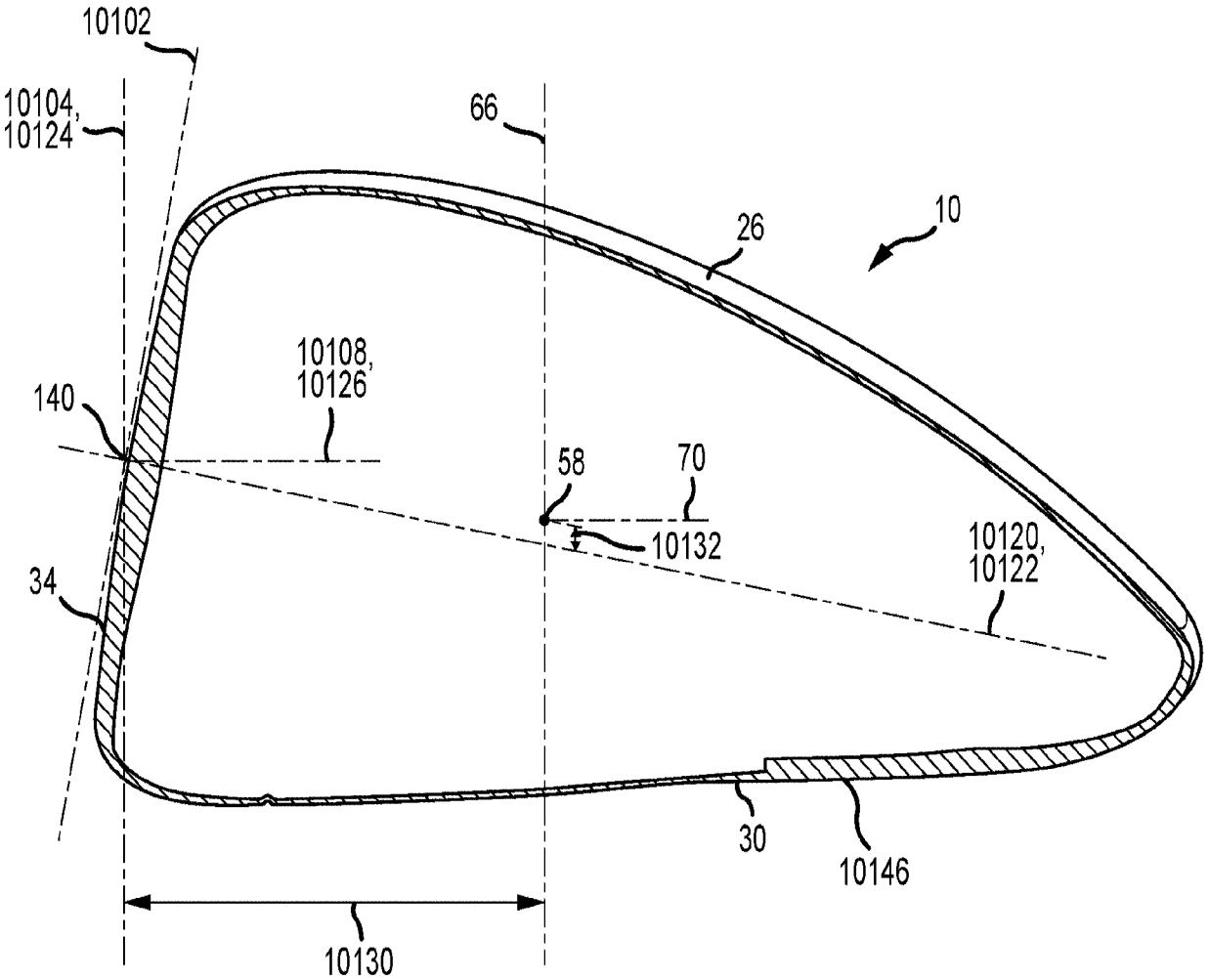
FIG. 3B is a side cross-sectional view of the club head of FIG. 1 taken along line 3B-3B of FIG. 3A.

Referring now to FIGS. 2, 3A, and 3B the golf club head 10 includes a center of gravity or CG 58 that defines an origin of a coordinate system including an x-axis 62, a y-axis 66, and a z-axis 70. The y-axis 66 (shown in FIG. 2) extends through the club head 10 center of gravity 58 from the crown or top 26 to the sole or bottom 30, is parallel to the hosel axis 54 when viewed from the side view, and is positioned at a 30 degree angle from the hosel axis 54 when viewed from a front view (FIG. 2). The x-axis 62 (shown in FIG. 3) extends through the club head center of gravity 58 from the toe or toe end 18 to the heel or heel end 22, perpendicular to y-axis 66 when viewed from a front view and parallel to the x'y' plane 10124. The z-axis 70 (shown in FIG. 3) extends through the center of gravity 58 of the club head 10 from the club face 34 to the back end 42 and perpendicular to the x-axis 62 and the y-axis 66. The x-axis 62 extends through the head CG 58 from the toe or toe end 18 to the heel or heel end 22 and parallel to the x' axis 10106. The y-axis 66 extends through the head CG 58 from the crown or top 26 to the sole or bottom 30 parallel to the y' axis 10104. The z-axis 70 extends through the head CG 58 from the club face 34 to the back end 42 and parallel to the z' axis 10108.

As shown in FIG. 3B, the club head 10 further comprises a head depth plane 10120 and a head depth axis 10122, wherein the head depth plane 10120 extends through the geometric center 140 of the strikeface 34, perpendicular to the loft plane 10102, in a direction from the heel 22 to the toe 18 of the club head 10, and the head depth axis 10122 extends through the geometric center 140 of the strikeface 34, perpendicular to the loft plane 10102. In many embodiments, the head CG 58 is located at a head CG depth 10130 from the x'y' plane 10124, measured in a direction perpendicular to the x'y' plane 10124. In some embodiments, the head CG 58 can be located at a head CG depth 10130 from the loft plane 10102, measured in a direction perpendicular to the loft plane 10102. The head CG 58 is further located at a head CG height 10132 from the head depth plane 10120, measured in a direction perpendicular to the head depth plane 10120. Further, the head CG height 10132 is measured as the offset distance of the head CG 58 from the head depth plane 10120 in a direction perpendicular to the head depth plane 10120 toward the crown 26 or toward the sole 30.

For additional guidance in describing the innovation herein, the x-axis 62 and the z-axis 70 are arranged to coincide with numbers on an analog clock in FIG. 3A. The z-axis 70 extends between 12 o'clock ("12" through the club face 34) and 6 o'clock ("6" through the back 42), and the x-axis 62 extends between 3 o'clock ("3" through the toe end 18) and 9 o'clock ("9" through the heel end 22).

Various golf club head parameters are important in achieving desired performance characteristics, such as club head moment of inertia, club head center of gravity position, and club head center of gravity adjustability. High club head moment of inertia results in increased club head forgiveness for off-center hits. A club head center of gravity positioned low and back (i.e. toward the sole and rear of the club head) beneficially increases moment of inertia, reduces backspin, and increases launch angle of a golf ball on impact. Adjustability of club head center of gravity allows for desired trajectory tuning of a club head by an end user. Each of these parameters are important in golf club design to achieve desired or optimal performance characteristics. However, including all of these parameters on a golf club head presents a design challenge, as many current center of gravity adjustability mechanisms (1) lower club head moment of inertia and/or (2) shift the club head center of gravity up and toward the front of the club head due to internal and/or bulky weight structures, and/or non-optimal weight structure positioning.

The embodiments of the golf club heads described below include adjustable weighting systems while maintaining or preventing a significant reduction in club head moment of inertia, and low and back club head center of gravity positioning. For example, many embodiments below describe low profile adjustable weighting systems and/or optimally positioned adjustable weighting systems to maintain a high club head moment of inertia and low and back club head center of gravity position, similar to a club head devoid of an adjustable weighting system, while providing user adjustability of ball flight and/or trajectory. Maintaining a high club head moment of inertia about the club head CG results in increased forgiveness for off-center hits, and maintaining a high club head moment if inertia about the hosel axis results in increased rotational stability during a swing. Further, maintaining a low and back club head center of gravity beneficially increases club head moment of inertia about the head CG and reduces backspin.

The club head 10 described herein comprises a moment of inertia about the x-axis $I_{xx}$ (i.e. crown-to-sole moment of inertia), a moment of inertia about the y-axis $I_{yy}$(i.e. heel-to-toe moment of inertia), and a moment of inertia about the hosel axis $I_{hh}$.

The club heads comprising the adjustable weighting systems described herein can have a moment of inertia about the x-axis $I_{xx}$ greater than 3100 g·cm$^2$, greater than 3200 g·cm$^2$, greater than 3300 g·cm$^2$, greater than 3400 g·cm$^2$, greater than 3500 g·cm$^2$, greater than 3600 g·cm$^2$, greater than 3700 g·cm$^2$, greater than 3800 g·cm$^2$, greater than 3900 g·cm$^2$, greater than 4000 g·cm$^2$, greater than 4100 g·cm$^2$, greater than 4200 g·cm$^2$, greater than 4300 g·cm$^2$, greater than 4400 g·cm$^2$, or greater than 4500 g·cm$^2$. In some embodiments, the club heads comprising the adjustable weighting systems described herein have a moment of inertia about the x-axis $I_{xx}$ between 3100 and 4000 g·cm$^2$, between 3100 and 3800 g·cm$^2$, between 3200 and 4000 g·cm$^2$, between 3200 and 4000 g·cm$^2$, between 3300 and 4000 g·cm$^2$, between 3400 and 4000 g·cm$^2$, or between 3500 and 4000 g·cm$^2$.

Further, the club heads comprising the adjustable weighting systems described herein can have a moment of inertia about the y-axis $I_{yy}$ greater than 4700 g·cm$^2$, greater than 4800 g·cm$^2$, greater than 4900 g·cm$^2$, greater than 5000 g·cm$^2$, greater than 5100 g·cm$^2$, greater than 5200 g·cm$^2$, greater than 5300 g·cm$^2$, greater than 5400 g·cm$^2$, greater than 5500 g·cm$^2$, greater than 5600 g·cm$^2$, greater than 5700 g·cm$^2$, greater than 5800 g. cm$^2$, greater than 5900 g·cm$^2$, or greater than 6000 g·cm$^2$. In some embodiments, the club heads comprising the adjustable weighting systems described herein have a moment of inertia about the y-axis $I_{yy}$ between 4800 and 6000 g·cm$^2$, between 4900 and 6000 g. cm$^2$, between 5000 and 6000 g·cm$^2$, between 5100 and 6000 g·cm$^2$, between 5200 and 6000 g·cm$^2$, between 5300 and 6000 g·cm$^2$, or between 5400 and 6000 g·cm$^2$.

Further still, the club heads comprising the adjustable weighting systems described herein can have a moment of inertia about the hosel-axis $I_{hh}$ greater than 7500 g·cm$^2$, greater than 8000 g·cm$^2$, greater than 8250 g·cm$^2$, greater than 8500 g·cm$^2$ greater than 8750 g·cm$^2$, greater than 9000 g·cm$^2$, greater than 9050 g·cm$^2$, or greater than 10000 g·cm$^2$. In some embodiments, the club heads comprising the adjustable weighting systems described herein have a moment of inertia about the hosel-axis $I_{hh}$ between 7500 and 10000 g·cm$^2$, between 8000 and 10000 g·cm$^2$, between 8500 and 10000 g·cm$^2$, or between 9000 and 10000 g·cm$^2$.

Referring to Relation 1 below, many embodiments of the club heads with adjustable weighting systems comprise a combined moment of inertia about the head CG ($MOI_{CG}$) defined as the sum of the moment of inertia about the x-axis and the moment of inertia about the y-axis.

$$MOI_{CG}=I_{xx}+I_{yy} \quad \text{Relation 1}$$

The combined moment of inertia about the head center of gravity $MOI_{CG}$ can be greater than 7600 g·in$^2$, greater than 7700 g·cm$^2$, greater than 7800 g·cm$^2$, greater than 7900 g·cm$^2$, greater than 8000 g·cm$^2$, greater than 8100 g·cm$^2$, greater than 8200 g·cm$^2$, greater than 8300 g·cm$^2$, greater than 8400 g·cm$^2$, greater than 8500 g·cm$^2$, greater than 8600 g·cm$^2$, greater than 8700 g·cm$^2$, greater than 8800 g·cm$^2$, greater than 8900 g·cm$^2$, greater than 9000 g·cm$^2$, greater than 9100 g·cm$^2$, greater than 9200 g·cm$^2$, or greater than 9300 g·cm$^2$. For example, the combined moment of inertia about the club head head center of gravity $MOI_{CG}$ can be between 7700 and 9500 g·cm$^2$, between 7800 and 9500 g·cm$^2$, between 7900 and 9500 g·cm$^2$, between 8000 and 9500 g·cm$^2$, between 8100 and 9500 g·cm$^2$, between 8200 and 9500 g·cm$^2$, or between 8300 and 9500 g·cm$^2$.

Referring to Relation 2 below, many embodiments of the club heads with adjustable weighting systems comprise a combined moment of inertia about the head CG and hosel ($MOI_{CG}$-H), defined as the sum of the moment of inertia about the x-axis, the moment of inertia about the y-axis, and the moment of inertia about the hosel axis.

$$MOI_{CG\text{-}H}=I_{xx}+I_{yy}+I_{hh} \quad \text{Relation 2}$$

The combined moment of inertia about the head CG and hosel $MOI_{CG}$-H can be greater than 14800 g·cm$^2$, greater than 14900 g·cm$^2$, greater than 15000 g·cm$^2$, greater than 15100 g·cm$^2$, greater than 15200 g·cm$^2$, greater than 15300 g·cm$^2$, greater than 15400 g·cm$^2$, greater than 15500 g·cm$^2$, greater than 15600 g·cm$^2$, greater than 15700 g. cm$^2$, greater than 15800 g·cm$^2$, greater than 15900 g·cm$^2$, greater than 16000 g·cm$^2$, greater than 16200 g·cm$^2$, greater than 16400 g·cm$^2$, greater than 16600 g cm$^2$, greater than 16800 g·cm$^2$, greater than 17000 g·cm$^2$, greater than 17200 g·cm$^2$, greater than 17400 g·cm$^2$, greater than 17600 g·cm$^2$, greater than 17800 g·cm$^2$, greater than 18000 g. cm$^2$, greater than 18400 g·cm$^2$, greater than 18800 g·cm$^2$, greater than 19000 g·cm$^2$, greater than 19200 g·cm$^2$, or greater than 19400 g·cm$^2$. For example, the combined moment of inertia about the head CG and hosel $MOI_{CG}$-H can be between 15000 and 19500 g·cm$^2$, between 15000 and 19000 g·cm$^2$, between 15000 and 18000 g·cm$^2$, between 16000 and 19500 g·cm$^2$, between 16000 and 19000 g·cm$^2$, or between 16000 and 18000 g·cm$^2$. In these embodiments, the combined moment of inertia about the head CG and hosel $MOI_{CG}$-H can be greater than 15000 g·cm$^2$ for club heads with adjustable weighting systems having a volume between 425 and 450 cubic centimeters (cc), and the combined moment of inertia about the head CG and hosel $MOI_{CG}$-H can be greater than 17000 g·cm$^2$ for club heads with adjustable weighting systems having a volume between 450 and 500 cubic centimeters (cc).

The club heads comprising the adjustable weighting systems described herein can have a head CG depth 10130 greater than 1.6 inches, greater than 1.65 inches, greater than 1.7 inches, greater than 1.75 inches, greater than 1.8 inches, greater than 1.85 inches, greater than 1.9 inches, greater than 1.95 inches, or greater than 2.0 inches. For example, the club head having the adjustable weighting systems can have a head CG depth 10130 between 1.61 and 2.0 inches, between 1.65 and 2.0 inches, between 1.7 and 2.0 inches, between 1.8 and 2.0 inches, between 1.61 and 3.0 inches, between 1.65 and 3.0 inches, between 1.7 and 3.0 inches, between 1.8 and 3.0 inches, between 1.9 and 3.0 inches, or between 2.0 and 3.0 inches.

Further, the club heads comprising the adjustable weighting systems described herein can have a head CG height 10132 located below the head depth plane 10120 (i.e. located between the head depth plane 10120 and the sole 30 of the club head). Further, the club heads comprising the adjustable weighting systems described herein can have a head CG height 10132 located within 0.25 inch, within 0.20 inch, within 0.15 inch, within 0.10 inch, within 0.09 inch, within 0.08 inch, within 0.07 inch, within 0.06 inch, within 0.05 inch, or within 0.04 inch of the head depth plane 10120 toward the crown 26 or toward the sole 30 of the club head.

In many embodiments, and as described above, the adjustable weighting system of the club head 10 includes an insert or member capable of receiving one or more weights in multiple configurations, wherein one weight has a mass greater than at least one of the remaining weights. The member comprises a plurality of attachment locations or positions to receive the weights. Further, the member is removably positionable within a channel or recess on the club head with the weights positioned in various configurations to adjust the head CG position. For example, to adjust the club head CG position, the adjustable weighting system can be removed from the channel or recess, and the weights replaced or repositioned (i.e. the heavy weight shifted to a different attachment location), such that the club head center of gravity changes when the adjustable weighting system is repositioned in the channel or recess on the club head. Adjusting the head CG position using the adjustable weight systems described herein can affect ball trajectory and/or spin characteristics of the club head at impact, while maintaining a high club head moment of inertia.

In many embodiments, the channel on the club head includes a width W defined as the distance between opposing sides of the channel in a front to back direction, and a height H defined as the distance between the sole and a bottom surface of the channel. The width W and height H of the channel can be constant along the length of the channel from near the heel to near the toe, or the width W and height H of the channel can vary along the length of the channel from the heel to the toe such that the cross-sectional area of the channel varies. In many embodiments, the height H of the channel can range from 0.05 inch to 0.4 inch, from 0.05 inch to 0.5 inch, from 0.05 inch to 0.6 inch, from 0.1 inch to 0.4, from 0.1 inch to 0.5, or from 0.1 inch to 0.6 inch. In many embodiments, the width W of the cavity can be between 0.05 inch and 1.25 inch, between 0.05 inch and 1.0 inch, between 0.05 inch and 0.75 inch, between 0.25 inch and 1.25 inch, between 0.25 inch and 1.0 inch, or between 0.25 inch and 0.75 inch.

In many embodiments, the adjustable weighting system can receive two or more weights. In many embodiments, adjustable weight system can include two, three, four, or five weights. For example, in embodiments of the adjustable weighting system having two weights (e.g. FIGS. 4-10, 13-21), one configuration of the adjustable weighting system can include a first weight is positioned toward the back end 34 and the toe 18 and a second weight is positioned toward the back end 24 and the heel 22 of the club head, when the member comprising the weights is positioned in the channel on the club head. In these embodiments, a distance between the first weight and the second weight can be greater than 0.8 inch, greater than 0.9 inch, greater than 1.0 inch, greater than 1.1 inches, greater than 1.2 inches, or greater than 1.3 inches. For example, the distance between the first weight and the second weight can be between 0.8-1.3 inches, between 0.9-1.3 inches, between 1.0-1.3 inches, or between 1.1-1.3 inches.

For further example, in embodiments of the adjustable weighting system having three weights (FIGS. 23-26), one configuration of the adjustable weighting system can include a first weight can be positioned toward the back end 34 and the toe 18, a second weight can be positioned toward the back end 34 and the heel 22, and a third weight can be positioned centrally and toward the back end 34 of the club head, generally aligned with or adjacent to the head depth axis 10122, and/or between the first and second weights. In these embodiments, a distance between adjacent weights (e.g. the distance between the first weight and the third weight, or the distance between the second weight and the third weight) can be greater than 0.5 inch, greater than 0.6 inch, greater than 0.7 inch, greater than 0.8 inch, greater than 0.9 inch, or greater than 1.0 inch. For example, the distance between adjacent weights (e.g. the distance between the first weight and the third weight, or the distance between the second weight and the third weight) can be between 0.5-1.0 inch, between 0.6-1.0 inch, between 0.7-1.0 inch, or between 0.8-1.0 inch.

In other embodiments, the adjustable weighting system can include any number of weights greater than one, such as, two, three, four, five, six, seven, eight, or more weights. In embodiments where the adjustable weighting system includes four weights, a distance between adjacent weights can be greater than 0.4 inch, greater than 0.5 inch, greater than 0.6 inch, greater than 0.7 inch, greater than 0.8 inch, or greater than 0.9 inch. For example, in embodiments including four weights, the distance between adjacent weights can be between 0.4-0.9 inch, between 0.5-0.9 inch, between 0.6-0.9 inch, or between 0.7-0.9 inch. In embodiments where the adjustable weighting system includes five weights, a distance between adjacent weights can be greater than 0.3 inch, greater than 0.4 inch, greater than 0.5 inch, greater than 0.6 inch, greater than 0.7 inch, or greater than 0.8 inch. For example, in embodiments including five weights, the distance between adjacent weights can be between 0.3-0.8 inch, between 0.4-0.8 inch, between 0.5-0.8 inch, or between 0.6-0.8 inch.

The one or more weights of the adjustable weighting system can have a height $H_W$ measured in a crown to sole direction, a width $W_W$ measured in a heel to toe direction, and a depth $D_W$ measured in a front to back direction. In many embodiments, the height $H_W$ can be less than 0.5 inch, less than 0.4 inch, less than 0.3 inch, less than 0.25 inch, less than 0.2 inch, less than 0.18 inch, less than 0.16 inch, less than 0.14 inch, less than 0.12 inch, or less than 0.10 inch. For example, in some embodiments, the height $H_W$ can be between 0.1 inch and 0.5 inch. In many embodiments, the width $W_W$ can be less than 1.3 inches, less than 1.2 inches, less than 1.1 inches, less than 1.0 inch, less than 0.9 inch, less than 0.8 inch, less than 0.7 inch, less than 0.6 inch, less than 0.5 inch, or less than 0.4 inch. For example, the width $W_W$ can be between 0.25 inch and 1.25 inch. In many embodiments, the depth $D_W$ can be less than 1.0 inch, less than 0.9 inch, less than 0.8 inch, less than 0.7 inch, less than 0.6 inch, less than 0.5 inch, less than 0.4 inch, less than 0.3 inch, less than 0.2 inch, or less than 0.1 inch. For example, the depth $D_W$ can be between 0.25 inch and 1.25 inch.

In many embodiments, the first weight is heavier than one or more of the remaining weights (e.g. the second weight, the third weight, the fourth weight, and/or the fifth weight). The first weight can comprises a mass greater than 10 grams, greater than 12 grams, greater than 14 grams, greater than 16 grams, greater than 18 grams, greater than 20 grams, greater than 22 grams, greater than 24 grams, greater than 26 grams, greater than 28 grams, or greater than 30 grams. For example, first weight can comprises a mass between 6 and 20 grams, between 6 and 50 grams, between 10 and 50 grams, between 15 and 50 grams, between 20 and 50 grams, between 15 and 40 grams, between 20 and 40 grams, between 25 and 35 grams, between 10 and 25 grams, between 15 and 25 grams, between 10 and 20 grams, or between 15 and 20 grams. The remaining weights (e.g. the second weight, the third weight, the fourth weight, and/or the fifth weight) can comprise a mass less than 20 grams, less than 18 grams, less than 16 grams, less than 14 grams, less than 12 grams, less than 10 grams, less than 8 grams, less than 6 grams, less than 4 grams, or less than 2 grams. For example, the remaining weights can comprise a mass between 0.10 and 15 grams, between 0.25 and 4 grams, between 0.25 and 10 grams, between 0.5 and 7 grams, or between 1 and 10 grams. Further, the remaining weights can comprise the same or a different mass from one another.

The member and each weight can be formed of one material, two or more materials, or a plurality of materials. For example, the member can be formed of metal (e.g. aluminum, steel, titanium), metal alloy (e.g. aluminum alloy, titanium alloy, steel alloy), a plastic or plastics, plastic(s) with powdered metal(s), composite(s), composite(s) with powdered metal(s), or any other suitable material. For further example, one or more of the weights can be formed of a high density material (e.g., tungsten, etc.), a low density material (e.g., polyurethane or other suitable plastic, etc.), a combination of two or more high density materials, a combination of two or more low density materials, or a combination of high and low density materials. As a further example, one or more of the weights can be formed of a metal, metal alloy, a plastic or plastics, plastic(s) with powdered metal(s), composite(s), composite(s) with powdered metal(s), or any other suitable material.

The first weight can be positioned in any of the attachment locations on the member. In embodiments having an adjustable weighting system comprising two attachment locations, the first weight can be positioned in a first attachment location, such that the first weight is positioned near the toe 18 when the member is coupled to the club head. Further, the first weight can be positioned in a second attachment location, such that the first weight is positioned near the heel 22 when the member is coupled to the club head. In these embodiments, shifting the first weight from the first attachment location to the second attachment location shifts the head CG toward the heel 22, and shifting the first weight from the second attachment location to the first attachment location shifts the head CG toward the toe 18. In these embodiments, the remaining attachment location can comprise a second weight that is lighter than the first weight.

In embodiments having an adjustable weighting system comprising three weights, the first weight can be positioned in a third attachment positioned centrally on the member, thereby generating a neutral head CG position. The first weight can be shifted from the third attachment location to the first attachment location, positioned toward the toe 18, thereby shifting the head CG 58 toward the toe 18 by a distance. The first weight can be shifted from the third attachment location to the second attachment location, positioned toward the heel 22, thereby shifting the head CG 58 toward the heel 22 by a distance. In these embodiments, the remaining locations can be devoid of weights, or the remaining locations can comprise additional weights that are lighter than the first weight.

Shifting the first weight from an attachment location nearest the toe 18 to an attachment location nearest the heel 22 can shift the head CG 58 by a distance of at least 0.10 inch, at least 0.15 inch, at least 0.20 inch, at least 0.25 inch, or at least 0.30 inch, in a direction extending parallel to the x-axis 62. For example, in many embodiments, shifting the first weight from an attachment location nearest the toe 18 to an attachment location nearest the heel 22 can shift the head CG 58 by a distance between 0.05 and 0.30 inch, between 0.15 and 0.30 inch, between 0.20 and 0.30 inch, between 0.15 and 0.25 inch, or between 0.20 and 0.25 inch.

In these or other embodiments, shifting the head CG 58 toward the toe 18 can generate a fade or correct for a hook. Conversely, shifting the head CG 58 toward the heel 22 can generate a draw or correct for a slice. In the embodiments of the adjustable weighting system described below, shifting head CG 58 in a direction extending parallel to the x-axis 62 between 0.10 and 0.30 inch can result in a change in shot bend of 4.6 to 13.9 yards.

Figure 22:
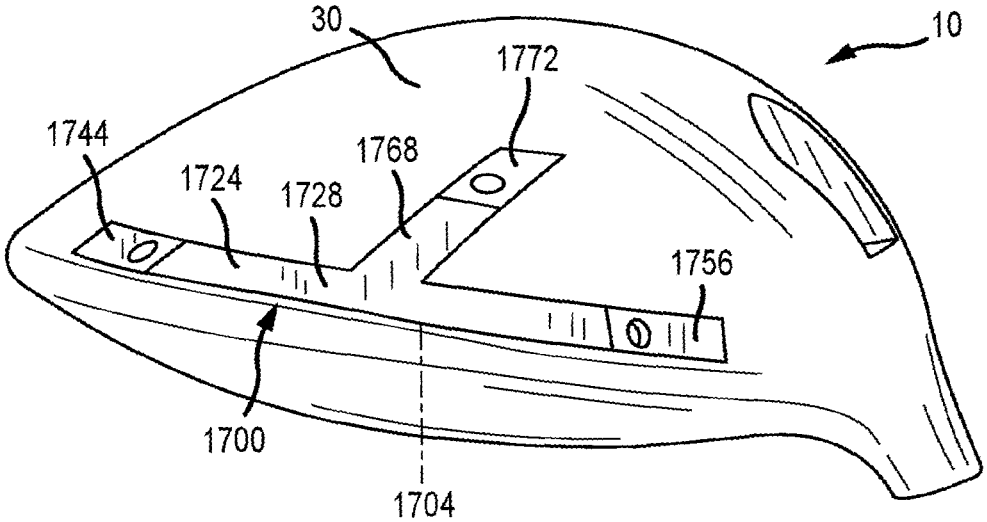
FIG. 22 is a perspective view of another embodiment of the adjustable weighting system illustrating a channel positioned on the sole of the club head of FIG. 1, and the adjustable weighting system being received by the channel.
Figure 29:
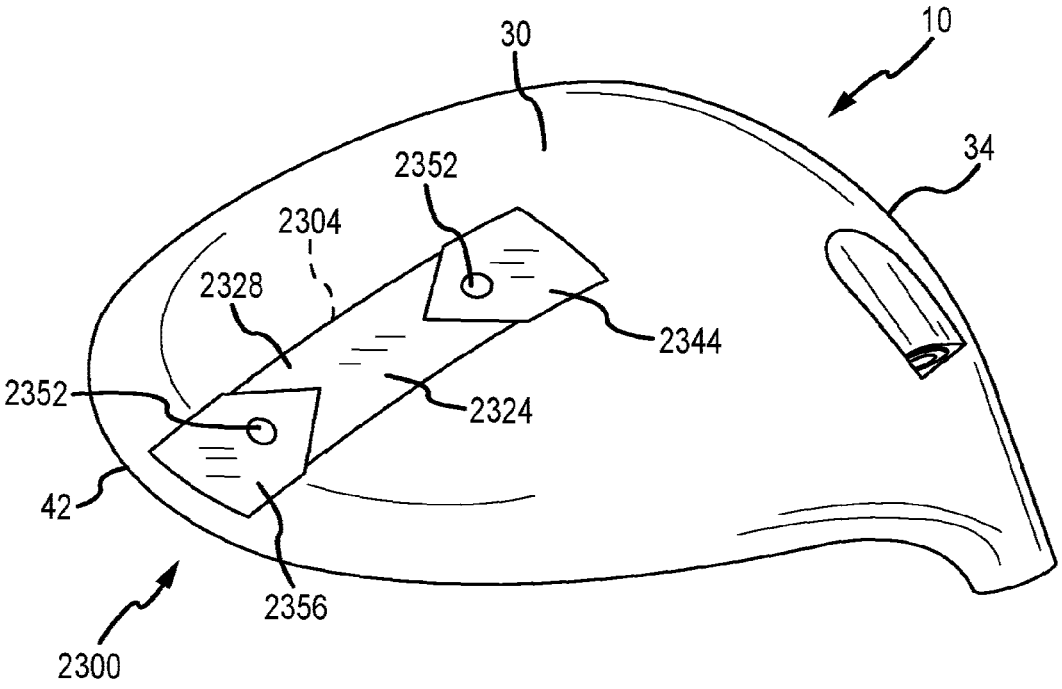
FIG. 29 is a perspective view of another embodiment of the adjustable weighting system illustrating a channel positioned on the sole of the club head of FIG. 1, and the adjustable weighting system being received by the channel.

Other embodiments can include one or more attachment locations on the member positioned toward the strike face 34 of the club head (e.g. FIGS. 22 and 29). In these embodiments, shifting one or more weights to an attachment location(s) near the back end 42 of the club head from an attachment location near the strike face 34 can increase the club head moment of inertia about the head CG $MOI_{CG}$ and increase dynamic loft or launch angle of a golf ball. Conversely, shifting one or more weights to an attachment location(s) near the strike face 34 of the club head from an attachment location near the back end 42 can reduce dynamic loft or launch angle of a golf ball.

The embodiments of the club heads having adjustable weighting systems described herein maximize head CG depth 10130 and club head moment of inertia (or minimize the reduction in head CG depth 10130 and club head moment of inertia typically associated with introducing adjustability compared to a non-adjustable club head). In many embodiments, the maximized head CG depth and club head moment of inertia are achieved with first adjustable weight having a relatively low mass, thereby increasing the efficiency of the design to maintain club head performance characteristics (e.g. forgiveness, low back spin, high launch), while enabling user adjustability of ball spin and/or trajectory.

Referring to Relation 3 below, the club heads having adjustable weighting systems comprise a depth to mass ratio of the head CG depth 10130 to the mass of the first weight $W_m$. In many embodiments, the depth to mass ratio of the club head can be greater than 0.060 inch/gram, greater than 0.070 inch/gram, greater than 0.080 inch/gram, greater than 0.090 inch/gram, greater than 0.100 inch/gram, greater than 0.110 inch/gram, greater than 0.120 inch/gram, or greater than 0.130 inch/gram. In some embodiments, the depth to mass ratio can be between 0.070 and 0.13 inch/gram, between 0.080 and 0.13 inch/gram, between 0.090 and 0.13 inch/gram, between 0.070 and 0.11 inch/gram, between 0.080 and 0.11 inch/gram, or between 0.090 and 0.11 inch/gram. In these embodiments, the mass of the first weight can be less than 25 grams, less than 24 grams, less than 23 grams, less than 22 grams, less than 20 grams, less than 19 grams, less than 18 grams, less than 17 grams, less than 16 grams, or less than 15 grams. In some embodiments, the mass of the first weight can be between 6 and 20 grams, between 10 and 20 grams, between 12 and 20 grams, between 14 and 20 grams, between 16 and 20 grams, between 10 and 18 grams, between 12 and 18 grams, or between 14 and 18 grams.

$$\text{Depth to Mass Ratio} = \text{Head CG Depth}/Wm \qquad \text{Relation 3}$$

Referring to Relation 4 below, the club heads having adjustable weighting systems can comprise a first inertia to mass ratio defined as the combined moment of inertia about the head CG $MOI_{CG}$ to the mass of the first weight $W_m$. In many embodiments, the first inertia to mass ratio can be greater than 400 $cm^2$, greater than 410 $cm^2$, greater than 420 $cm^2$, greater than 430 $cm^2$, greater than 440 $cm^2$, greater than 450 cm 2, greater than 460 $cm^2$, greater than 470 $cm^2$, greater than 480 $cm^2$, greater than 490 $cm^2$, greater than 500 $cm^2$, greater than 510 $cm^2$, greater than 520 $cm^2$, greater than 530 cm 2, greater than 540 $cm^2$, greater than 550 $cm^2$, greater than 560 $cm^2$, greater than 570 $cm^2$, greater than 580 $cm^2$, greater than 590 $cm^2$, greater than 600 $cm^2$, greater than 610 cm 2, greater than 620 $cm^2$, greater than 630 $cm^2$, greater than 640 $cm^2$, greater than 650 cm 2, greater than 660 $cm^2$, greater than 670 $cm^2$, greater than 680 $cm^2$, greater than 690 $cm^2$, or greater than 700 $cm^2$. In some embodiments, the first inertia to mass ratio can be between 400 and 700 $cm^2$, between 510 and 750 $cm^2$, between 520 and 750 $cm^2$, between 530 and 750 $cm^2$, between 540 and 750 $cm^2$, between 550 and 750 $cm^2$, between 500 and 700 $cm^2$, between 510 and 700 $cm^2$, between 20 and 700 $cm^2$, between 530 and 700 $cm^2$, between 540 and 700 $cm^2$, or between 550 and 700 cm. In these embodiments, the mass of the first weight can be less than 25 grams, less than 24 grams, less than 23 grams, less than 22 grams, less than 20 grams, less than 19 grams, less than 18 grams, less than 17 grams, less than 16 grams, or less than 15 grams. In some embodiments, the mass of the first weight can be between 6 and 20 grams, between 10 and 20 grams, between 12 and 20 grams, between 14 and 20 grams, between 16 and 20 grams, between 10 and 18 grams, between 12 and 18 grams, or between 14 and 18 grams.

$$\text{First Inertia to Mass Ratio} = MOI_{CGs}/W_m \qquad \text{Relation 4}$$

The embodiments of the club heads having adjustable weighting systems described herein maximize the total shift in head CG as achievable by adjusting the one or more weights to the plurality of attachment locations on the member. In many embodiments, the maximized total shift in head CG is achieved with first adjustable weight having a relatively low mass, thereby increasing the efficiency of the design to maintain club head performance characteristics (e.g. forgiveness, low back spin, high launch) while enabling user adjustability of ball spin and/or trajectory.

Referring to Relation 5 below, the club heads having adjustable weighting systems comprise a head CG to mass ratio defined as the total shift in head CG or maximum head CG shift to the mass of the first weight. In many embodiments, the head CG to mass ratio can be greater than 0.008 inch/gram, greater than 0.009 inch/gram, greater than 0.010 inch/gram, greater than 0.011 inch/gram, greater than 0.012 inch/gram, greater than 0.013 inch/gram, greater than 0.014 inch/gram, or greater than 0.015 inch/gram. In some embodiments, the head CG to mass ratio can be between 0.008 and 0.015 inch/gram, between 0.009 and 0.015 inch/gram, between 0.010 and 0.015 inch/gram, between 0.008 and 0.013 inch/gram, between 0.009 and 0.013 inch/gram, or between 0.010 and 0.013 inch/gram. In these embodiments, the mass of the first weight can be less than 25 grams, less than 24 grams, less than 23 grams, less than 22 grams, less than 20 grams, less than 19 grams, less than 18 grams, less than 17 grams, less than 16 grams, or less than 15 grams. In some embodiments, the mass of the first weight can be between 6 and 20 grams, between 10 and 20 grams, between 12 and 20 grams, between 14 and 20 grams, between 16 and 20 grams, between 10 and 18 grams, between 12 and 18 grams, or between 14 and 18 grams.

$$\text{Head CG to Mass Ratio} = \text{Maximum Head CG Shift}/W_m \qquad \text{Relation 5}$$

The one or more weights of the adjustable weighting system comprise a weight CG $W_{CG}$. In many embodiments, the weight CG $W_{CG}$ is positioned near a rear perimeter or skirt 74 of the club head when viewed from a top or bottom view, and at a maximized distance from the geometric center 140 of the strike face 34. Positioning the weight CG $W_{CG}$ near the rear perimeter 74 of the club head or away from the strike face 34 can increase perimeter weighting and club head moment of inertia, thereby resulting in increased club head forgiveness for off center hits, compared to adjustable weights positioned closer to the strike face. Further, positioning the weight CG $W_{CG}$ near the rear perimeter 74 or away from the strike face 34 can result in a head CG position that is lower and farther back, thereby increasing club head moment of inertia and reducing back spin, back compared to adjustable weights positioned closer to the strike face.

In these embodiments, the weight CG $W_{CG}$ of one or more of the weights is positioned at a distance D1 from the rear perimeter 74 of the club head. The distance D1 can be measured as the minimum projected distance from the weight CG to the perimeter 74 when the club head is viewed from a bottom view, perpendicular to the x'z' plane 10126. Further, the distance D1 can be measured in a direction parallel to the x'z' plane 10126. For example, the weight CG $W_{CG}$ of one or more of the weights can be positioned within 0.7 inch, within 0.65 inch, within 0.6 inch, within 0.55 inch, within 0.5 inch, within 0.45 inch, within 0.4 inch, within 0.35 inch, within 0.3 inch, within 0.25 inch, or within 0.2 inch of the rear perimeter 74 of the club head. For further example, the weight CG $W_{CG}$ of one or more of the weights can be positioned between 0.10 and 0.50 inch, between 0.25 and 0.5 inch, between 0.10 and 0.25 inch, between 0.10 and 0.35 inch, or between 0.10 and 0.45 inch from the rear perimeter 74 of the club head.

Further, in these embodiments, the weight CG $W_{CG}$ of one or more of the weights is positioned at a distance D2 from the geometric center 140 of the strike face 34 of the club head. For example, the weight CG $W_{CG}$ of one or more of the weights can be positioned at a distance D2 greater than 2.0 inches, greater than 2.25 inches, greater than 2.5 inches, greater than 2.75 inches, greater than 3.0 inches, greater than 3.25 inches, greater than 3.5 inches, or greater than 3.75 inches from the geometric center of the strike face. For further example, the weight CG $W_{CG}$ of one or more of the weights can be positioned at a distance D2 between 2.0 and 3.5 inches, between 2.5 and 3.5 inches, between 2.0 and 3.0 inches, between 2.5 and 3.0 inches, between 2.5 and 4.0 inches, between 3.0 and 3.75 inches, between 3.0 and 4.0 inches, between 3.2 and 4.0 inches, or between 3.5 and 4.0 inches from the geometric center 140 of the strike face 34. Positioning the weight CG $W_{CG}$ away from the geometric center 140 of the strike face 34 can increase perimeter weighting and club head moment of inertia, thereby resulting in increased club head forgiveness for off center hits, compared to adjustable weights positioned closer to the strike face. Further, positioning the weight CG $W_{CG}$ away from the geometric center 140 of the strike face 34 can result in a head CG position that is lower and farther, thereby increasing club head moment of inertia and reducing back spin, back compared to adjustable weights positioned closer to the strike face.

In many embodiments, the weight CG $W_{CG}$ protrudes from an external contour or outer surface 10146 of the sole 30, is positioned flush with the external contour 10146 of the sole 30, and/or is positioned minimally inset relative to the external contour 10146 of the sole 30. Positioning the weight CG $W_{CG}$ minimally inset, flush with, or external relative to the external contour 10146 of the sole 30 requires less structural support material to receive the one or more weights, thereby maintaining a low profile adjustable weighting system. Accordingly, positioning the weight CG $W_{CG}$ minimally inset, flush with, or external relative to the external contour 10146 of the sole 30 can increase perimeter weighting and club head moment of inertia, thereby resulting in increased club head forgiveness for off center hits, compared to internal adjustable weights or adjustable weights recessed into the club head. Further, positioning the weight CG $W_{CG}$ minimally inset, flush with, or external relative to the external contour 10146 of the sole 30 can result in a head CG position that is lower and farther back, thereby increasing club head moment of inertia and reducing back spin, back compared to internal adjustable weights or adjustable weights recessed into the club head.

In these embodiments, the weight CG $W_{CG}$ of one or more of the weights is positioned at a distance D3 from the external contour 10146 of the sole 30, wherein the distance D3 is measured in a direction parallel to the y-axis 66. For example, the weight CG $W_{CG}$ of one or more of the weights can protrude from the external contour 10146 of the sole by up to 0.10 inch, up to 0.15 inch, up to 0.20 inch, up to 0.25 inch, or up to 0.30 inch. In some embodiments, the weight CG $W_{CG}$ of the one or more weights protrudes from the external contour 10146 of the sole 30 by 0.10 to 0.25 inch, by 0.15 to 0.25 inch, by 0.15 to 0.25 inch, or by 0.15 to 0.30 inch. For further example, the weight CG $W_{CG}$ can be inset relative to the external contour 10146 of the sole 30 by a distance D3 of less than 0.15 inch, less than 0.14 inch, less than 0.13 inch, less than 0.125 inch, less than 0.12 inch, less than 0.11 inch, less than 0.10 inch, less than 0.09 inch, less than 0.08 inch, or less than 0.07 inch. In some embodiments, the weight CG $W_{CG}$ of the one or more weights is inset relative to the external contour 10148 of the sole 30 by a distance D3 between 0.05 and 0.15 inch, between 0.05 and 0.125 inch, between 0.05 and 0.15 inch, between 0.10 and 0.15 inch, between 0.10 and 0.125 inch, or between 0.10 and 0.15 inch.

B. Embodiments of Adjustable Weighting Systems

Figure 4A:
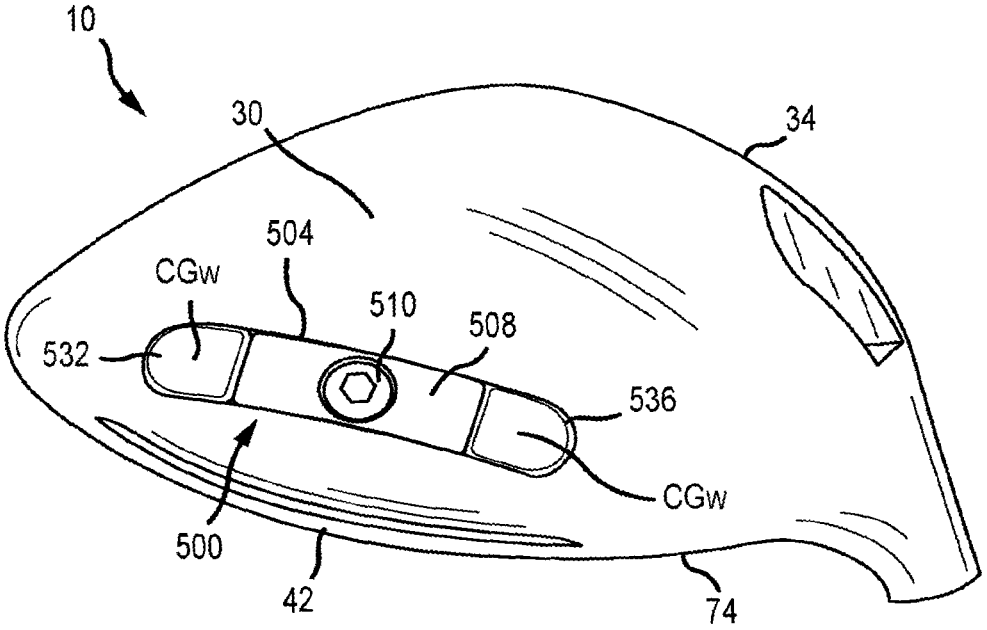
FIG. 4A is a perspective view of an embodiment of the adjustable weighting system illustrating a channel positioned on the sole of the club head of FIG. 1, and the adjustable weighting system being received by the channel.
Figure 4B:
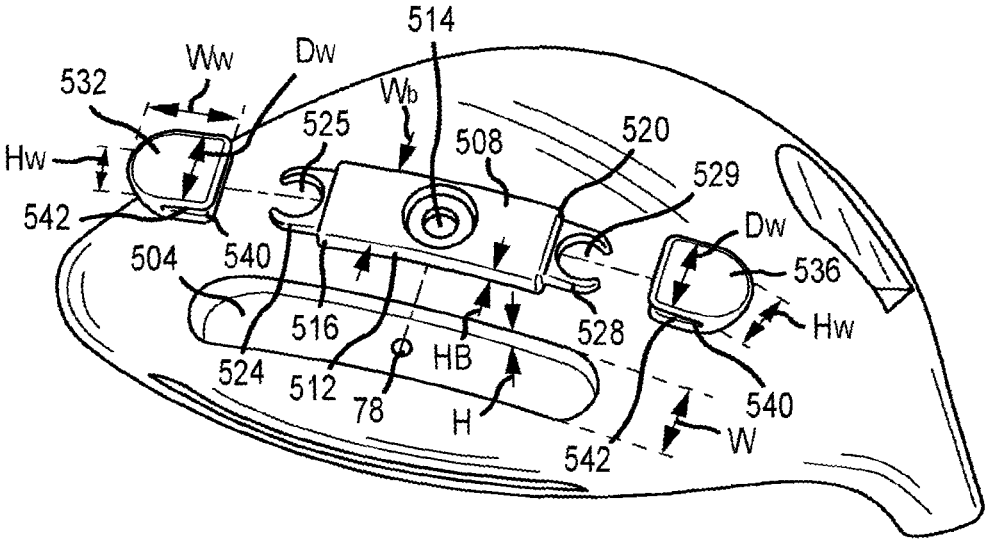
FIG. 4B is an exploded, perspective view of the club head and adjustable weighting system of FIG. 4A illustrating the weights being removed.

Referring now to FIGS. 4A and 4B, an embodiment of an adjustable weighting system 500 is illustrated. The adjustable weighting system 500 includes a single port or channel or recessed track 504 that is positioned on the sole 30 of the club head 10. In the illustrated embodiment, the channel 504 is positioned proximal, or closer to, the back 42 of the club head 10 than to the face plate 34. However, in other embodiments, the channel 504 can be positioned at any suitable location on the sole 30 of the club head 10 relative to the face plate 34. In addition, the channel 504 is illustrated as having an arcuate or curved shape. However, in other embodiments, the channel 504 can have any suitable shape (e.g., be linear, geometric, etc.). As shown in FIG. 4A, the channel 504 includes a width W and a height (or depth) H. The width W is defined as the distance between opposing sides of the channel 504. The height H is defined as the distance between the sole 30 and a bottom surface of the channel 504. In the illustrated embodiment, the width W and the height H are constant along the channel 504 (i.e., are the same at different positions along the channel 504). In other embodiments, the bottom surface of the channel 504 can be sloped or stepped, such that the height H changes, or is varying, along the channel 504. In yet other embodiments, the distance between the opposing sides of the channel 504 can change (e.g., increase or decrease) to provide a varying width W along the channel 504.

The adjustable weighting system 500 also includes a member 508 (or an insert 708) configured to be received by the channel 504. The member 508 includes a body 512 that has a body width $W_B$ and a body height (or body depth) $H_B$ (shown in FIG. 4B). The body width $W_B$ preferably corresponds to the width W of the channel 504, such that the body width $W_B$ does not exceed the width W of the channel 504. Similarly, the body height $H_B$ preferably corresponds to the height H of the channel 504, such that the body height $H_B$ does not exceed the height of the channel 504. This allows the member 508 to be received by the channel 504. It should be appreciated that in other embodiments, the body width $W_B$ can be less than the width W of the channel 504, and/or the body height $H_B$ can be less than the height H of the channel 504. In yet other embodiments, the body height $H_B$ can be greater than the height H of the channel 504, causing the member 508 to extend out of the channel 504. The body 512 defines an aperture 514 that extends entirely through the body 512. The aperture 514 is configured to align with a channel aperture 78 (shown in FIG. 4B) positioned in the channel 504. When aligned, the aperture 514 and channel aperture 78 receive a fastener 510 configured to couple the member 508 to the channel 504. In the illustrated embodiment, the fastener 510 can be a threaded fastener (e.g., screw, bolt, etc.) or any suitable device to selectively fasten the member 508 to the channel 504. Further, in many embodiments, the fastener 510 can comprise a density similar to or less than the density of the club head body, such that the fastener 510 does not significantly contribute to the weight distribution of the club head 10.

Referring now to FIG. 4B, the body 512 includes a first end 516 and a second end 520. The first end 516 is positioned at one end of the body 512, and the second end 520 is positioned at another end of the body 512 that is opposite the first end 516. Each end 516, 520 includes a respective attachment position 524, 528 that is configured to engage a respective weight 532, 536 in various configurations. In the illustrated embodiment, the first attachment position 524 located at the first end 516 is illustrated as a first protrusion 524. The first protrusion 524 comprises a first and second arm, each having a hook shape and defining a void or channel 525. The second attachment position 528 located at the second end 520 is illustrated as a second protrusion 528. The second protrusion 528 comprises a first and second arm, each having a hook shape and defining a void or channel 529. Each weight 532, 536 defines a void or channel 540 corresponding in shape to the first and second protrusion 524, 528 and configured to engage with, and more specifically receive, one of the protrusions 724, 728. In the illustrated embodiment, the weight 532, 536 further comprises a post 542 that can be received within the voids 525, 529 of the protrusions 524, 528 to provisionally secure the weights 532, 536 to the member 508. In these embodiments, the weights 532, 536 are configured to couple to the member 508 by a snap-fit or press-fit mechanism. In other embodiments, the weights 532, 536 can couple to the member using any other suitable mechanism, as described further in the embodiments below.

Each weight 532, 536 has a rounded geometric shape. In other embodiments, the weights 532, 536 can have different shapes, such as square, circular, rectangular, triangular, or any suitable polygonal shape or shape with at least one curved surface. Further, the weights can have a shape that is suitable to adjust the face angle at address, which is discussed in additional detail below in association with the face angle adjustment system 1200.

The first and second weights 532, 536 can be positioned at or repositioned between any attachment location 524, 528 to adjust the weight distribution and club head center of gravity, as described below, to affect ball trajectory and/or spin.

Figure 6:
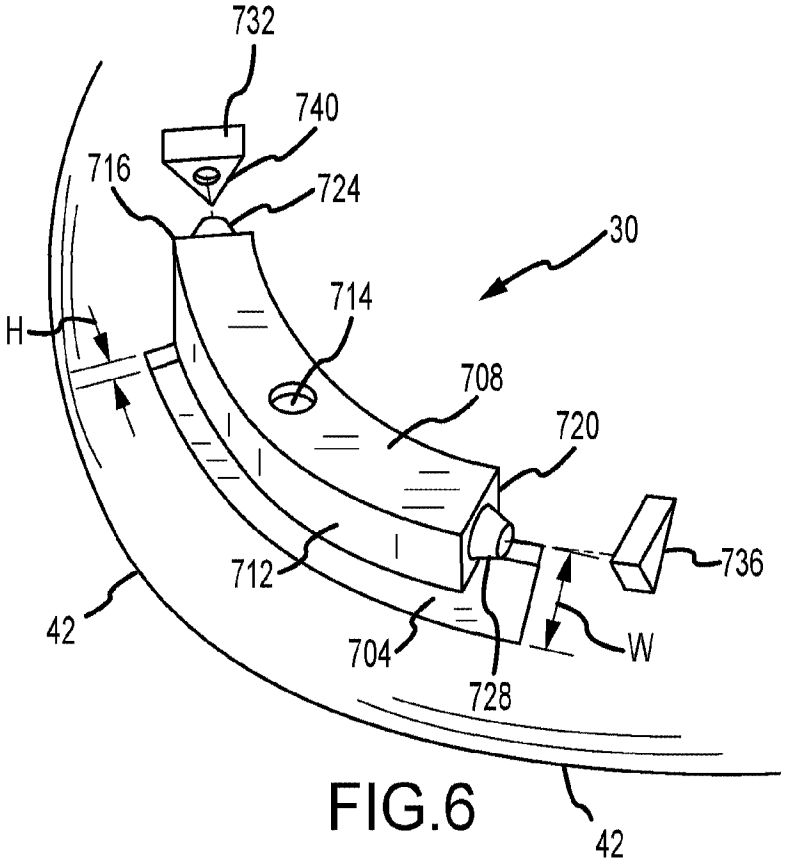
FIG. 6 is a perspective view of the channel of FIG. 5, illustrating the adjustable weighting system being removed from the channel.
Figure 5:
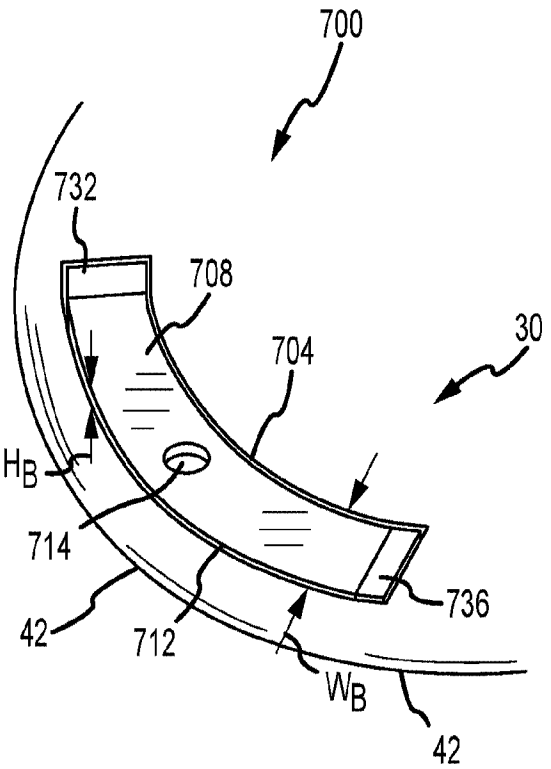
FIG. 5 is a close-up perspective view of an embodiment of the adjustable weighting system, illustrating a channel positioned on the sole of the club head of FIG. 1, and the adjustable weighting system being received by the channel.

Referring now to FIGS. 5-6, an embodiment of an adjustable weighting system 700 is illustrated. The adjustable weighting system 700 has similar components to the adjustable weighting system 500, with like names and/or like numbers identifying like components. The adjustable weighting system 700 includes a single port or channel or recessed track 704 that is positioned on the sole 30 of the club head 10. In the illustrated embodiment the channel 704 is positioned proximal, or closer to, the back 42 of the club head 10 than to the face place 34. However, in other embodiments, the channel 704 can be positioned at any suitable location on the sole 30 of the club head 10. In addition, the channel 704 is illustrated as having an arcuate or curved shape. However, in other embodiments, the channel 704 can have any suitable shape (e.g., be linear, geometric, etc.). As shown in FIG. 6, the channel 704 includes a width W and a height (or depth) H. The width W is defined as the distance between opposing sides of the channel 704. The height H is defined as the distance between the sole 30 and a bottom surface of the channel 704. In the illustrated embodiment, the width W and the height H are constant along the channel 704 (i.e., are the same at different positions along the channel 704). In other embodiments, the bottom surface of the channel 704 can be sloped or stepped, such that the height H changes, or is varying, along the channel 704. In yet other embodiments, the distance between the opposing sides of the channel 704 can change (e.g., increase or decrease) to provide a varying width W along the channel 704.

Referring again to FIGS. 5-6, the adjustable weighting system 700 also includes a member 708 (or an insert 708) configured to be received by the channel 704. The member 708 includes a body 712 that has a body width $W_B$ and a body height (or body depth) $H_B$ (shown in FIG. 5). The body width $W_B$ preferably corresponds to the width W of the channel 704, such that the body width $W_B$ does not exceed the width W of the channel 704. Similarly, the body height $H_B$ preferably corresponds to the height H of the channel 704, such that the body height $H_B$ does not exceed the height H of the channel 704. This allows the member 708 to be received by the channel 704. It should be appreciated that in other embodiments, the body width $W_B$ can be less than the width W of the channel 704, and/or the body height $H_B$ can be less than the height H of the channel 704. In yet other embodiments, the body height $H_B$ can be greater than the height H of the channel 704, causing the member 708 to extend out of the channel 704. The body 712 defines an aperture 714 that extends entirely through the body 712. The aperture 714 is configured to align with a channel aperture 78 (shown in FIG. 11) positioned in the channel 704. When aligned, the aperture 714 and channel aperture 78 (shown in FIG. 11) receive a fastener (not shown in FIGS. 5-6, but shown as 810, 910, 1010 in FIGS. 7, 9, and 11, respectively) configured to couple the member 708 to the channel 704. In the illustrated embodiment, the fastener can be a threaded fastener (e.g., screw, bolt, etc.) or any suitable device to selectively fasten the member 708 to the channel 704. Further, in many embodiments, the fastener 710 can comprise a density similar to or less than the density of the club head body, such that the fastener 710 does not significantly contribute to the weight distribution of the club head 10.

Referring now to FIG. 6, the body 712 includes a first end 716 and a second end 720. The first end 716 is positioned at one end of the body 712, and the second end 720 is positioned at another end of the body 712 that is opposite the first end 716. Each end 716, 720 includes a respective attachment position 724, 728 that is configured to engage a respective weight 732, 736 in various configurations. In the illustrated embodiment, the first attachment position 724 located at the first end 716 is illustrated as a first protrusion 724 (or first post 724). The second attachment position 728 located at the second end 720 is illustrated as a second protrusion 728 (or second post 728). Each weight 732, 736 can define an aperture 740 (or bore 740) configured to engage with, and more specifically receive, one of the protrusions 724, 728. Each protrusion 724, 728 can be threaded to form a threaded connection with corresponding threads positioned in each aperture 740. In other embodiments, each protrusion 724, 728 can have a smooth (or relatively smooth) surface such that each aperture 740 slidably receives one of the protrusions 724, 728 to slidably mount one of the weights 732, 736 to each attachment position 724, 728. The aperture 740 is illustrated as partially extending into each weight 732, 736. In other embodiments, the aperture 740 can extend entirely through one or more of the weights 732, 736. It should also be appreciated that while each weight 732, 736 is illustrated as being removably coupled to the body 712, in other embodiments each weight 732, 736 can be mounted to the body 712 such that the weights 732, 736 are not intended to be disengaged from the body 712 by an end user. For example, the weights 732, 736 can be further mounted to the body 712 by an adhesive or any other permanent or semi-permanent mounting material.

Each weight 732, 736 has a geometric or a polygonal shape. For example, in the embodiment shown in FIG. 6, each weight 732, 736 has a triangular cross-sectional shape. The triangular cross-sectional shape of each weight 732, 736 can have different length legs (e.g., be an isosceles, scalene, acute-angled, right-angled, obtuse-angled, etc.). In other embodiments, the triangular cross-sectional shape of each weight 732, 736 can be an equilateral triangle shape (i.e., each leg of the triangle has the same length). In yet other embodiments, the weights 732, 736 can have a frusto-pyramidal (or triangular frustrum) shape, or can have a different cross-sectional shape. For example, in the embodiments illustrated in FIGS. 7-10 (to be later described), each weight 832, 836, 932, 936 has a generally rectangular shape. In yet other embodiments, each weight can have a shape that corresponds to a cross-sectional shape of the body 712, is larger than a cross-sectional shape of the body 712, is smaller than a cross-sectional shape of the body 712, corresponds to a shape of the channel 704 (i.e., such that each weight is received by the channel 704), is smaller dimensionally than the width W and/or the height H of the channel 704, or is larger dimensionally than the height H of the channel 704 (e.g., such that the weight extends out of the channel 704 and projects away from the sole 30. In yet other embodiments, one or more of the weights can be square, circular, rectangular, triangular, or any suitable polygonal shape. Further, the weights can have a shape that is suitable to adjust the face angle at address, which is discussed in additional detail below in association with the face angle adjustment system 1200.

The first and second weights 732, 736 can be positioned at or repositioned between any attachment location 724, 728 to adjust the weight distribution and club head center of gravity, as described below, to affect ball trajectory and/or spin.

Figure 8:
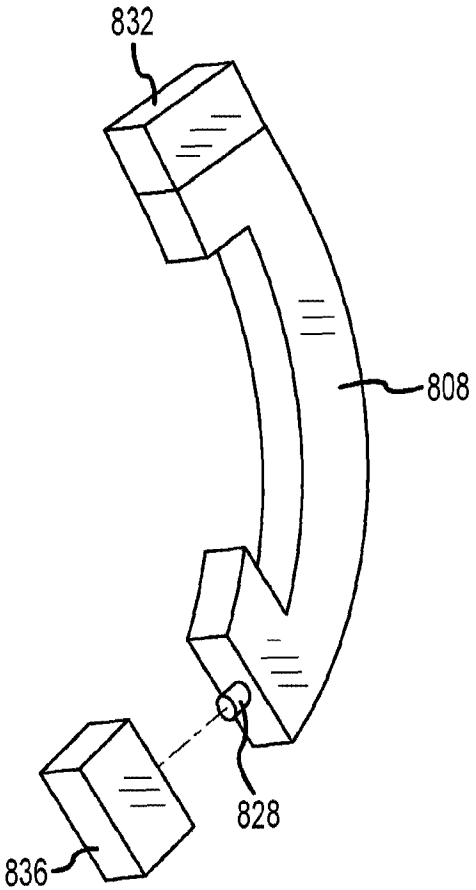
FIG. 8 is a perspective view of the member and associated adjustable weights of the adjustable weighting system of FIG. 7 illustrating one weight being removed.
Figure 7:
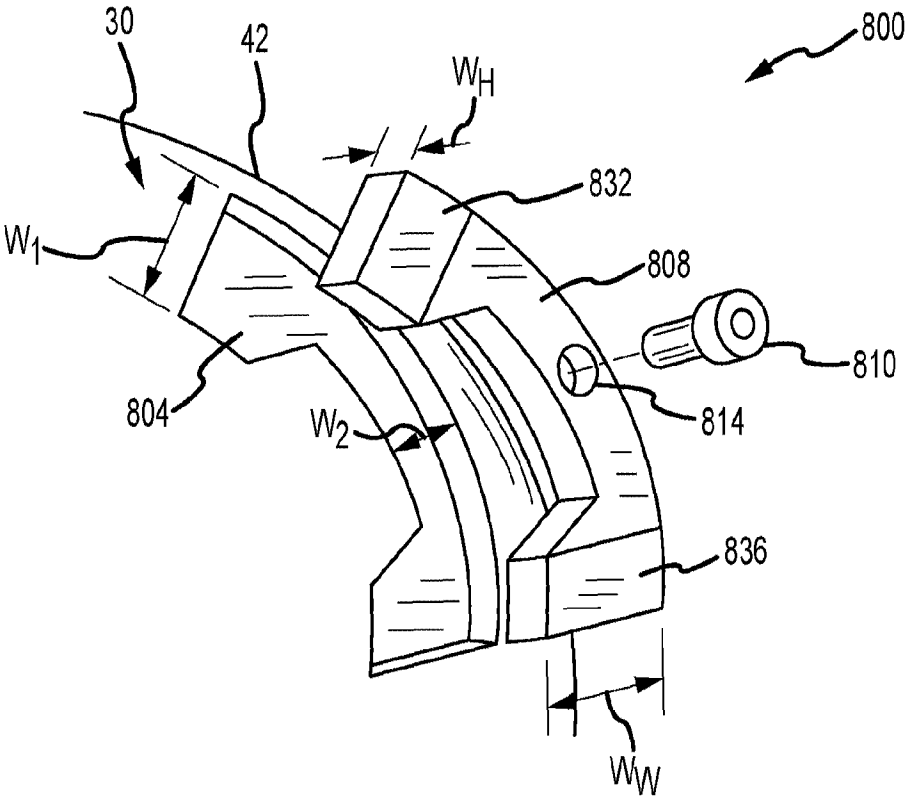
FIG. 7 is a close-up perspective view of another embodiment of the adjustable weighting system illustrating a channel positioned on the sole of the club head of FIG. 1, and a member carrying adjustable weights removed from the channel.

FIGS. 7-8 illustrate another embodiment of the adjustable weighting system 800. The adjustable weighting system 800 has similar components to the adjustable weighting system 700, with like names and/or like numbers identifying like components. As illustrated in FIG. 7, the adjustable weighting system 800 includes a channel 804 and a member 808. The channel 804 is substantially the same as the channel 704 except for the shape. More specifically, the channel 804 has a "U-shape" such that the channel 804 has a different width at different positions. For example, a first width $W_1$ at an end of the channel 804 is greater than a second width $W_2$ at a center (or midpoint) of the channel 804. The member 808 also has a "U-shape" that corresponds to the shape of the channel 804, such that the member 808 is received by the channel 804. The member 808 is coupled to the channel 804 by a fastener 810. More specifically, an aperture 814 is aligned with a channel aperture 78 (shown in FIG. 11), and the aperture 814 and channel aperture 78 (shown in FIG. 11) receive the fastener 810, attaching the member 808 to the channel 804. Further, in many embodiments, the fastener 810 can comprise a density similar to or less than the density of the club head body, such that the fastener 810 does not significantly contribute to the weight distribution of the club head 10.

The member 808 also carries a first weight 832 and a second weight 836 in various configurations. The weights 832, 836 are substantially the same as weights 732, 736 except for the shape (e.g., the weights 832, 836 mount to the member 808 by a protrusion 828, etc.). As shown in FIG. 7, the weights 832, 836 have a generally rectangular shape such that a weight width $W_w$ is greater (or longer) than a weight height WH.

Figure 10:
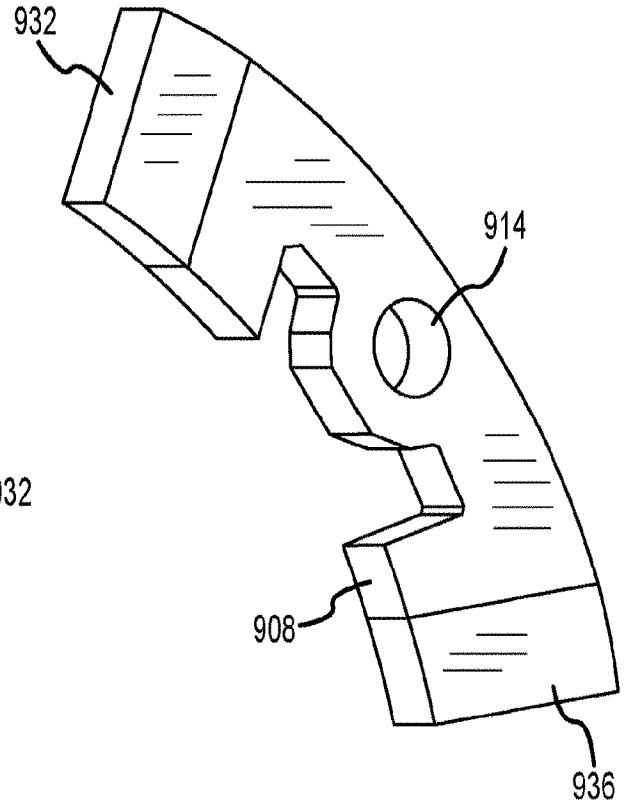
FIG. 10 is a perspective view of the member and associated adjustable weights of the adjustable weighting system of FIG. 9.
Figure 9:
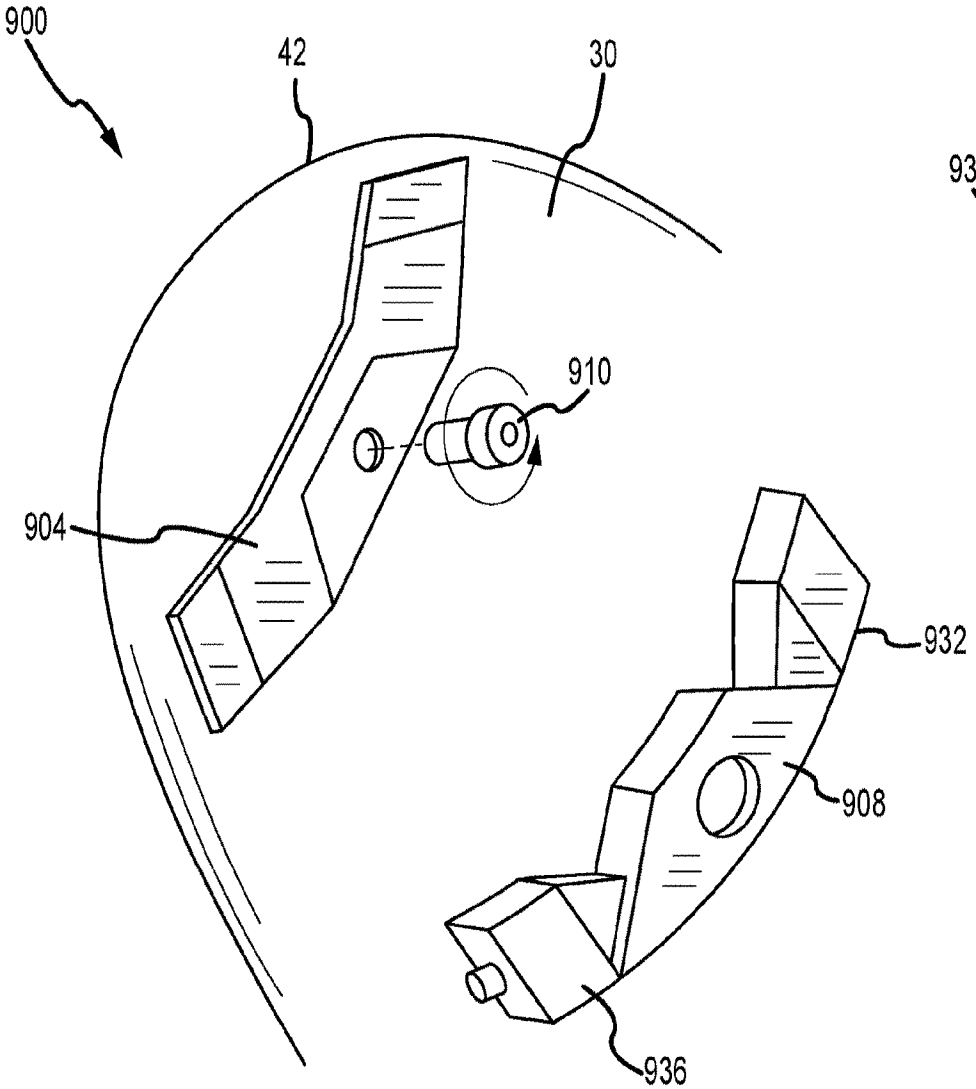
FIG. 9 is a close-up perspective view of another embodiment of the adjustable weighting system illustrating a channel positioned on the sole of the club head of FIG. 1, a first member carrying adjustable weights being received by the channel, and a second member carrying adjustable weights being removed from the channel.

FIGS. 9-10 illustrate another embodiment of the adjustable weighting system 900. The adjustable weighting system 900 has similar components to the adjustable weighting system 700, 800 with like names and/or like numbers identifying like components. With reference to FIG. 9, the adjustable weighting system 900 includes a channel 904 and a member 908. The channel 904 is substantially the same as the channel 704, 804 except for the shape. More specifically, the channel 904 has a "M-shape" such that the channel 904 has a different width at different positions. The member 908 also has a corresponding "M-shape" such that the member 908 is received by the channel 904. The member 908 couples to the channel 904 by a fastener 910. More specifically, an aperture 914 (shown in FIG. 10) is aligned with a channel aperture 78 (shown in FIG. 11), and the aperture 914 and the channel aperture 78 (shown in FIG. 11) receive the fastener 910, attaching the member 908 to the channel 904. Further, in many embodiments, the fastener 910 can comprise a density similar to or less than the density of the club head body, such that the fastener 910 does not significantly contribute to the weight distribution of the club head 10.

The member 908 also carries a first weight 932 and a second weight 936 in various configurations. The weights 932, 936 are substantially the same as weights 732, 736, 832, 836, including having the same rectangular shapes as weights 832, 836.

Figure 11:
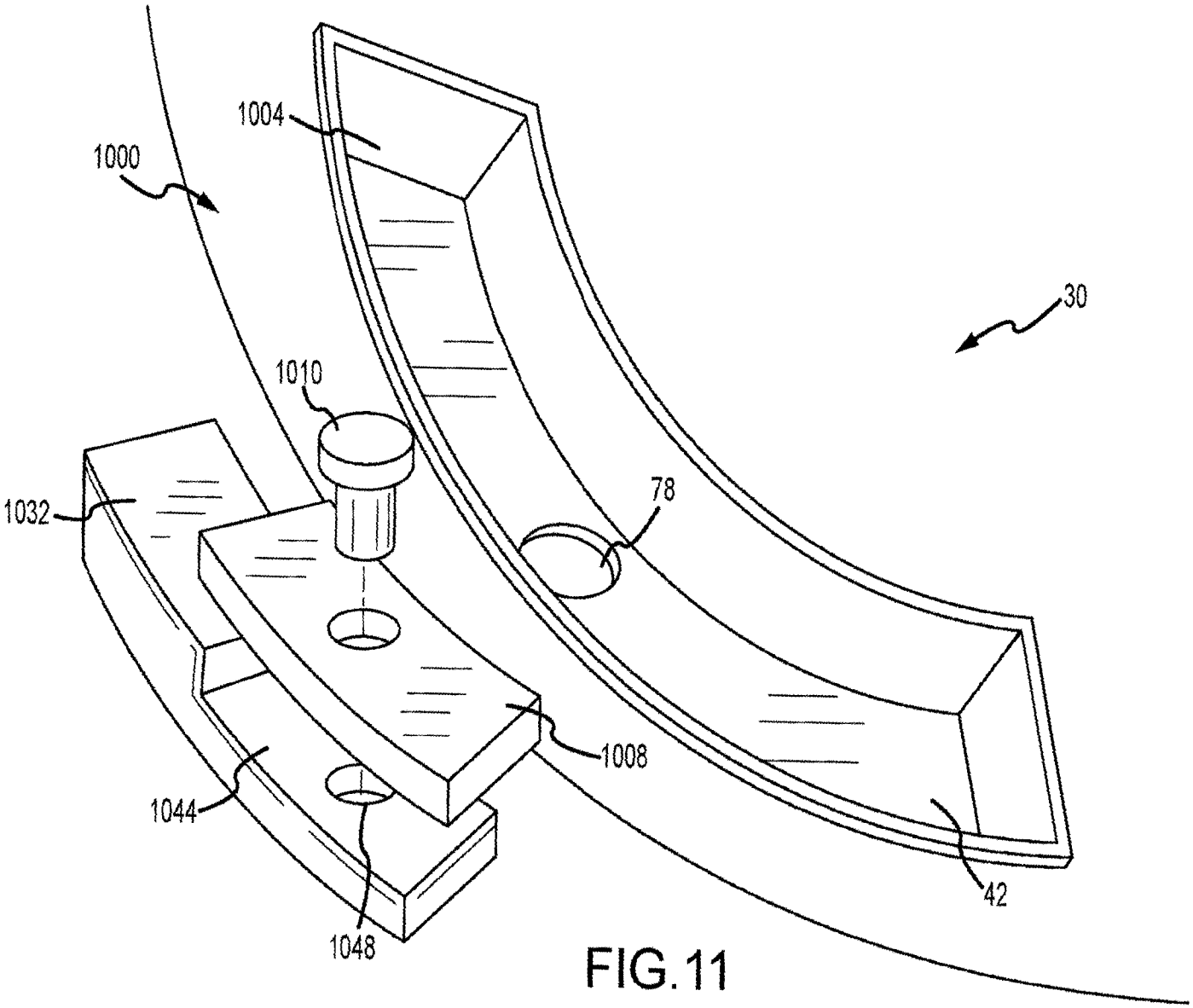
FIG. 11 is a close-up perspective view of another embodiment of the adjustable weighting system illustrating a channel positioned on the sole of the club head of FIG. 1, and a member that couples to an adjustable weight being removed from the channel.

FIG. 11 illustrates another embodiment of the adjustable weighting system 1000. The adjustable weighting system 1000 has similar components to the adjustable weighting system 700, 800, 900 with like names and/or like numbers identifying like components. With reference to FIG. 11, the adjustable weighting system 1000 includes a channel 1004 and a member 1008. The channel 1004 is substantially the same as the channel 704. A first weight 1032 is substantially the same as the first weight 732, except for the geometry of the first weight 1032. Notably, the first weight 1032 includes a protruding tab 1044. The protruding tab 1044 acts as an engagement surface to align and couple to the member 1008. More specifically, the protruding tab includes an aperture 1048 that extends through the protruding tab 1044. The member 1008 is positioned on the protruding tab 1044 such that the member aperture 1014, which is substantially the same as aperture 714, is aligned with the protruding tab aperture 1048. The member 1008 and weight 1032 are then positioned in the channel 1004 such that the apertures 1014, 1048 are aligned with the channel aperture 74. Once the apertures 1014, 1048, 74 are in alignment, they receive a fastener 1010, which is substantially the same as fasteners 810, 910. In other embodiments, the protruding tab 1044 can extend above the member 1008, or the protruding tab 1044 can be formed with the member 1008 (instead of with the weight 1032). In yet other embodiments, the protruding tab 1044 can extend under a portion of the member 1008, including the entirety of the member 1008, or can extend beyond the member 1008.

Figure 12:
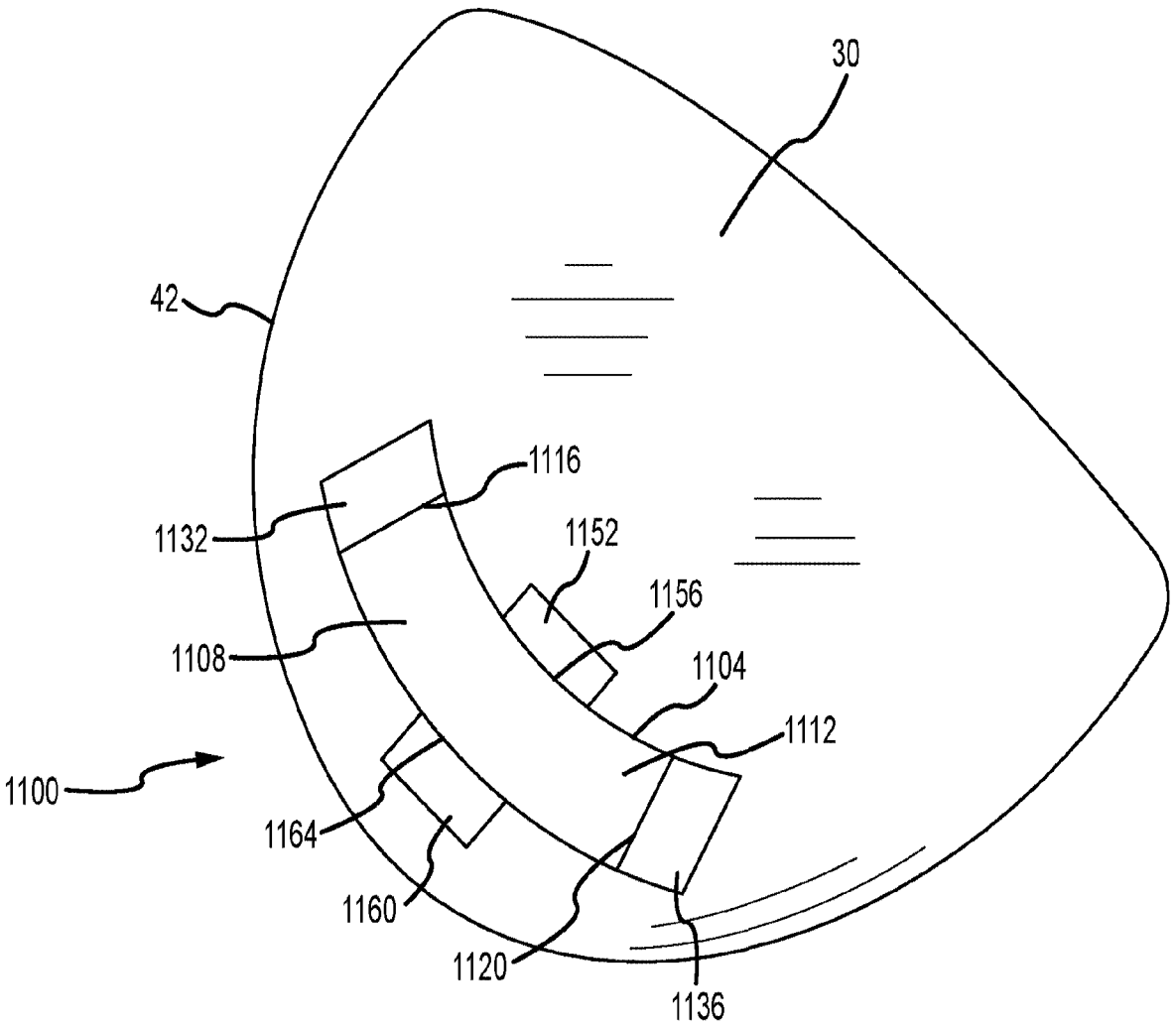
FIG. 12 is a close-up perspective view of another embodiment of the adjustable weighting system illustrating a channel positioned on the sole of the club head of FIG. 1, and a member that couples to a plurality of adjustable weights being received by the channel.

FIG. 12 illustrates another embodiment of the adjustable weighting system 1100. The adjustable weighting system 1100 has similar components to the adjustable weighting system 700, 800, 900, 1000 with like names and/or like numbers identifying like components. With reference to FIG. 12, the adjustable weighting system 1100 includes a channel 1104 and a member 1108. The channel 1004 is substantially the same as the channel 704, and the member 1108 is substantially the same as the member 708. The difference is a body 1112 of the member 1108 is configured to engage a plurality of weights, illustrated as four different weights. Similar to the adjustable weighting system 700, a first weight 1132 is attached to a first attachment location on the first end 1116 of the body 1112, and a second weight 1136 is attached to a second attachment location on the second end 1120 of the body 1112. However, in this embodiment of the adjustable weighting system 1100, a third weight 1152 is attached to a third attachment location on a first side 1156 of the body 1112, and a fourth weight 1160 is attached to a fourth attachment location on an opposing, second side 1164 of the body 1112. Each weight 1132, 1136, 1152, 1160 can be substantially the same as the weights 732, 736, and attach to the body 1112 in a similar manner as disclosed above. Further, the first, second, third, and fourth weights 1132, 1136, 1152, 1160 can be positioned at or repositioned between any attachment location on the member to adjust the weight distribution and club head center of gravity, as described below, to affect ball trajectory and/or spin.

Figure 13:
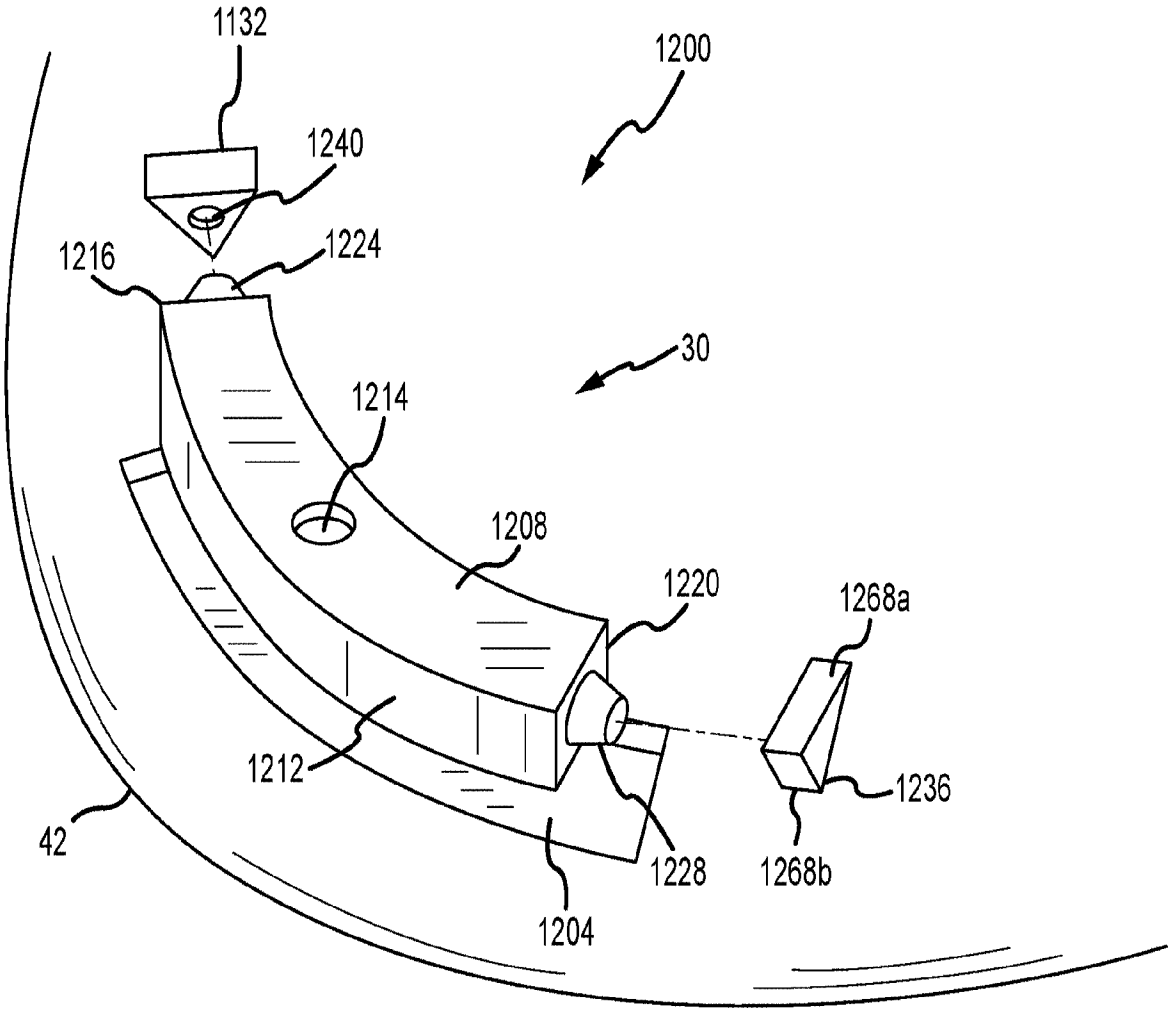
FIG. 13 is a perspective view of an embodiment of a face angle adjustment system that is configured to provide user adjustment of a resting face angle.

FIG. 13 illustrates an embodiment of a face angle adjustment system 1200. The illustrated system 1200 has structural similarities to the adjustable weighting system 700, with like names and/or like numbers identifying like components. The difference is each end member 1232, 1236 is not weighted in this embodiment, but instead has a geometry (or shape) suitable to allow for adjustment of a resting face angle. While this embodiment is discussed separately from the adjustable weighting systems 100, 500, 700, 800, 900, 1000, 1100 disclosed herein, it should be appreciated that features of the face angle adjustment system 1200 can be incorporated into any of the embodiments of the adjustable weighting system 100, 500, 700, 800, 900, 1000, 1100 to provide a system that both has adjustable weighting and can adjust a resting face angle. As such, in other embodiments, each end member 1232, 1236 can be a weight (e.g., weight 732, 736, 832, 836, 932, 936, 1132, 1136, 1152, 1160, etc.) that also includes the features that allow for adjustment of a resting face angle as disclosed herein.

With reference to FIG. 13, the face angle adjustment system 1200 includes a channel 1204 positioned in the sole 30, and a member 1208 having a body 1212. The body 1212 defines an aperture 1214 configured to receive a fastener (not shown, but shown as 810, 910, 1010 in FIGS. 7, 9, and 11, respectively) to couple the member 1208 to the channel 1204. The body 1212 includes a first end 1216 and a second end 1220, the first and second ends 1216, 1220 being positioned at opposite ends of the body 1212. A first attachment position 1224 (or first protrusion 1224 or first post 1224) is located at the first end 1216, and a second attachment position 1228 (or second protrusion 1228 or second post 1228) is located at the second end 1220. A first end member 1232 removably couples to the first attachment position 1224, and a second end member 1236 removably couples to the second attachment position 1228. Each end member 1232, 1236 has a plurality of sides 1268*a*, 1268*b*. At least one side 1268*a* can have a length that is greater than a length of the second side 1268*b* (or at least one side 1268*a* can have a length that is less than a length of the second side 1268*b*). Thus, as one or both of the end members 1232, 1236 is rotated with respect to the body 1212 (or rotated with respect to the respective attachment position 1224, 1228), one of the plurality of sides 1268*a*, 1268*b* can be oriented to extend (or project) out of the channel 1204, to be flush with the sole 30 (e.g., not extend or project out of the channel 1204), and/or be recessed within the channel 1204. It should be appreciated that each end member 1232, 1236 can include an aperture 1240 that is substantially the same as aperture 740. Accordingly, the end members 1232, 1236 can attach to the body 1212 in the same manner as the weights 732, 736 attach to the body 712, as disclosed above.

In operation of the adjustable weighting systems 500, 700, 800, 900, 1000, 1100, a user can remove the member 508, 708, 808, 908, 1008, 1108 from the associated channel 504, 704, 804, 908, 1004, 1104 by disengaging the fastener 510, 810, 910, 1010. The user can then remove and replace one or more of the weights 532, 536, 732, 736, 832, 836, 932, 936, 1032, 1036, 1132, 1136, 1152, 1160, and then reattach the member 508, 708, 808, 908, 1008, 1108 to the channel 504, 704, 804, 908, 1004, 1104 of the golf club 10.

In an embodiment without removable weights, the user can remove the member 508, 708, 808, 908, 1008, 1108 from the associated channel 504, 704, 804, 908, 1004, 1104, and then attach a second member having a different weight configuration (i.e., one or more of the weights 532, 536, 732, 736, 832, 836, 932, 936, 1032, 1036, 1132, 1136, 1152, 1160 has a different mass than the removed member).

Alternatively or additionally, the member 508, 708, 808, 908, 1008, 1108 can be removed, reoriented, and reinstalled onto the channel 507, 704, 804, 908, 1004, 1104. For example, the member 508, 708, 808, 908, 1008, 1108 can be removed from a first orientation where the first weight 532, 732, 832, 932, 1032, 1132 is positioned closer to the toe end 18 than the heel end 22, reoriented (e.g., rotated 180 degrees, flipped over, etc.), and then reattached in a second orientation where the first weight 532, 732, 832, 932, 1032, 1132 is positioned closer to the heel end 22 than to the toe end 18.

By changing one or more weights of the weights 532, 536, 732, 736, 832, 836, 932, 936, 1032, 1036, 1132, 1136, 1152, 1160, and/or reorienting the member 508, 708, 808, 908, 1008, 1108, the center of gravity 58 can be adjusted (or altered). For example, a distance that the center of gravity 58 can be adjusted (or moved) can be in the range of 0.01 inches to 0.50 inches resulting in a ball trajectory change of 0.46 yards to 23 yards. In other embodiments, the club head center of gravity 58 can be adjusted (or moved) in the range of 0.050 inches to 0.200 inches resulting in a ball trajectory change of 2.3 yards to 9.2 yards.

In operation of the face angle adjustment system 1200, a user can remove the member 1208 from the channel 1204 by disengaging the fastener 510, 810, 910, 1010. The user can then rotate, remove and replace, or otherwise reorient one or both of the end members 1232, 1236, and then reinsert the member 1208 into the channel 1204, and reattach the member 1208 to the channel 1204.

For example, by reorienting the end member 1232, 1236 positioned closest to the toe end 18 such that it extends out of the channel 1204 when reattached, and reorienting the end member 1236, 1232 positioned closest to the heel end 22 such that it does not extend out of the channel 1204 when reattached, the face angle at address (or resting face angle of the golf club) can be reoriented into a closed position, with the toe end 18 being closer than the heel end 22 to a golf ball at address (e.g., to promote a draw or a hook, etc.).

As another example, by reorienting the end member 1232, 1236 positioned closest to the toe end 18 such that it does not extend out of the channel 1204 when reattached, and reorienting the end member 1236, 1232 positioned closest to the heel end 22 such that it does extend out of the channel 1204 when reattached, the face angle at address (or resting face angle of the golf club) can be reoriented into an open position (or open configuration), with the heel end 22 being closer than the toe end 18 to the golf ball at address (e.g., to promote a cut or a slice, etc.).

As yet another example, by reorienting the end member 1232, 1236 positioned closest to the toe end 18 such that it does not extend out of the channel 1204 when reattached, and reorienting the end member 1236, 1232 positioned closest to the heel end 22 such that it does not extend out of the channel 1204 when reattached, the face angle at address (or resting face angle of the golf club) can be reoriented into a neutral position (or neutral configuration or square configuration), with neither the toe end 18 nor the heel end 22 being closer to the golf ball at address (e.g., to promote a straight ball flight, etc.).

Again, while the illustrated embodiment of the face angle adjustment system 1200 does not include weights, it should be appreciated that the end members 1232, 1236 can be weights such that the face angle adjustment system 1200, as disclosed herein, can be incorporated into one or more of the adjustable weighting systems 500, 700, 800, 900, 1000, 1100.

Figure 14:
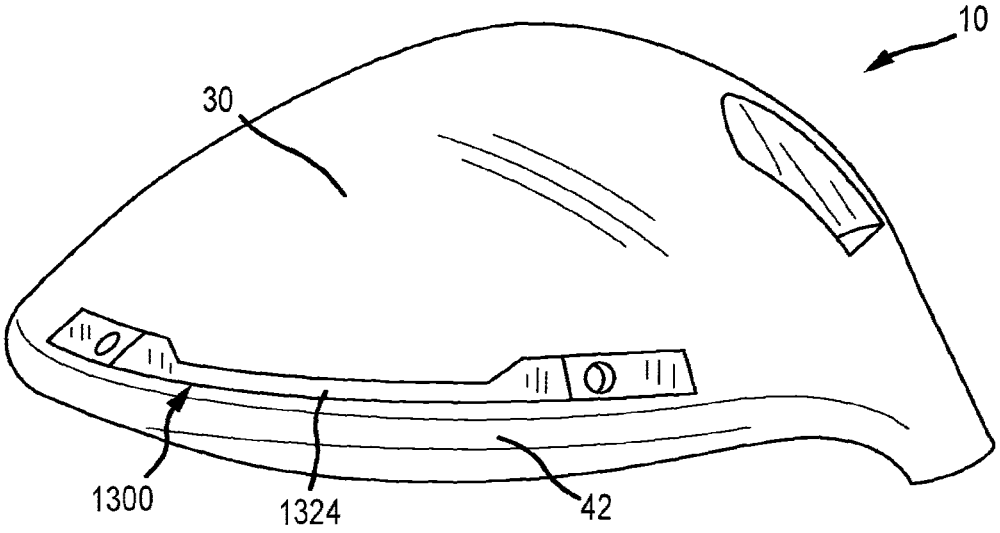
FIG. 14 is a perspective view of an embodiment of the adjustable weighting system, illustrating a channel positioned on the sole of the club head of FIG. 1, and the adjustable weighting system being received by the channel.
Figure 15:
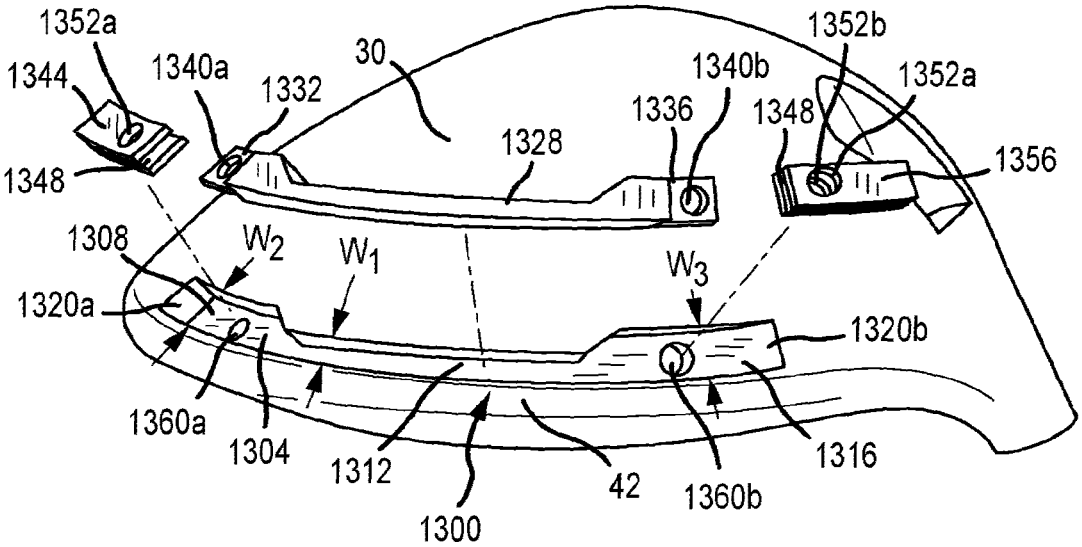
FIG. 15 is a perspective view of the channel of FIG. 14, illustrating the adjustable weighting system removed from the channel and the weights detached from a member.

Referring now to FIGS. 14-15, another embodiment of the adjustable weighting system 1300 is illustrated. The adjustable weighting system 1300 includes a single port or channel or recessed track 1304 (shown in FIG. 15) that is positioned on the sole 30 of the club head 10. In the illustrated embodiment the channel 1304 is positioned proximal, or closer to, the back 42 of the club head 10 than to the face place 34. However, in other embodiments, the channel 1304 can be positioned at any suitable location on the sole 30 of the club head 10. The channel 1304 is shown as having an arcuate or curved shape. In other embodiments, the channel 1304 can have any suitable shape (e.g., straight, etc.).

With reference to FIG. 15, the channel 1304 includes a first channel portion 1308, a second channel portion 1312, and a third channel portion 1316. The channel portions 1308, 1312, 1316 can collectively define the channel 1304 (or a portion of the channel 1304). The second channel portion 1312 is positioned between the first and third channel portions 1308, 1316. The second channel portion 1312 includes a first width $W_1$ that defines a distance between opposing edges of the channel 1304 in the second channel portion 1312. The first channel portion 1308 includes a second width $W_2$ that defines a distance between opposing edges of the channel 1304 in the first channel portion 1308. Similarly, the third channel portion 1316 includes a third width $W_3$ that defines a distance between opposing edges of the channel 1304 in the third channel portion 1316. The first width $W_1$ is less than the second width $W_2$ and the third width $W_3$ to form a taper in the channel 1304. Stated another way, the channel 1304 is narrower at the second channel portion 1312 than at the first and third channel portions 1308, 1316. In the illustrated embodiment, the second width $W_2$ and the third width $W_3$ are substantially the same (or equal). However, in other embodiments the second width $W_2$ and the third width $W_3$ can be different widths (or do not equal).

The channel 1304 includes tapered ends 1320*a, b*. The tapered ends 1320*a, b* define a depth taper (instead of a width taper), and are positioned on opposite ends of the channel 1304 to provide a gradual decrease in depth from the respective channel portion 1308, 1316 to an edge of the channel 1304. The first tapered end 1320*a* is positioned in the first channel portion 1308, and has a decreasing depth. Stated another way, the depth along the tapered end 1320*a* is less than a depth taken at the first channel portion 1308. The second tapered end 1320*b* is substantially the same as the first tapered end 1320*a*, except that it is positioned in the third channel portion 1316. In other examples of embodiments, the channel 1304 can have one end that includes a tapered end 1320, or does not include any tapered ends.

Referring back to FIGS. 14-15, the adjustable weighting system 1300 also includes a member 1324 (or insert 1324) that is configured to be received by the channel 1304. In the illustrated embodiment, the member 1324 has a shape that is complimentary to the channel 1304, such that the member 1324 is received by the channel 1304.

With reference to FIG. 15, the member 1324 includes a body 1328 (or a central member 1328). The body 1328 includes a first end 1332 that is opposite a second end 1336. Each of the ends 1332, 1336 has a thickness (or depth) that is less than the thickness (or depth) of the body 1328. Each end 1332, 1336 also defines a respective aperture 1340*a, b* that extends entirely through the end 1332, 1336. The body 1328 can have a weight (or a mass). A first weight 1344 is configured to attach to a first attachment location at the first end 1332. More specifically, the first weight 1344 defines a slot 1348 that is configured to receive (or slidably receive) the first end 1332. The first weight 1344 also includes opposing apertures 1352*a, b* that are positioned through the first weight 1344 on opposing sides of the slot 1348. The second weight 1356 is substantially the same as the first weight 1344, with like numbers identifying like components. It should be appreciated that the member 1324 includes the body 1328, the first weight 1344, and the second weight 1356.

The first weight 1344 removably attaches to the body 1328 at the first end 1332. The first weight 1344 receives the first end 1332 in the slot 1348. Stated another way, the first end 1332 is slidably received by the slot 1348 in the first weight 1344. The apertures 1352*a*, 1340*a*, and 1352*b* are then positioned into alignment, with the aperture 1340*a* of the first end 1332 being positioned between the apertures 1352*a*, 1352*b* of the first weight 1344. Once aligned, the apertures 1352*a*, 1340*a*, 1352*b* can receive a fastener (e.g., a threaded screw, etc.) (not shown). The second weight 1356 removably attaches to the body 1328 at a second attachment location at the second end 1336 in the same way. More specifically, the second weight 1356 receives the second end 1336 in the slot 1348. Stated another way, the second end 1336 is slidably received by the slot 1348 in the second weight 1356. The apertures 1352*a*, 1340*b*, and 1352*b* are then positioned into alignment, with the aperture 1340*b* of the second end 1336 being positioned between the apertures 1352*a*, 1352*b* of the second weight 1356. Once aligned, the apertures 1352*a*, 1340*b*, 1352*b* can receive a fastener (e.g., a threaded screw, etc.) (not shown).

The fasteners (not shown) that couple the weights 1344, 1356 to the body 1328 can also couple the member 1324 to the club head 10 in the channel 1304. More specifically, the fasteners (not shown) are configured to be received (or engage) in a respective bore 1360*a, b* positioned in the channel 1304. More specifically, a first bore 1360*a* is positioned in the first channel portion 1308, and a second bore 1360*b* is positioned in the third channel portion 1316. In many embodiments, the fastener can comprise a density similar to or less than the density of the club head body, such that the fastener does not significantly contribute to the weight distribution of the club head 10.

The first and second weights 1344, 1356 can be positioned at or repositioned between any attachment location to adjust the weight distribution and club head center of gravity, as described below, to affect ball trajectory and/or spin.

Figure 16:
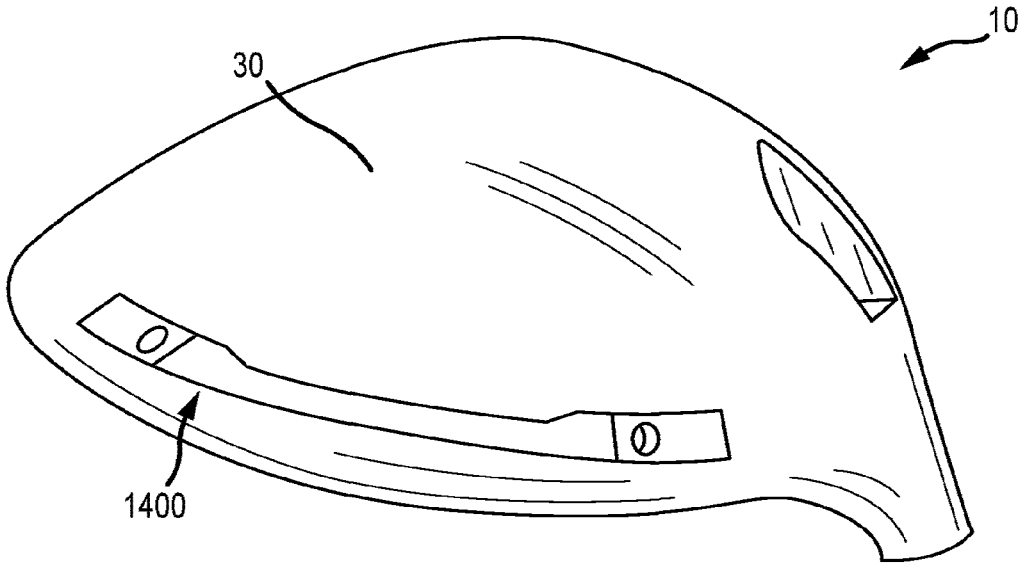
FIG. 16 is a perspective view of another embodiment of the adjustable weighting system illustrating a channel positioned on the sole of the club head of FIG. 1, and the adjustable weighting system being received by the channel.
Figure 17:
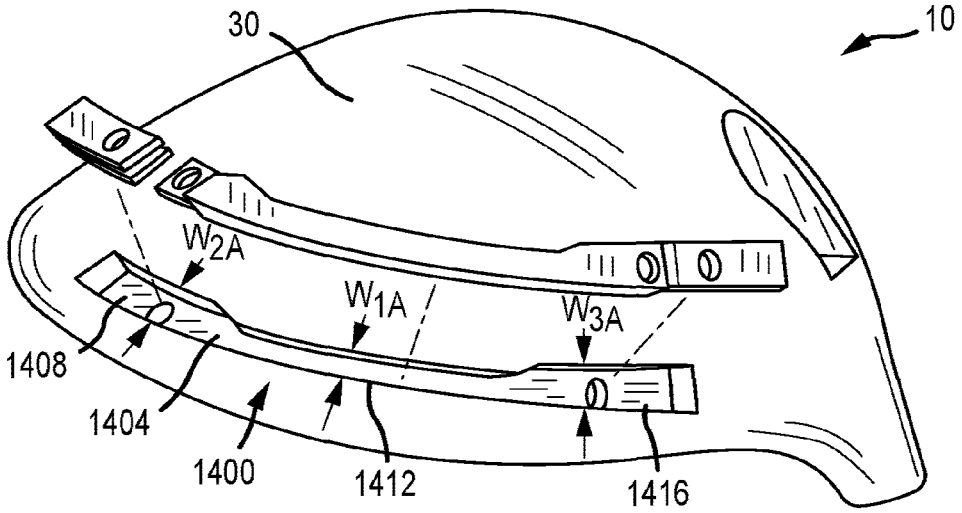
FIG. 17 is a perspective view of the channel of FIG. 16, illustrating the adjustable weighting system removed from the channel and the weights detached from the member.

FIGS. 16-17 illustrate another embodiment of the adjustable weighting system 1400. The adjustable weighting system 1400 has similar components to the adjustable weighting system 1300, with like names and/or like numbers identifying like components. The adjustable weighting system 1400 is substantially similar to the adjustable weighting system 1300, and only the differences are described herein, with similar structure referenced with the same reference numerals incremented by "100" (e.g., 1304 and 1404 both reference the channel, etc.).

With reference to FIG. 17, the adjustable weighting system 1400 includes a channel 1404 that includes a first channel portion 1408, a second channel portion 1412, and a third channel portion 1416. The channel portions 1408, 1412, 1416 are substantially the same as channel portion 1308, 1312, 1316, except that the first width $W_{1A}$ that defines a distance between opposing edges of the channel 1404 in the second channel portion 1412 is greater than the first width $W_1$ of the second channel portion 1312. The first width $W_{1A}$ is less than a second width $W_{2A}$ that defines a distance between opposing edges of the channel 1404 in the first channel portion 1408. The first width $W_{1A}$ is also less than a third width $W_{3A}$ that defines a distance between opposing edges of the channel 1404 in the third channel portion 1416. Accordingly, the taper formed in the channel 1404 is present, but less pronounced (or less significant) than the taper formed in the channel 1304.

Figure 18:
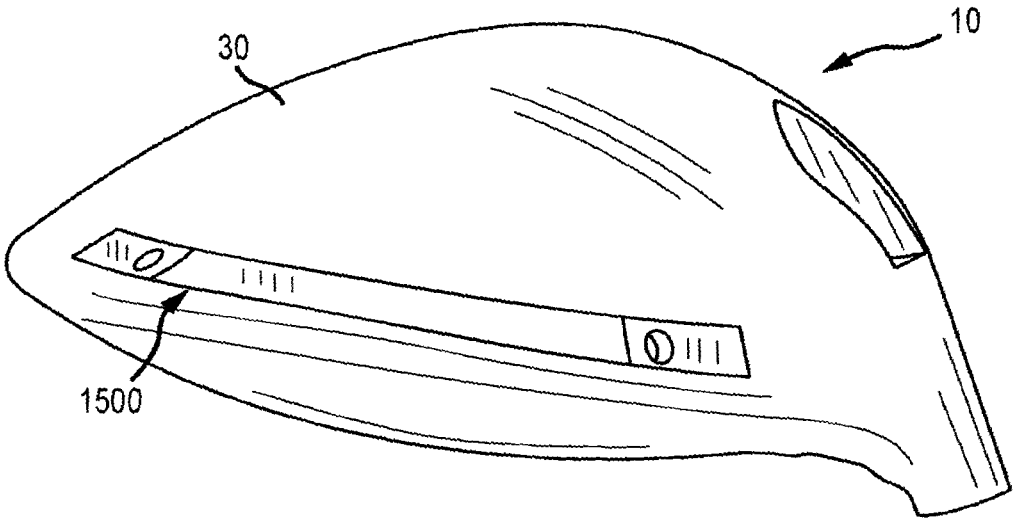
FIG. 18 is a perspective view of another embodiment of the adjustable weighting system illustrating a channel positioned on the sole of the club head of FIG. 1, and the adjustable weighting system being received by the channel.
Figure 19:
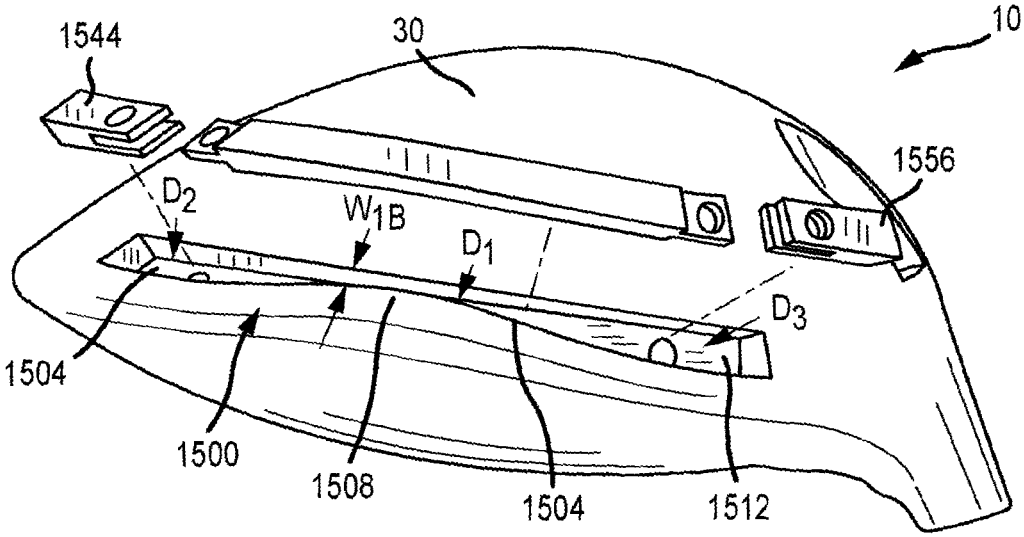
FIG. 19 is a perspective view of the channel of FIG. 18, illustrating the adjustable weighting system removed from the channel and the weights detached from the member.

FIGS. 18-19 illustrate another embodiment of the adjustable weighting system 1500. The adjustable weighting system 1500 has similar components to the adjustable weighting system 1300, 1400, with like names and/or like numbers identifying like components. The adjustable weighting system 1500 is substantially similar to the adjustable weighting system 1300, and only the differences are described herein, with similar structure referenced with the same reference numerals incremented by "200" (e.g., 1304 and 1504 both reference the channel, etc.).

With reference to FIG. 19, the adjustable weighting system 1500 includes a channel 1504 that includes a first channel portion 1508, a second channel portion 1512, and a third channel portion 1516. The channel portions 1508, 1512, 1516 are substantially the same as channel portions 1308, 1312, 1316, except that the channel 1504 has a constant width $W_{1B}$ along the channel portions 1508, 1512, 1516, and the channel 1504 has a variable depth. More specifically, a depth of the channel in the second channel portion 1512 is less than a depth of the channel in the first channel portion 1508 and the third channel portion 1516. More specifically, the second channel portion 1512 includes a first depth $D_1$. The first channel portion 1508 includes a second depth $D_2$, while the third channel portion 1516 includes a third depth $D_3$. The first depth $D_1$ is less than the second depth $D_2$ and the third depth $D_3$. Accordingly, the channel 1504 has a greater depth at the first and third channel portions 1508, 1516, which respectively receive weights 1544, 1556, than the second channel portion 1508. It should be appreciated that the weights 1544, 1556 are substantially the same as the weights 1344, 1356.

Figure 20:
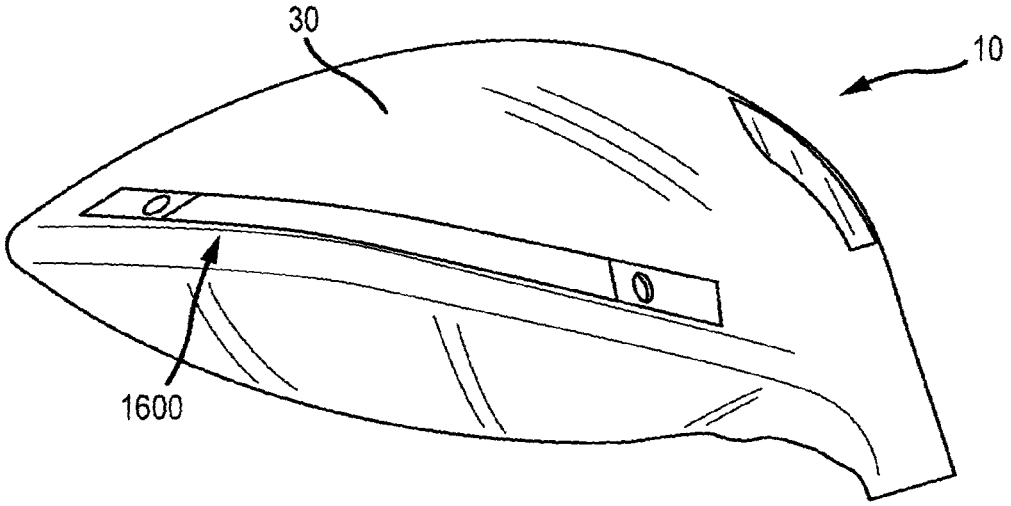
FIG. 20 is a perspective view of another embodiment of the adjustable weighting system illustrating a channel positioned on the sole of the club head of FIG. 1, and the adjustable weighting system being received by the channel.
Figure 21:
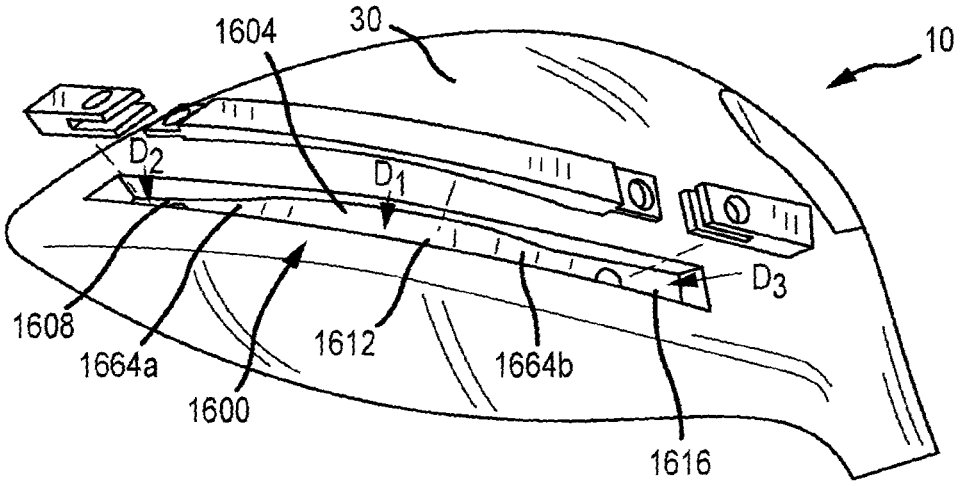
FIG. 21 is a perspective view of the channel of FIG. 20, illustrating the adjustable weighting system removed from the channel and the weights detached from the member.

FIGS. 20-21 illustrate another embodiment of the adjustable weighting system 1600. The adjustable weighting system 1600 has similar components to the adjustable weighting system 100, 1300, 1400, 1500 with like names and/or like numbers identifying like components. The adjustable weighting system 1600 is substantially similar to the adjustable weighting system 1500, and only the differences are described herein, with similar structure referenced with the same reference numerals incremented by "100" (e.g., 1404 and 1504 both reference the channel, etc.).

With reference to FIG. 21, the adjustable weighting system 1600 includes a channel 1604 that includes a first channel portion 1608, a second channel portion 1612, and a third channel portion 1616. The channel portions 1608, 1612, 1616 are substantially the same as channel portions 1508, 1512, 1516, except that the channel 1604 includes a tapered transition between the second channel portion 1612 and the first channel portion 1608, and between the second channel portion 1612 and the third channel portion 1616. More specifically, the channel 1604 includes a first tapered depth transition 1664*a* between the second channel portion 1612 and the first channel portion 1608. The first tapered depth transition 1664*a* is an incremental increase in channel depth from the second channel portion 1612 to the first channel portion 1608. Stated another way, the first tapered depth transition 1664*a* is a slope between the second channel portion 1612 and the first channel portion 1608. The channel 1604 also includes a second tapered depth transition 1664*b* between the second channel portion 1612 and the third channel portion 1616. The second tapered depth transition 1664*b* is substantially the same as the first tapered depth transition 1664*a*, except that it is positioned between the second channel portion 1612 and the third channel portion 1616.

FIG. 22 illustrates another embodiment of the adjustable weighting system 1700. The adjustable weighting system 1700 has similar components to the adjustable weighting system 1300, 1400, 1500, 1600, with like names and/or like numbers identifying like components. The adjustable weighting system 1700 is substantially similar to the adjustable weighting system 1300, and only the differences are described herein, with similar structure referenced with the same reference numerals incremented by "400" (e.g., 1304 and 1704 both reference the channel, etc.).

The adjustable weighting system 1700 includes a member 1724 (or insert 1724) that is configured to be received by a channel 1704 (noted with a broken line). In the illustrated embodiment, the member 1724 has a shape that is complimentary to the channel 1704, such that the member 1724 is received by the channel 1704. The member 1724 includes a first weight 1744 and a second weight 1756. The member 1724 is substantially the same as the member 1324, and the weights 1744, 1756 are substantially the same as the weights 1344, 1356. However, the member 1724 is different in that it has a "T-shape." More specifically, the member 1724 includes a body 1728 and a leg 1768 that is oriented approximately orthogonal to the body 1728. The channel 1704 thus has a corresponding additional channel portion (not shown) that is oriented approximately orthogonal to the second channel portion (not shown) and is configured to receive the leg 1768. The leg 1768 includes a third weight 1772 that is substantially the same as the first and second weights 1344, 1356. Further, the third weight 1772 removably couples to the leg 1768 in the same way as the first and second weights 1344, 1356 removably couple to the body 1328.

Operation of the adjustable weighting systems 1300, 1400, 1500, 1600, 1700 is substantially similar, and as such, operation will be discussed in association with the adjustable weighting system 1300. The same steps will apply to the other embodiments of the weighting systems 1400, 1500, 1600, 1700.

A user can remove the member 1324 from the channel 1304 by disengaging the fasteners (not shown) from the respective bore 1360 positioned in the channel 1304. Once removed from the channel 1304, the user can disengage (or otherwise remove) one or more of the weights 1344, 1356 from the body 1328. To remove the respective weight 1344, 1356, the user disengages the fastener (not shown) from the aligned apertures 1352*a*, 1340, 1352*b*. The respective weight 1344, 1356 is then free to be disengaged from the body 1328. A user can then exchange the body 1328 or the weight 1344, 1356 with another having a different mass (e.g., lighter or heavier) to change the weighting characteristic of the golf club head 10. The body 1328 and/or weight 1344, 1356 having a different mass can then be reengaged (or reattached). More specifically the weight 1344, 1356 slidably receives a portion of the body 1328 (e.g., the first end 1332, the second end 1336, etc.) and aligns the apertures 1352*a*, 1340, 1352*b*. Once the apertures 1352*a*, 1340, 1352*b* are aligned, the fastener (not shown) can be reinserted through the apertures 1352*a*, 1340, 1352*b*. The member 1324 can then be positioned (or repositioned) into the channel 1304, and each fastener (not shown) can be engaged (or reengaged) with the respective bore 1360 in the channel 1304. It should be appreciated that the operation above applies not only to removal of the weights 1344, 1356, but also embodiments with three weights 1744, 1756, 1772.

By changing one or more of the body 1328 and/or the weights 1344, 1356 (or weights 1744, 1756, 1772), the center of gravity 58 can be adjusted (or altered). For example, a distance that the center of gravity 58 can be adjusted (or moved) can be in the range of 0.01 inches to 0.50 inches resulting in a ball trajectory change of 0.46 yards to 23 yards. In other embodiments, the club head center of gravity 58 can be adjusted (or moved) in the range of 0.050 inches to 0.200 inches resulting in a ball trajectory change of 2.3 yards to 9.2 yards.

Figure 23:
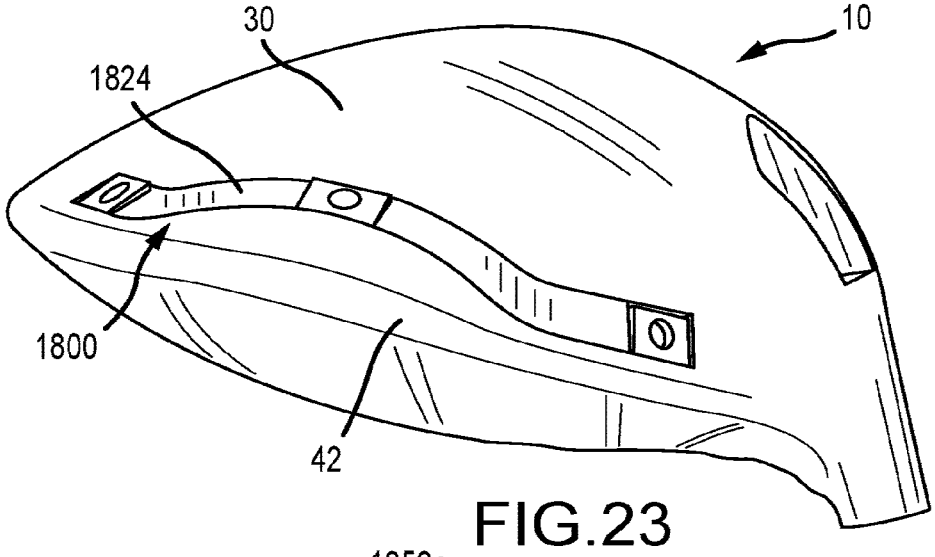
FIG. 23 is a perspective view of an embodiment of the adjustable weighting system, illustrating a channel positioned on the sole of the club head of FIG. 1, and the adjustable weighting system being received by the channel.
Figure 24:
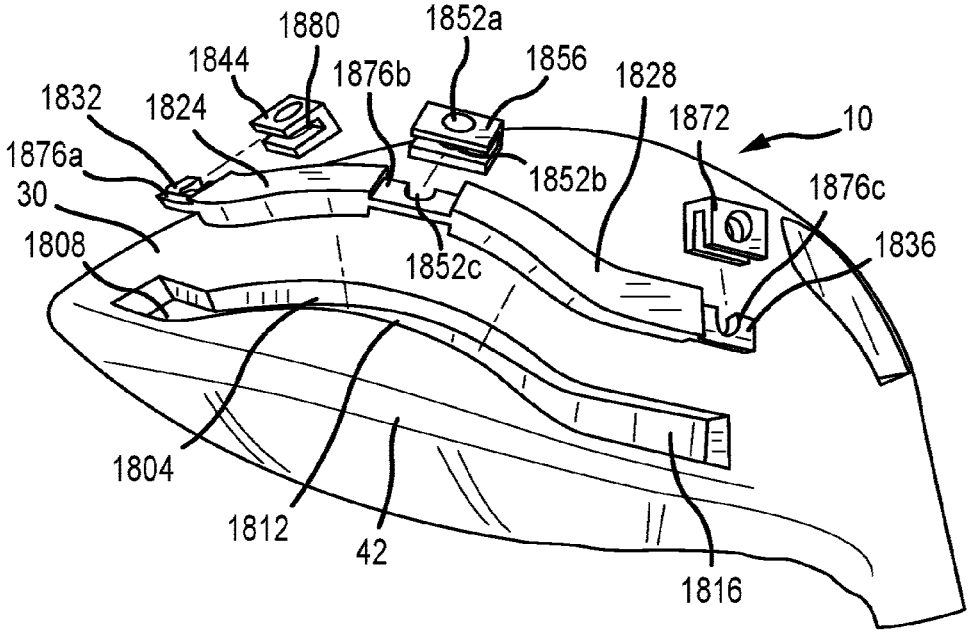
FIG. 24 is a perspective view of the channel of FIG. 23, illustrating the adjustable weighting system removed from the channel and the weights detached from a member.

Referring now to FIGS. 23-24, an embodiment of the adjustable weighting system 1800 is illustrated. The system 1800 includes a single port or channel or recessed track 1804 configured to receive a plurality of weights in various configurations. The channel 1804 is an arcuate or curved channel 1804 positioned on a portion of the sole 30. Stated another way, the channel 1804 is positioned towards the back 42 of the club head 10, proximate the rail 74, or positioned closer to the back 42 of the club head 10 than to the face plate 34. In other embodiments, the channel 1804 can be positioned on the skirt 74, on both the skirt 74 and the sole 30, and/or at any other suitable location on the club head 10. While the channel 1804 is illustrated as having a generally arcuate shape, in other embodiments, the channel 1804 can take any shape (e.g., be linear, geometric, etc.).

With reference to FIG. 24, the channel 1804 includes a first channel portion 1808, a second channel portion 1812, and a third channel portion 1816. The channel portions 1808, 1812, 1816 can collectively define the channel 1804 (or a portion of the channel 1804). The second channel portion 1812 is positioned between the first and third channel portions 1808, 1816. The second channel portion 1812 includes a curved or arcuate shape, while the first and third channel portions 1808, 1816 are generally straight in shape. Accordingly, the channel 1804 is shown as having a portion with an arcuate or curved shape. In other embodiments, the channel 1804 can have any suitable shape (e.g., straight, etc.). The channel 1804 is shown as having a varying channel width. More specifically, the channel 1804 can have a different width at the first channel portion 1808 or third channel portion 1816 than at the second channel portion 1812 (e.g., the first and third channel portions 1808, 1816 can be narrower (or wider) than the second channel portion 1812, etc.). In other embodiments, the channel 1804 can have a uniform (or substantially the same) width through the portions 1808, 1812, 1816 of the channel.

Referring back to FIGS. 23-24, the adjustable weighting system 1800 also includes a member 1824 (or insert 1824) that is configured to be received by the channel 1804. In the illustrated embodiment, the member 1824 has a shape that is complimentary to the channel 1804, such that the member 1824 is received by the channel 1804.

With reference to FIG. 24, the member 1824 includes a body 1828. The body 1828 includes a first end 1832 that is opposite a second end 1836. The body 1828 also includes a plurality of mounting points or attachment locations 1876. More specifically, the body 1828 includes a first attachment location 1876*a* (positioned at the first end 1832), a second attachment location 1876*b* (positioned between the first and second ends 1832, 1836), and a third attachment location 1876*c* (positioned at the second end 1836). In the illustrated embodiment, the second attachment location 1876*b* is positioned approximately equidistant from the first and second ends 1832, 1836 (or approximately at a central location along the body 1828). In other embodiments, the second attachment location 1876*b* can be located at any position between the first and second ends 1832, 1836. In addition, a plurality of second attachment locations 1876*b* can be located at any suitable positions between the first and second ends 1832, 1836.

In the illustrated embodiment, each attachment location 1876 has a thickness (or a depth) that is less than a thickness (or a depth) of the rest of the body 1828. As such, each weight couples to the body 1828 at each attachment location 1876. As shown, each weight can slide (or clip) into engagement with the body 1828 at each attachment location 1876. As shown in FIG. 24, a first weight 1844 removably couples to the first attachment location 1876*a*, a second weight 1856 removably couples to the second attachment location 1876*b*, and a third weight 1872 removably couples to the third attachment location 1876*c*. To facilitate the engagement, each weight 1844, 1856, 1872 includes a channel 1880. More specifically, each weight 1844, 1856, 1872 has a U-shaped configuration to define the channel 1880. The channel 1880 is configured to receive a respective attachment location 1876 (i.e., the less thick, or thinner, portion of the body 1828) to couple, or otherwise attach, the respective weight 1844, 1856, 1872 to the body 1828. Each weight 1844, 1856, 1872 can also include aligned apertures 1852*a, b* that are positioned on opposing sides of the channel 1880. Each attachment location 1876 can also include an aperture 1852*c*. In response to each weight 1844, 1856, 1872 being coupled to the body 1828 at the respective attachment location 1876, the apertures 1852*a, c, b* are positioned into alignment. The aligned apertures 1852*a, c, b* can receive a fastener (e.g., a threaded screw, bolt, etc.) (not shown). The fasteners (not shown) can further couple the member 1824 to the club head 10 in the channel 1804. More specifically, the fasteners (not shown) are configured to be received (or engage) in a respective bore (not shown) positioned in the channel 1804. In many embodiments, the fasteners can comprise a density similar to or less than the density of the club head body, such that the fasteners do not significantly contribute to the weight distribution of the club head 10.

The body 1828 and each weight 1844, 1856, 1872 has a geometric or a polygonal shape. In other embodiments, the body 1828 and/or each weight 1844, 1856, 1872 can have any shape suitable to removably attach (e.g., the weights 1844, 1856, 1872 to the body 1828), and be received by the channel 1804.

The first, second, and third weights 1844, 1856, 1872 can be positioned at or repositioned between any attachment location to adjust the weight distribution and club head center of gravity, as described below, to affect ball trajectory and/or spin.

Figure 25:
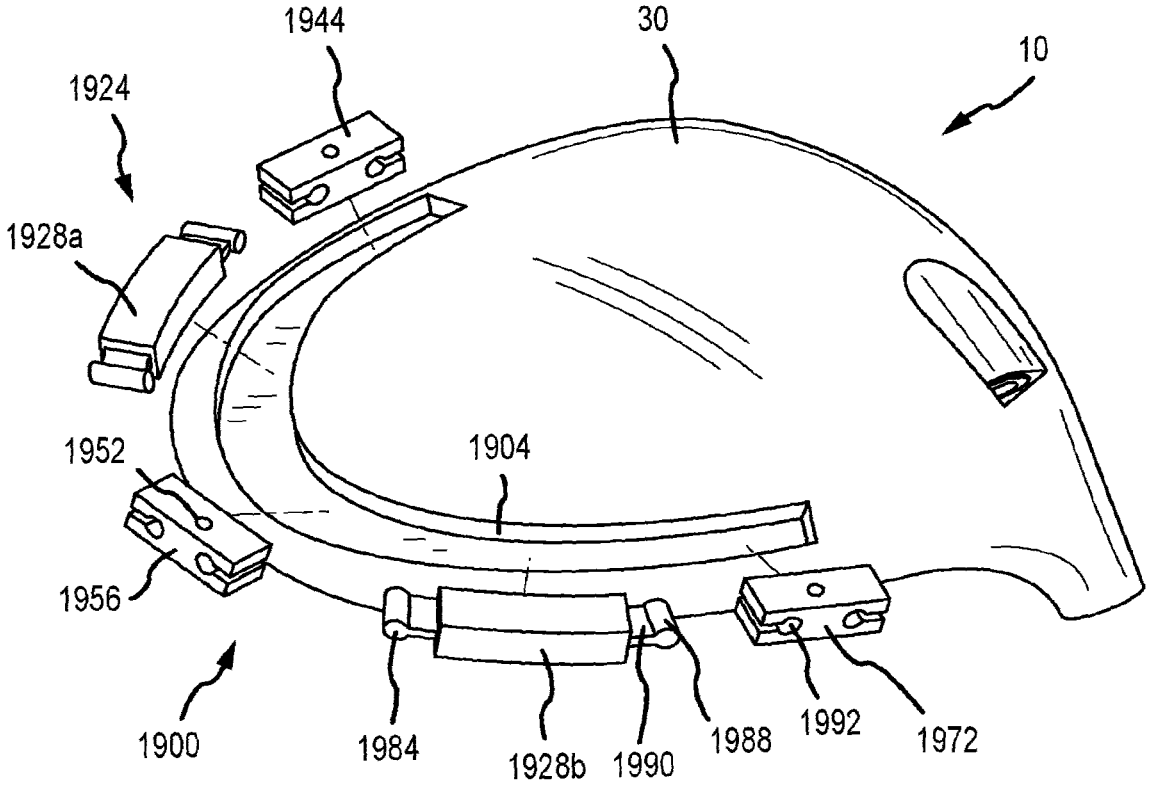
FIG. 25 is a perspective view of another embodiment of the adjustable weighting system illustrating a channel positioned on the sole of the club head of FIG. 1, and the adjustable weighting system removed from the channel and in an exploded configuration.

FIG. 25 illustrates another embodiment of the adjustable weighting system 1900. The adjustable weighting system 1900 has similar components to the adjustable weighting system 1800, with like names and/or like numbers identifying like components. The adjustable weighting system 1900 is substantially similar to the adjustable weighting system 1800, and only the differences are described herein, with similar structure referenced with the same reference numerals incremented by "100" (e.g., 1804 and 1904 both reference the channel, etc.).

With reference to FIG. 25, the adjustable weighting system 1900 includes a channel 1904 that is configured to receive a member 1924 (or insert 1924). The member 1924 can include at least one connecting member 1928 (or body 1928) and at least one weight 1944. More specifically, and as illustrated in FIG. 25, the member 1924 includes a plurality of connecting members 1928*a*, 1928*b* and a plurality of weights 1944, 1956, 1972. Each weight 1944, 1956, 1972 is in a keyed relationship with at least one connecting member 1928*a*, 1928*b*. More specifically, each weight 1944, 1956, 1972 is configured to interlock with one of the connecting member 1928*a*, 1928*b* to define the member 1928. To facilitate the interlocking connection, the connecting members 1928*a*, 1928*b* each include at least one pin 1984, and more specifically pins 1984 positioned on opposing ends of each member 1928*a*, 1928*b*. The pin 1984 can include a head 1988 that is connected to the member 1928 by a shaft 1990. The head 1988 has a different thickness than the shaft 1990. The pin 1984 is configured to be received by a corresponding aperture 1992 in each weight 1944, 1956, 1972. Each weight includes apertures 1992 positioned on opposing ends of the weight 1944, 1956, 1972. This facilitates a chainlike arrangement, alternating weights and connecting members to define the member 1924. More specifically, a first weight 1944 is removably coupled to one end of a first connecting member 1928*a*, while a first end of a second weight 1956 is removably coupled to a second, opposite end of the first connecting member 1928*a*. The second weight 1956 is removably coupled to a first end of a second connecting member 1928*b*. The second connecting member 1928*b* couples to a second end of the second weight 1956, opposite the first end. A third weight 1972 is also removably coupled to a second end of the second connecting member 1928*b*, the second end opposite the first end. Accordingly, the connecting members 1928*a, b* and weights 1944, 1956, 1972 are removably coupled through the keyed, interlocking relationship. It should be appreciated that the connecting members 1928*a, b* and weights 1944, 1956, 1972 can be constructed of similar materials and/or have masses as described above in association with the body 1828 and the weights 1844, 1856, 1872. In addition, the member 1924 can removably couple to the to the club head 10 in the channel 1804 by one or more fasteners (not shown). The fasteners (not shown) are configured to be received (or engage) by an aperture 1952 in each weight 1944, 1956, 1972 and a bore 1960 in the channel 1904 when the respective aperture 1952 and bore 1960 are positioned into alignment.

Figure 26:
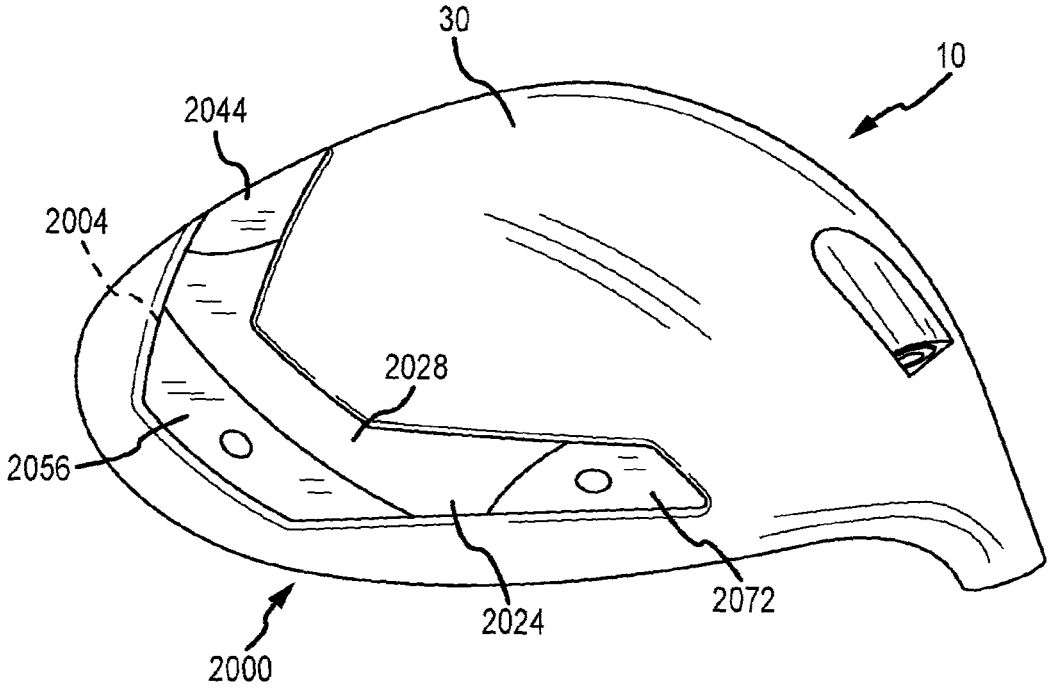
FIG. 26 is a perspective view of another embodiment of the adjustable weighting system illustrating a channel positioned on the sole of the club head of FIG. 1, and the adjustable weighting system being received by the channel.

FIG. 26 illustrates another embodiment of the adjustable weighting system 2000. The adjustable weighting system 2000 has similar components to the adjustable weighting system 1800, 1900, with like names and/or like numbers identifying like components. The adjustable weighting system 2000 is substantially similar to the adjustable weighting system 1800, and only the differences are described herein, with similar structure referenced with the same reference numerals incremented by "200" (e.g., 1804 and 2004 both reference the channel, etc.).

The adjustable weighting system 2000 includes a channel 2004 that removably receives a member 2024. The member 2024 includes a body 2028. A plurality of weights 2044, 2056, 2072 are configured to removably couple to the body 2028 at different positions on the body 2028. As illustrated, the body 2028 includes three mounting positions (or edges) (not shown) that are each configured to couple to one of the weights 2044, 2056, 2072. The weights 2044, 2056, 2072 are substantially the same shape (or geometry) and/or size, which allows each weight 2044, 2056, 2072 to be connected to any one of the mounting positions (not shown). For example, each weight 2044, 2056, 2072 can have a channel (not shown) along a perimeter edge. For example, a channel can be positioned on each edge of the weight 2044, 2056, 2072, such that the channels can be positioned along the edges up to, and including the entire perimeter as defined by the edges. This allows a suitable edge of the weight 2044, 2056, 2072 to couple to a suitable mounting position (such as by the keyed relationship disclosed in association with the adjustable weighting system 1900) by reorienting the weight 2044, 2056, 2072 to match required orientation to couple to the desired mounting position (not shown).

Figure 27:
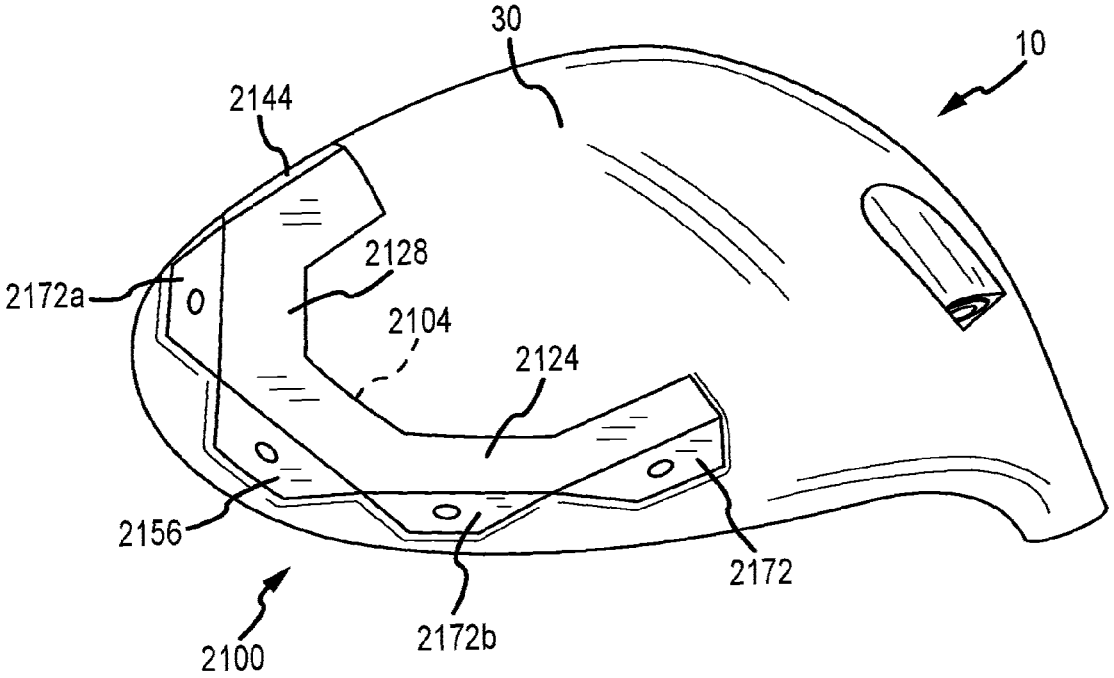
FIG. 27 is a perspective view of another embodiment of the adjustable weighting system illustrating a channel positioned on the sole of the club head of FIG. 1, and the adjustable weighting system being received by the channel.

FIG. 27 illustrates another embodiment of the adjustable weighting system 2100. The adjustable weighting system 2100 has similar components to the adjustable weighting system 1800, 1900, 2000 with like names and/or like numbers identifying like components. The adjustable weighting system 2100 is substantially similar to the adjustable weighting system 2000, and only the differences are described herein, with similar structure referenced with the same reference numerals incremented by "100" (e.g., 2004 and 2104 both reference the channel, etc.).

The adjustable weighting system 2100 includes a channel 2104 that removably receives a member 2124. The member 2124 includes a body 2128. A plurality of weights are removably coupled to the body 2128 at different positions on the body 2128. The body 2128 has a general "U-shape" to provide three, four, or five weight mounting positions. For example, the body 2128 can include three mounting positions (not shown) for weights 2144, 2156, 2172. The body 2128 can also add additional mounting positions (not shown) for two additional weights 2172*a*, 2172*b*. The weights 2144, 2156, 2172, 2172*a*, 2172*b* can be removably coupled to the body 2128 as described in association with adjustable weighting system 2000. In addition, the weights 2144, 2156, 2172, 2172*a*, 2172*b* can have the same substantially the same shape (or geometry) and/or size, which allows each weight 2144, 2156, 2172, 2172*a*, 2172*b* to be connected to any one of the mounting positions (not shown). In other embodiments, the body 2128 can include one, two, three, four, or five weight mounting positions, and can include any one or combination of the mounting positions disclosed herein.

Figure 28:
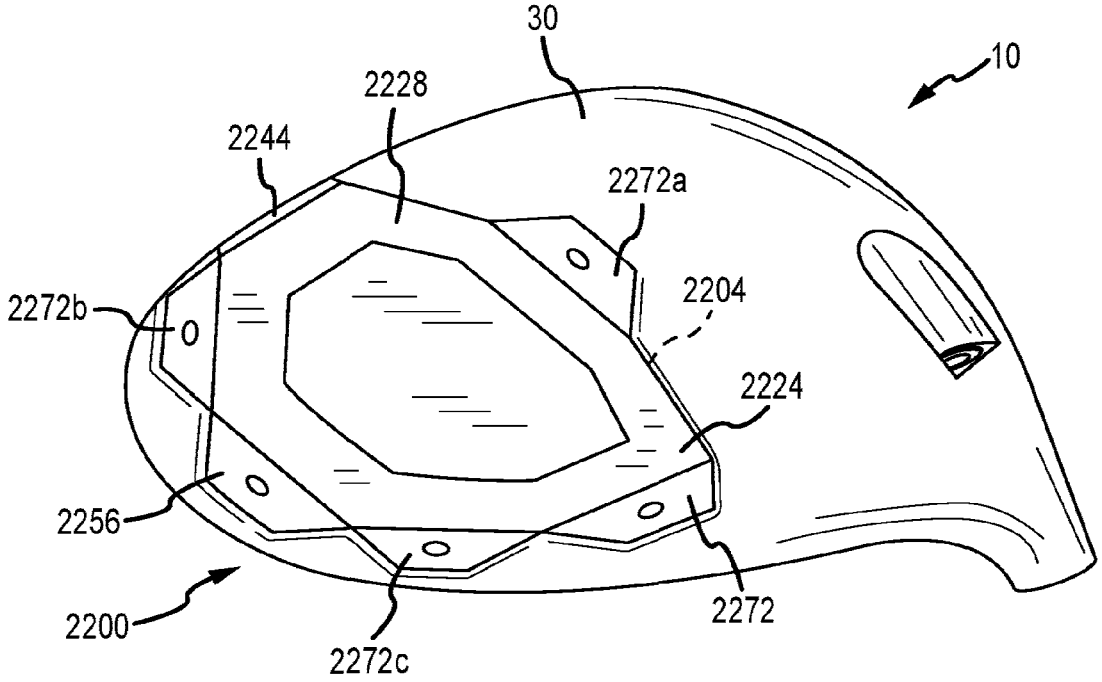
FIG. 28 is a perspective view of another embodiment of the adjustable weighting system illustrating a channel positioned on the sole of the club head of FIG. 1, and the adjustable weighting system being received by the channel.

FIG. 28 illustrates another embodiment of the adjustable weighting system 2200. The adjustable weighting system 2200 has similar components to the adjustable weighting system 1800, 1900, 2000, 2100 with like names and/or like numbers identifying like components. The adjustable weighting system 2200 is substantially similar to the adjustable weighting system 2000 and only the differences are described herein, with similar structure referenced with the same reference numerals incremented by "200" (e.g., 2004 and 2204 both reference the channel, etc.).

The adjustable weighting system 2200 includes a channel 2204 that removably receives a member 2224. The member 2224 includes a body 2228. A plurality of weights are removably coupled to the body 2228 at different positions on the body 2228. The body 2228 has a general "O-shape" to provide four, five, or six weight mounting positions. For example, the body 2228 can include four mounting positions (not shown) for weights 2244, 2256, 2272, 2272*a*. The body 2228 can also add additional mounting positions (not shown) for two additional weights 2272*b*, 2272*c*. The weights 2244, 2256, 2272, 2272*a*, 2272*b*, 2272*c* can be removably coupled to the body 2228 as described in association with adjustable weighting system 2000. In addition, the weights 2244, 2256, 2272, 2272*a*, 2272*b*, 2272*c* can have substantially the same shape (or geometry) and/or size, which allows each weight 2244, 2256, 2272, 2272*a*, 2272*b*, 2272*c* to be connected to any one of the mounting positions (not shown). In other embodiments, the body 2228 can include one, two, three, four, five, or six weight mounting positions, and can include any one or combination of the mounting positions disclosed herein.

FIG. 29 illustrates another embodiment of the adjustable weighting system 2300. The adjustable weighting system 2300 has similar components to the adjustable weighting system 1800, 1900, 2000, 2100, 2200 with like names and/or like numbers identifying like components. The adjustable weighting system 2300 is substantially similar to the adjustable weighting system 1800 and only the differences are described herein, with similar structure referenced with the same reference numerals incremented by "500" (e.g., 1804 and 2304 both reference the channel, etc.).

The adjustable weighting system 2300 includes a channel 2304 that removably receives a member 2324. The member 2324 includes a body 2328. Weights 2344, 2356 are removably couples at opposite ends of the body 2328. The member 2324 is oriented to extend in a plane that intersects both the face plate 34 and the back 42 of the club head 10. Thus, removal and readjustment of the weights 2344, 2356 relative to the body 2328 can influence the spin rate (e.g., backspin) of a golf ball struck by the club head 10.

It should be appreciated that the body 2328 and the weights 2344, 2356 can be constructed of similar materials and/or have masses as described above in association with the body 1828 and the weights 1844, 1856. In addition, the member 2324 can removably couple to the to the club head 10 in the channel 2304 by one or more fasteners (not shown). The fasteners (not shown) are configured to be received (or engage) by an aperture 2352 in each weight 2344, 2356 and a bore (not shown) in the channel 2304 when the respective aperture 2352 and bore (not shown) are positioned into alignment.

Operation of the adjustable weighting systems 1800, 1900, 2000, 2100, 2200, 2300 is substantially similar, and as such, operation will be discussed in association with the adjustable weighting system 1800. The same steps will apply to the other embodiments of the weighting systems 1900, 2000, 2100, 2200, 2300.

A user can remove the member 1824 from the channel 1804 by disengaging the fasteners (not shown) from the respective bore (not shown) positioned in the channel 1804. Once removed from the channel 1804, the user can disengage (or otherwise remove) one or more of the weights 1844, 1856, 1872 from the body 1828. To remove the respective weight 1844, 1856, 1872, the user disengages the fastener (not shown) from the aligned apertures 1852*a*, 1852*c*, 1852*b*. The respective weight 1844, 1856, 1872 is then free to be disengaged from the body 1828 (e.g., by sliding, etc.). A user can then exchange the body 1828 or one or more of the weights 1844, 1856, 1872 with another having a different mass (e.g., lighter or heavier) to change the weighting characteristic of the golf club head 10. The body 1828 and/or weight 1844, 1856, 1872 having a different mass can then be reengaged (or reattached). More specifically the weight 1844, 1856, 1872 slidably receives a portion of the body 1328 at the mounting point 1876. Apertures 1852*a*, 1852*c*, 1852*b* can then be aligned and the fastener (not shown) can be reinserted through the apertures 1852*a*, 1852*c*, 1852*b*. The member 1824 can then be positioned (or repositioned) into the channel 1804, and each fastener (not shown) can be engaged (or reengaged) with the respective bore (not shown) in the channel 1304. It should be appreciated that the operation above applies not only to removal of the weights 1844, 1856, 1872, but also embodiments with more than three weights (e.g., three, four, five, or six or more weights, etc.).

By changing one or more of the body 1828 and/or the weights 1844, 1856, 1872, the center of gravity 58 can be adjusted (or altered). For example, a distance that the center of gravity 58 can be adjusted (or moved) can be in the range of 0.01 inches to 0.50 inches resulting in a ball trajectory change of 0.46 yards to 23 yards. In other embodiments, the club head center of gravity 58 can be adjusted (or moved) in the range of 0.050 inches to 0.200 inches resulting in a ball trajectory change of 2.3 yards to 9.2 yards.

Figure 34:
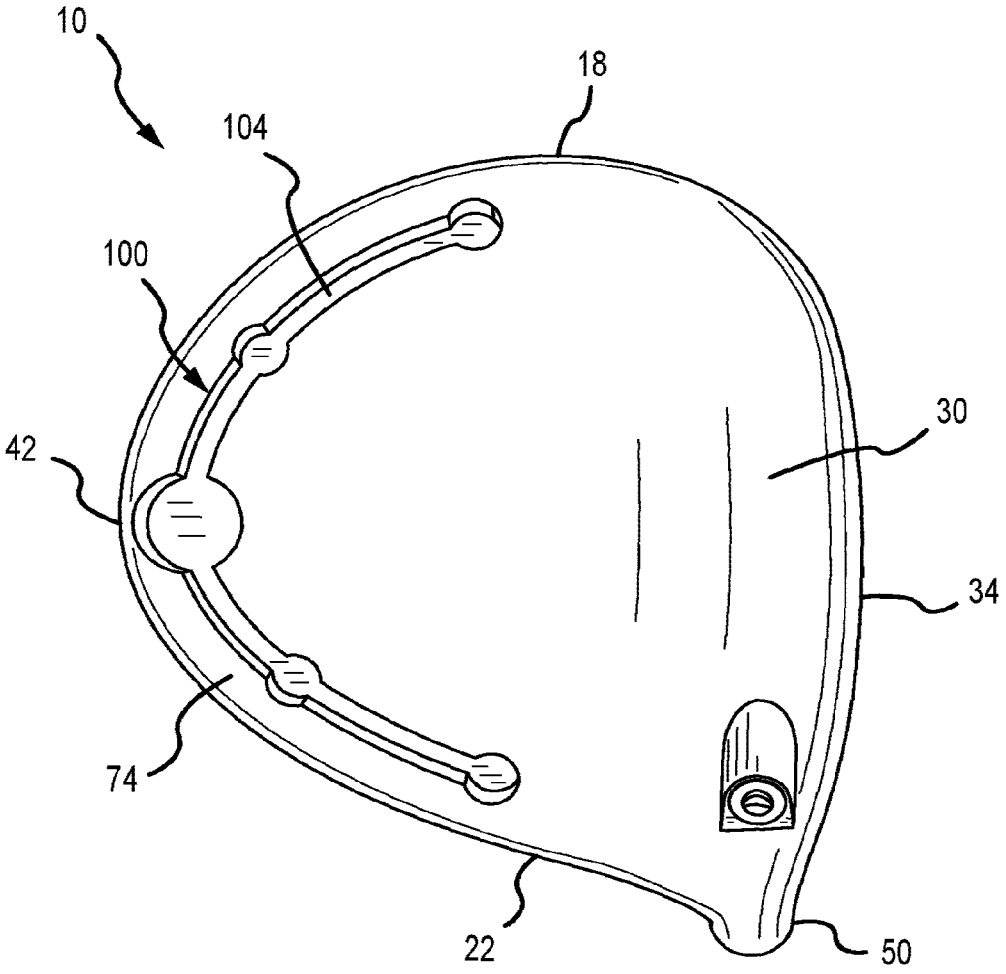
FIG. 34 is a perspective view of another embodiment of an adjustable weighting system positioned on the sole of the club head of FIG. 1, including a channel capable of receiving adjustable weights.

FIG. 34 illustrates an embodiment of the club head 10 having an adjustable weighting system 100. The system 100 includes a single port or channel or recessed track 104 configured to receive a weight or a plurality of weights (not shown). The weight or plurality of weights can be removed and repositioned to adjust the club head center of gravity, as described with respect to adjustable weighting systems 500, 700, 800, 900, 1000, 1100, 1300, 1400, 1500, 1600, 1700, 1800, 1900, 2000, 2100, 2200, 2300. The channel 104 is an arcuate or curved channel 104 positioned on a portion of the sole 30. Stated another way, the channel 104 is positioned towards the back 42 of the club head 10, proximate the rail 74, or positioned closer to the back 42 of the club head 10 than to the face plate 34. In other embodiments, the channel 104 can be positioned on the skirt 74, on both the skirt 74 and the sole 30, and/or at any other suitable location on the club head 10. While the channel 104 is illustrated as having a generally arcuate shape, in other embodiments, the channel 104 can take any shape (e.g., be linear, geometric, etc.). The single channel 104 includes a plurality of attachment points (or attachment positions) that are each configured to receive a weight (not shown).

In the illustrated embodiment of FIG. 34, the adjustable weighting system 100 is devoid of the member. Accordingly, the weight or plurality of weights can be removably secured directly to the body of the club head 10. The weight or plurality of weights can be removably secured to the club head body using threaded fasteners, magnets, snap fit, or any other suitable method. The weight or plurality of weights can be positioned at one or more locations within the channel 104. In the illustrated embodiment, the channel 104 comprises five positions or locations to receive weights. In other embodiments, the channel 104 can comprise two, three, four, or any other number of locations to receive weights.

C. Additional Coupling Mechanisms Embodiments of the Adjustable Weighting Systems FIGS. 30-33 illustrate exemplary means to couple the weight or weights to the insert or member of the adjustable weight systems 700, 800, 900, 1000, 1100, 1300, 1400, 1500, 1600, 1700, 1800, 1900, 2000, 2100, 2200, 2300 described herein. The mechanisms of coupling the weight(s) to the member or insert described with reference to FIGS. 30-33 can be used with any of the adjustable weighting systems 700, 800, 900, 1000, 1100, 1300, 1400, 1500, 1600, 1700, 1800, 1900, 2000, 2100, 2200, 2300 described herein.

Further, the mechanisms of coupling the weight(s) to the member or insert described with reference to FIGS. 30-33 can be used in addition to or instead of the mechanisms described with reference to adjustable weighting systems 700, 800, 900, 1000, 1100, 1300, 1400, 1500, 1600, 1700, 1800, 1900, 2000, 2100, 2200, 2300.

Figure 30:
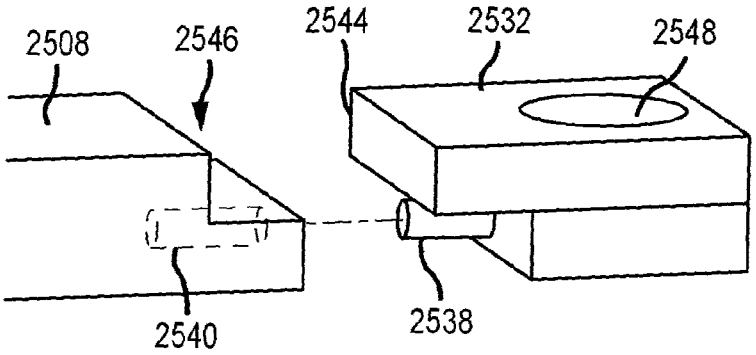
FIG. 30 is a perspective view of an exemplary coupling mechanism of a weight with a member or insert of an adjustable weighting system.

Referring to FIG. 30, in some embodiments, the insert or member 2508 can comprise a bore 2540 capable of receiving a protrusion 2528 on the weight or weights 2532 to provisionally couple the weight(s) 2532 to the member 2508. In the illustrated embodiment, the bore 2540 and the protrusion 2528 are cylindrical in shape. In other embodiments, the bore 2540 and the protrusion 2528 can have any corresponding shape. In some embodiments, the weight or weights 2532 can further comprise a lip 2544 positionable within or over a recess 2546 on the member to further secure the weight to the member when the adjustable weighting system is positioned within the channel on the club head.

Figure 31:
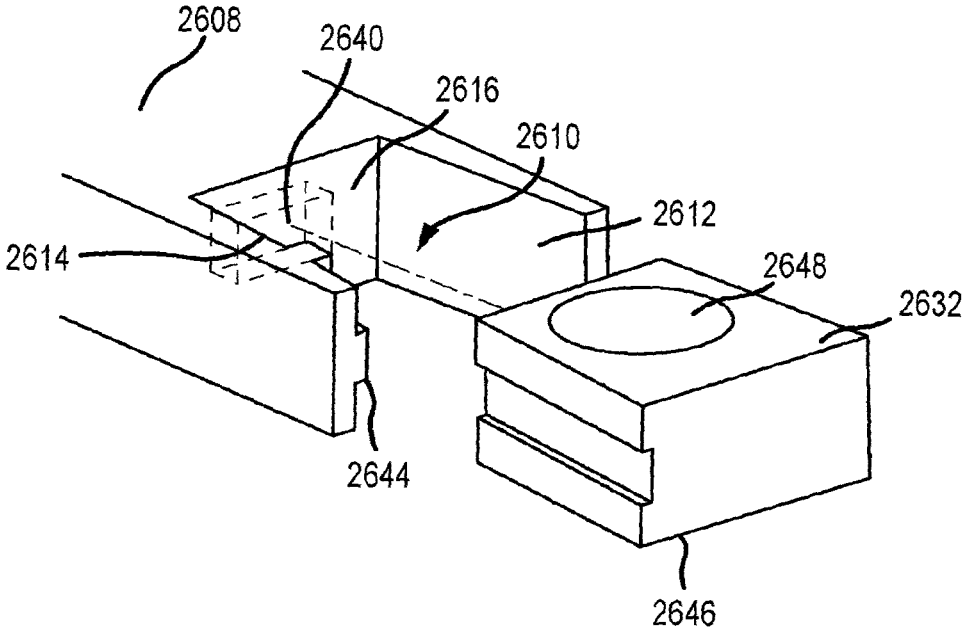
FIG. 31 is a perspective view of another exemplary coupling mechanism of a weight with a member or insert of an adjustable weighting system.

Referring to FIG. 31, in some embodiments, the insert or member 2608 can comprise one or more voids 2610 defined by a first side wall 2612, a second side wall 2614, and a back wall 2616. The one or more voids 2610 are capable of receiving the one or more weights 2632. In the illustrated embodiment, the back wall 2616 of the member has a bore 2640 capable of receiving a protrusion (not shown) on the weight 2632. Further, in the illustrated embodiment, the first side wall 2612 of the member 2608 comprises a rib or rail 2644 that is positionable through a channel 2646 on the weight 2632. The bore and protrusion, and the rib and channel of the adjustable weighting system provisionally couple the weight(s) 2632 to the member 2608.

In the embodiments illustrated in FIGS. 30-31, the adjustable weighting system is secured within the channel by a threaded fastener (not shown) positionable through a bore 2548, 2648 in the weight or weights 2532, 2632. In other embodiments, the adjustable weighting system can be secured within the channel by one or more threaded fasteners positionable through one or more bores in the member. In other embodiments still, the adjustable weighting system can be secured within the channel using other mechanisms.

Figure 32:
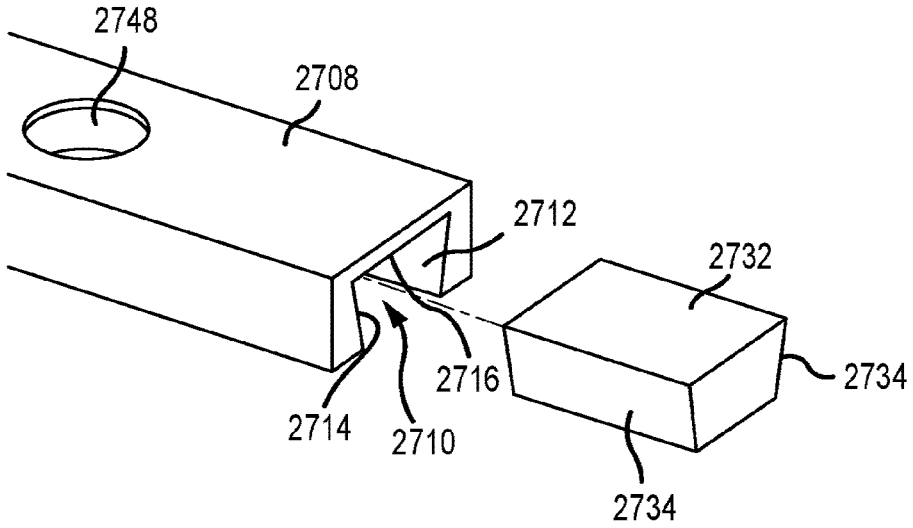
FIG. 32 is a perspective view of another exemplary coupling mechanism of a weight with a member or insert of an adjustable weighting system.

Referring to FIG. 32, in some embodiments, the insert or member 2708 can comprise one or more voids 2710 defined by a first side wall 2712, a second side wall 2714, and a top wall 2716. The one or more voids 2710 are capable of receiving the one or more weights 2732. In the illustrated embodiment, the first and second side walls 2712, 2714 are tapered such that the width of the void is larger near the top wall 2716 than near the open bottom. The weight 2732 comprises tapered side walls 2734 that correspond to the tapered first and second side walls 2712, 2714 of the void 2710 in the member 2708. The tapered wall configuration of the member void and the weights provisionally secure the weight 2734 within the void 2710 of the member 2708 and prevent the weight 2734 from dislodging from the member 2708 when the adjustable weighting system is removed from the club head. Further, in the illustrated embodiment, the member 2708 comprises a bore 2748 capable of receiving a threaded fastener to couple the adjustable weighting system to the club head.

Figure 33:
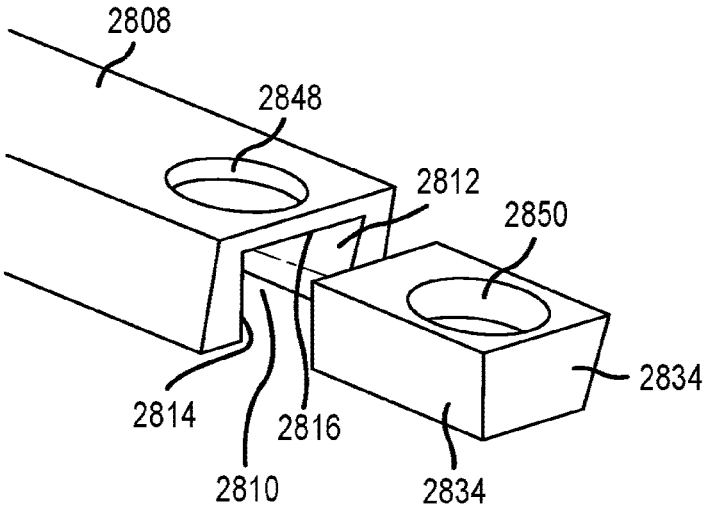
FIG. 33 is a perspective view of another exemplary coupling mechanism of a weight with a member or insert of an adjustable weighting system.

Referring to FIG. 33, in some embodiments, the insert or member 2808 can comprise one or more voids 2810 defined by a first side wall 2812, a second side wall 2814, and a top wall 2816. The one or more voids 2810 are capable of receiving the one or more weights 2832. In the illustrated embodiment, the first and second side walls 2812, 2814 are tapered such that the width of the void is larger near the top wall 2816 than near the open bottom. The weight 2832 comprises tapered side walls 2834 that correspond to the tapered first and second side walls 2812, 2814 of the void 2810 in the member 2808. The tapered wall configuration of the member void and the weights provisionally secure the weight 2834 within the void 2810 of the member 2808 and prevent the weight 2834 from dislodging from the member 2808 when the adjustable weighting system is removed from the club head. Further, in the illustrated embodiment, the member 2808 comprises a bore 2848 that corresponds to a bore 2850 on the weight 2834. The bores 2848, 2850 are capable of receiving a threaded fastener to couple the adjustable weighting system to the club head.

Example 1

According to one example, the golf club head 10 having the adjustable weighting system 1800 illustrated in FIGS. 23 and 24 comprises a member 1824 configured to be received by a channel 1804. The member 1824 includes a body 1828 and a plurality of attachment locations 1876 including a first attachment location 1876*a*, a second attachment location 1876*b*, and a third attachment location 1876*c*. The plurality of attachment locations are configured to receive a plurality of weights including a first weight 1844, a second weight 1856, and a third weight 1872 in various configurations.

The first weight 1844 of the exemplary adjustable weighting system 1800 first weight 1844 has a mass of 15 grams, the second weight 1856 of the exemplary adjustable weighting system 1800 has a mass of 0.5 grams, and the third weight 1872 of the exemplary adjustable weighting system 1800 has a mass of 0.5 grams.

The first weight is positionable at the first attachment location near the toe, the second attachment location near the center, or the third attachment location near the heel of the club head with the adjustable weighting system 1800 is positioned within the channel 1804. Referring to Table 1 below, the weight center of gravity $W_{CG}$ of the first weight is positioned at a distance D1 of 0.342 inch to 0.641 inch from the rear perimeter 74 of the club head 10 when the first weight is positioned at the first, second, or third attachment location. Further, the weight center of gravity $W_{CG}$ of the first weight is positioned at a distance D2 of 2.912 inches to 3.926 inches from the geometric center 140 of the strike face 34 when the first weight is positioned at the first, second, or third attachment location.

Further referring to Table 1 below, the club head 10 includes a head CG depth 10130 between 1.626 inches and 1.817 inches, and a head CG height 10132 of 0.206 inch to 0.210 inch above the head depth plane 10120 when the first weight is positioned at the first, second, or third attachment location. The exemplary club head 10 further includes a moment of inertia about the x-axis $I_{xx}$ between 3,665 and 4,052 g·cm$^2$, a moment of inertia about the y-axis $I_{yy}$ between 5,419 and 5,710 g·cm$^2$, and a moment of inertia about the hosel axis $I_{hh}$ between 9,722 and 11,026 g·cm$^2$ when the first weight is positioned at the first, second, or third attachment location. The combined moment of inertia of the exemplary club head 10 about the club head CG (i.e. the sum of the moment of inertia about the x-axis and the moment of inertia about the y-axis) is between 9,084 and 9,664 g·cm$^2$ when the first weight is positioned at the first, second, or third attachment location. The combined moment of inertia of the exemplary club head 10 about the club head CG and the hosel axis (i.e. the sum of the moment of inertia about the x-axis, the moment of inertia about the y-axis, and the moment of inertia about the hosel axis) is between 18,806 and 20,690 g·cm$^2$ when the first weight is positioned at the first, second, or third attachment location.

Further referring to Table 1 below, the exemplary club head having the adjustable weighting system 1800 has a depth to mass ratio of the club head CG depth to the mass of the first weight between 0.108 inch and 0.121 inch when the first weight is positioned at the first, second, or third attachment location. Further, the exemplary club head having the adjustable weighting system 1800 has a first inertia to mass ratio of the combined moment of inertia of the club head about the head CG to the mass of the first weight between 606 and 644 cm$^2$ when the first weight is positioned at the first, second, or third attachment location. Further still, the exemplary club head having the adjustable weighting system 1800 has a head CG to mass ratio of the maximum shift in head CG to the mass of the first weight of 0.015 inch/gram. Accordingly, the adjustable weighting system 1800 of the exemplary club head 10 maximizes head CG depth, moment of inertia, and head CG shift by a user, without the use of a large and heavy weight necessitating sizeable weight structures.

TABLE 1

Weighting Properties of Golf Club Head 10 having Exemplary Adjustable Weighting System 1800

| First weight position | First position (toe) | Second position (center) | Third position (heel) |
|---|---|---|---|
| $W_{CG}$-perimeter D1 (inch) | 0.403 | 0.641 | 0.342 |
| $W_{CG}$-face center D2 (inch) | 3.926 | 3.801 | 2.912 |
| $CG_D$ 10130 (inch) | 1.817 | 1.626 | 1.626 |
| $CG_H$ 10132 (inch above head depth plane 10120) | 0.210 | 0.207 | 0.206 |
| $I_{xx}$ (g · cm$^2$) | 3955 | 4052 | 3665 |
| $I_{yy}$ (g · cm$^2$) | 5710 | 5561 | 5419 |
| $I_{hh}$ (g · cm$^2$) | 11026 | 10522 | 9722 |
| $I_{xx} + I_{yy}$ (g · cm$^2$) | 9664 | 9613 | 9084 |
| $I_{xx} + I_{yy} + I_{hh}$ (g · cm$^2$) | 20690 | 20135 | 18806 |
| $CG_D$/mass (inch/g) | 0.121 | 0.108 | 0.108 |
| $I_{xx} + I_{yy}$/mass (cm$^2$) | 644 | 641 | 606 |
| Max CG shift/mass (in/g) | 0.015 | 0.015 | 0.015 |

Moving the weight between the first, second, and third attachment locations results in a maximum shift in the club head center of gravity of 0.2 inch. The maximum shift in center of gravity of the exemplary club head 6710 results in a total trajectory change of up to 9.3 yards (i.e. when shifting the first weight from the first to the second attachment location, or from the second to the first attachment location). Accordingly, shifting the weight from the third attachment location to the second attachment location can change the trajectory of a golf ball 4.6 yards to correct for a slice or generate a draw. Further, shifting the weight from the third attachment location to the first attachment location can change the trajectory of a golf ball 4.6 yards to correct for a hook or generate a fade.

Clause 1: A golf club head comprising: a club body having a crown opposite a sole, a toe end opposite a heel end, a back end, and a hosel, and wherein a channel is formed in the club body; and an adjustable weighting system including a member configured to be received by the channel and removably coupled to the club body, the member including a member body having a first end and a second end, the member further including a first attachment location positioned at the first end, a second attachment location positioned between the first and second ends, and a third attachment location positioned at the second end; a first weight configured to be removably coupled to the first attachment location of the member body, the first weight having a first mass; a second weight configured to be removably coupled to the second attachment location of the member body, the second weight having a second mass less than the first mass; a third weight configured to be removably coupled to the third attachment location of the member body, the third weight having a third mass less than the first mass; wherein the first weight, the second weight, and the third weight can be removed from the member and repositioned to change a center of gravity of the club head.

Clause 2: The golf club head of clause 1, wherein the first weight comprises a mass between 6 grams and 20 grams, and the second and third weights comprise a mass between 0.25 grams and 4 grams.

Clause 3: The golf club head of clause 2, wherein the club head further includes a club head center of gravity depth greater than 1.6 inches.

Clause 4: The golf club head of clause 3, wherein the club head further includes a depth to mass ratio of the club head center of gravity depth to the mass of the first weight greater than 0.060 inch/gram.

Clause 5: The golf club head of clause 1, wherein the channel includes a height between 0.1 inch and 0.5 inch.

Clause 6: The golf club head of clause 5, wherein the height of the channel varies from near the heel end to near the toe end of the club head such that the cross-sectional area of the channel varies.

Clause 7: The golf club head of clause 1, wherein each weight includes a weight center of gravity positioned within 0.50 inch of the perimeter of the club head.

Clause 8: The golf club head of claim 1, wherein: the first weight includes a first aperture, the first attachment location of the member body includes a second aperture aligned with the first aperture, and the aligned first and second apertures are configured to receive a first fastener, the second weight includes a third aperture, the second attachment location of the member body includes a fourth aperture aligned with the third aperture, and the aligned third and fourth apertures are configured to receive a second fastener, and the third weight includes a fifth aperture, the third attachment location of the member body includes a sixth aperture aligned with the fifth aperture, and the aligned fifth and sixth apertures are configured to receive a third fastener.

Clause 9: The golf club head of clause 8, wherein the channel includes a first bore, a second bore, and a third bore, and wherein the first bore is configured to receive the first fastener, the second bore is configured to receive the second fastener, and the third bore is configured to receive the third fastener to fasten the member to the club body, and wherein the first, second, and third fasteners comprise a density similar to or less than the density of the club head body.

Clause 10: The golf club head of clause 2, wherein a combined moment of inertia of the club head about the club head center of gravity, defined as the sum of a crown-to-sole moment of inertia and a heel-to-toe moment of inertia, is greater than 8,000 g·cm$^2$.

Clause 11: The golf club head of clause 10, wherein the a ratio of the combined moment of inertia of the club head about the club head center of gravity to the mass of the first weight is greater than 400 $cm^2$.

Clause 12: A golf club head comprising: a club body having a crown opposite a sole, a toe end opposite a heel end, a back end, and a hosel, and wherein a channel is formed in the club body; and an adjustable weighting system including a member configured to be received by the channel and removably coupled to the club body, the member including a member body having a first end and a second end, a first weight configured to be removably coupled to the first end of the member body the first weight having a first mass, and a second weight configured to be removably coupled to the second end of the member body the second weight having a second mass less than the first mass, wherein the first weight and the second weight can be removed from the member and repositioned to change a center of gravity of the club head.

Clause 13: The golf club head of clause 12, wherein the first weight includes a first aperture, the first end of the body includes a second aperture aligned with the first aperture, and the aligned first and second apertures are configured to receive a fastener.

Clause 14: The golf club head of clause 13, wherein the channel includes a bore configured to receive the fastener to fasten the member within the channel of the club body.

Clause 15: The golf club head of clause 13, wherein the fastener is a first fastener, and the second weight includes a third aperture, the second end of the body includes a fourth aperture aligned with the third aperture, and the aligned third and fourth apertures are configured to receive a second fastener.

Clause 16: The golf club head of clause 15, wherein the channel includes a first bore and a second bore, the first bore is configured to receive the first fastener and the second bore is configured to receive the second fastener to fasten the member to the club body.

Clause 17: A golf club head comprising: a club body having a crown opposite a sole, a toe end opposite a heel end, a back end, and a hosel; and a face angle adjustment system positioned on the sole, the face angle adjustment system including a single channel, and a member that is removably received by the channel, the member including a member body having a first end member and a second end member, wherein the member is configured to be repositioned within the channel to adjust a resting face angle of the golf club head.

Clause 18: The golf club head of clause 17, wherein the member includes a body, wherein the first end member is coupled to the body and configured to rotate with respect to the body, and wherein the second end member is coupled to the body and configured to rotate with respect to the body.

Clause 19: The golf club head of clause 18, wherein the first and second end members are configured to rotate with respect to the body between a first configuration, a second configuration, and a third configuration, wherein: in the first configuration the first end member extends out of the channel and the second end member does not extend out of the channel, in the second configuration the second end member extends out of the channel and the first end member does not extend out of the channel, and in the third configuration the first end member and the second end member do not extend out of the channel.

Clause 20: The golf club head of clause 17, wherein each of the first and second end members includes a first side and a second side, the first side being longer than the second side.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a wood-type golf club, the apparatus, methods, and articles of manufacture described herein may be applicable to other types of golf club such as a driver wood-type golf club, a fairway wood-type golf club, a hybrid-type golf club, an iron-type golf club, a wedge-type golf club, or a putter-type golf club. Alternatively, the apparatus, methods, and articles of manufacture described herein may be applicable to other types of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

The invention claimed is:

1. A golf club head comprising:

a club body having a crown opposite a sole, a toe end opposite a heel end, a back end, and a hosel, and wherein a channel is formed in the club body; and an adjustable weighting system comprising:

a member configured to be received by the channel, the member having a member body, a first weight, and a second weight;

wherein the member body comprises a first end and a second end opposite the first end, wherein the first end defines a first aperture and the second end defines a second aperture;

the first weight comprises opposing first weight apertures that are positioned through the first weight on opposing sides of a first slot and the second weight comprises opposing second weight apertures that are positioned through the second weight on opposing sides of a second slot;

wherein the first end is slidably received by the first slot such that the first aperture is positioned between the opposing first weight apertures and the second end is slidably received by the second slot such that the second aperture is positioned between the opposing second weight apertures;

the first weight is secured to the first end via the first aperture and the second weight is secured to the second end via the second aperture;

wherein:

the channel further comprises a first channel portion, a second channel portion, and a third channel portion;

the second channel portion is positioned between the first channel portion and the third channel portion;

the first channel portion defines a second width defined as a distance between opposing sides of the channel in the first channel portion;

the second channel portion defines a first width defined as a distance between opposing sides of the channel in the second channel portion;

the third channel portion defines a third width defined as a distance between opposing sides of the channel in the third channel portion;

the first width is less than the second width, and the first width is less than the third width; and the second width and the third width are different.

2. The golf club head of claim 1, wherein;

the channel comprises a first tapered end and a second tapered end;

the first tapered end is positioned in the first channel portion and comprises a first depth;

the second tapered end is positioned in the third channel portion and comprises a second depth; and the first depth is equal to the second depth.

3. The golf club head of claim 2, wherein:

the first depth defines a first depth taper and the second depth defines a second depth taper;

the first depth taper gradually decreases in depth in a direction towards an edge of the channel defined by the first channel portion; and the second depth taper gradually decreased in a depth in a direction toward an edge of the channel define by the third channel portion.

4. The golf club head of claim 1, wherein:

the channel includes a height defined as the distance between the sole and a bottom surface of the channel; and the height is between 0.1 inch and 0.5 inch.

5. The golf club head of claim 2, wherein a body member comprises a shape that is complementary to a shape of the channel, such that the body member is received by the channel.

6. The golf club head of claim 1, wherein the channel is formed on the sole, proximate to the back end, and comprises an arcuate shape when viewed perpendicularly to the sole.

7. The golf club head of claim 1, wherein the first weight comprises a mass between 6 grams and 20 grams, and the second weight comprises a mass between 0.25 grams and 4 grams.

8. The golf club head of claim 1, wherein the first weight, and the second weight comprise substantially the same shape.

9. The golf club head of claim 1, wherein each of the first weight and the second weight includes a weight center of gravity positioned within 0.50 inch of a perimeter of the golf club head.

10. The golf club head of claim 1, wherein a combined moment of inertia of the golf club head about a club head center of gravity, defined as a sum of a crown-to-sole moment of inertia and a heel-to-toe moment of inertia, is greater than 8,000 $g \cdot cm^2$.

11. A golf club head comprising:

a club body having a crown opposite a sole, a toe end opposite a heel end, a back end, and a hosel, and wherein a channel is formed in the club body; and an adjustable weighting system comprising:

a member configured to be received by the channel, the member having a member body, a first weight, a second weight;

wherein the member body comprises a first end and a second end opposite the first end, wherein the first end defines a first aperture and the second end defines a second aperture;

the first weight comprises opposing first weight apertures that are positioned through the first weight on opposing sides of a first slot and the second weight comprises opposing second weight apertures that are positioned through the second weight on opposing sides of a second slot;

wherein the first end is slidably received by the first slot such that the first aperture is positioned between the opposing first weight apertures and the second end is slidably received by the second slot such that the second aperture is positioned between the opposing second weight apertures;

the first weight is secured to the first end via the first aperture and the second weight is secured to the second end via the second aperture;

wherein:

the channel further comprises; a first channel portion, a second channel portion, and a third channel portion;

the second channel portion is positioned between the first channel portion and the third channel portion;

the first channel portion defines a second width defined as a distance between opposing sides of the channel in the first channel portion;

the second channel portion defines a first width defined as a distance between opposing sides of the channel in the second channel portion;

the third channel portion defines a third width defined as a distance between opposing sides of the channel in the third channel portion;

the first width is less than the second width and the first width is less than the third width; and the second width and the third width are equal.

12. The golf club head of claim 11, wherein;

the channel comprises a first tapered end and a second tapered end;

the first tapered end is positioned in the first channel portion and comprises a first depth;

the second tapered end is positioned in the third channel portion and comprises a second depth; and wherein the first depth and the second depth are the same.

13. The golf club head of claim 12, wherein;

the first depth defines a first depth taper and the second depth defines a second depth taper;

the first depth taper gradually decreases in depth in a direction towards an edge of the channel defined by the first channel portion; and the second depth taper gradually decrease in a depth in a direction toward an edge of the channel define by the third channel portion.

14. The golf club head of claim 11, wherein; the channel includes a height defined as the distance between the sole and a bottom surface of the channel; and the height is between 0.1 inch and 0.5 inch.

15. The golf club head of claim 11, wherein the body member comprises a shape that is complementary to a shape of the channel, such that the body member is received by the channel.

16. The golf club head of claim 11, wherein the channel is formed on the sole, proximate to the back end, and comprises an arcuate shape when viewed perpendicularly to the sole.

17. The golf club head of claim 11, wherein a combined moment of inertia of the golf club head about a club head center of gravity, defined as a sum of a crown-to-sole moment of inertia and a heel-to-toe moment of inertia, is greater than 8,000 g $g \cdot cm^2$.

18. The golf club head of claim 11, wherein each of the first weight and the second weight includes a weight center of gravity positioned within 0.50 inch of a perimeter of the golf club head.

* * * * *